US008581677B2

(12) United States Patent
Kawai et al.

(10) Patent No.: US 8,581,677 B2
(45) Date of Patent: Nov. 12, 2013

(54) VARIABLE RESONATOR, VARIABLE BANDWIDTH FILTER, AND ELECTRIC CIRCUIT DEVICE

(75) Inventors: Kunihiro Kawai, Yokohama (JP); Hiroshi Okazaki, Zushi (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 0 days.

(21) Appl. No.: 13/612,928

(22) Filed: Sep. 13, 2012

(65) Prior Publication Data

US 2013/0002374 A1 Jan. 3, 2013

Related U.S. Application Data

(62) Division of application No. 11/851,776, filed on Sep. 7, 2007, now Pat. No. 8,294,537.

(30) Foreign Application Priority Data

| | | |
|---|---|---|
| Sep. 8, 2006 | (JP) | 2006-244707 |
| Jun. 25, 2007 | (JP) | 2007-166362 |
| Aug. 27, 2007 | (JP) | 2007-219967 |

(51) Int. Cl.
*H01P 1/203* (2006.01)
*H01P 7/08* (2006.01)

(52) U.S. Cl.
USPC ..... 333/205; 333/235

(58) Field of Classification Search
USPC ..... 333/205, 235
See application file for complete search history.

(56) References Cited

U.S. PATENT DOCUMENTS

| | | | | |
|---|---|---|---|---|
| 4,250,475 | A * | 2/1981 | Schwarzmann | 333/205 |
| 5,162,759 | A | 11/1992 | Yajima | |
| 5,400,002 | A | 3/1995 | Takahashi et al. | |
| 5,659,274 | A | 8/1997 | Takahashi et al. | |
| 6,452,465 | B1 | 9/2002 | Brown et al. | |

(Continued)

FOREIGN PATENT DOCUMENTS

| | | |
|---|---|---|
| JP | 08-56104 | 2/1996 |
| JP | 2001-230602 | 8/2001 |
| JP | 2004-007352 | 1/2004 |
| JP | 2005-217852 | 8/2005 |

OTHER PUBLICATIONS

Office Action issued Nov. 19, 2010, in Chinese Patent Application No. 200710149629.2 with English translation.

(Continued)

*Primary Examiner* — Benny Lee
*Assistant Examiner* — Gerald Stevens
(74) *Attorney, Agent, or Firm* — Oblon, Spivak, McClelland, Maier & Neustadt, L.L.P.

(57) ABSTRACT

A variable resonator includes a ring-shaped conductor line (2) which is provided on a dielectric substrate (5) and has a circumferential length of a wavelength at a resonance frequency or an integral multiple of the wavelength, and at least two circuit switches ($\mathbf{3}_1$, $\mathbf{3}_2$), wherein the circuit switches ($\mathbf{3}_1$, $\mathbf{3}_2$) have one ends (31) electrically connected to the ring-shaped conductor line (2) and the other ends (32) electrically connected to a ground conductor (4) formed on the dielectric substrate (5), electrical connection/disconnection between the ground conductor (4) and ring-shaped conductor line (2) can be switched, and the one ends (31) of the circuit switches ($\mathbf{3}_1$, $\mathbf{3}_2$) are connected to the ring-shaped conductor line (2) on different portions.

25 Claims, 44 Drawing Sheets

(56) References Cited

U.S. PATENT DOCUMENTS

| | | | |
|---|---|---|---|
| 6,778,023 | B2 | 8/2004 | Christensen |
| 2003/0025563 | A1 | 2/2003 | Christensen |
| 2005/0190018 | A1 | 9/2005 | Kawai et al. |
| 2006/0028301 | A1 | 2/2006 | Kamata et al. |
| 2006/0087388 | A1 | 4/2006 | Kawai et al. |

OTHER PUBLICATIONS

Dimitrios Peroulis, et al. "Tunable Lumped Components with Applications to Reconfigurable MEMS Filters," 2001 IEEE MTT-S Digest, TU4C-6, pp. 341-344.

Hong-Teuk Kim, et al. "Low-Loss and Compact V-Band MEMS-Based Analog Tunable Bandpass Filters", IEEE Microwave and Wireless Components Letters, vol. 12, No. 11, Nov. 2002, pp. 432-434.

E. Fourn, et al., "Bandwidth and Central Frequency Control on Tunable Bandpass Filter by Using MEMS Cantilevers", 2003 IEEE MTT-S Digest, IFTU-21, pp. 523-526.

Arnaud Pothier, et al. "Low-Loss 2-Bit Tunable Bandpass Filters Using MEMS DC Contact Switches," IEEE Transactions on Microwave Theory and Techniques, vol. 53, No. 1, Jan. 2005, pp. 354-360.

Bruce E. Carey-Smith, et al., "Wide Tuning-Range Planar Filters Using Lumped-Distributed Coupled Resonators", IEEE Transactions on Microwave Theory and Techniques, vol. 53, No. 2, Feb. 2005, pp. 777-785.

Kamran Entesari, et al., "A Differential 4-bit 6.5-10-GHz RF MEMS Tunable Filter", IEEE Transactions on Microwave Theory and Techniques, vol. 53, No. 3, Mar. 2005, pp. 1103-1110.

Kamran Entesari, et al., "A 12-18-GHz Three-Pole RF MEMS Tunable Filter", IEEE Transactions on Microwave Theory and Techniques, vol. 53, No. 8, Aug. 2005, pp. 2566-2571.

Lung-Hwa Hsieh, et al., "Slow-Wave Bandpass Filters Using Ring or Stepped-Impedance Hairpin Resonators", IEEE Transactions on Microwave Theory and Techniques, vol. 50, No. 7, Jul. 2002, pp. 1795-1800.

Kunihiro Kawai, et al., "Tunable Resonator Employing Comb-Shaped Transmission Line and Switches", pp. 193-196, Oct. 2005.

Arun Chandra Kundu, et al., "Attenuation Pole Frequency Control of a Dual-Mode Circular Microstrip Ring Resonator BPF," 29$^{th}$ European Microwave Conference—Munich 1999, pp. 329-332.

Kunihiro Kawai, et al., "Tunable Band-pass Filter Employing Comb-shaped Transmission Line Resonator", 2005 Electronics Society Conference of the Institute of Electronics, Information and Communication Engineers, C-2-37, p. 58 (with English Translation).

Kunihiro Kawai, et al., "Center-frequency and Bandwidth Tunable Band-pass Filter Employing Comb-shaped Transmission Line Resonator," 2006 General Conference of the Institute of Electronics, Information and Communication Engineers, C-2-35, p. 66 (with English Translation).

Kunihiro Kawai, et al., "Center Frequency and Bandwidth Tunable Filter Employing Tunable Comb-Shaped Transmission Line Resonators and J-inverters", Proceedings of the 35$^{th}$ European Microwave Conference, Manchester UK, Sep. 2006, pp. 649-652.

Kunihiro Kawai, et al., "Comb-shaped Transmission Line Tunable Resonator Employing MEMS RF Switches", Research Laboratories, NTT DoCoMo, Inc., 2006 Electronics Society Conference of the Institute of Electronics, Information and Communication Engineers, C-2-77, p. 96 (with English Translation).

Lei Zhu, et al., "A Joint Field/Circuit Design Model of Microstrip Ring Dual-Mode Filter: Theory and Experiments", 1997 Asia Pacific Microwave Conference, 4P18-7, pp. 865-868.

Julio A. Navarro, et al., "Varactor-Tunable Uniplanar Ring Resonators," IEEE Transactions on Microwave Theory and Techniques, vol. 41, No. 5, XP-000396777, May 1993, pp. 760-766.

Lung-Hwa Hsieh, et al., "Compact, Low Insertion-Loss, Sharp-Rejection, and Wide-Band Microstrip Bandpass Filters," IEEE Transactions on Microwave Theory and Techniques, vol. 51, No. 4, XP-001145365, Apr. 2003, pp. 1241-1246.

Cesar Lugo, Jr., et al., "Single Switch Reconfigurable Bandpass Filter with Variable Bandwidth Using a Dual-Mode Triangular Patch Resonator," Microwave Symposium Digest, XP-010844588, Jun. 12, 2005, pp. 779-782.

P. Gardner, et al., "Planar Microstrip Ring Resonator Filters," IEE Colloquium on Microwave Filters and Antennas for Personal Communication Systems, XP-006519862, Feb. 22, 1994, pp. 1-6.

T. Scott Martin, et al., "Electronically Tunable and Switchable Filters Using Microstrip Ring Resonator Circuits," International Microwave Symposium, vol. 2, XP-010069992, May 25, 1988, pp. 803-806.

Christen Rauscher, "Reconfigurable Bandpass Filter with a Three-to-One Switchable Passband Width," IEEE Transactions on Microwave Theory and Techniques, vol. 51, No. 2, XP-011076886, Feb. 2003, pp. 573-577.

* cited by examiner

VARIABLE RESONATOR, VARIABLE BANDWIDTH FILTER, AND ELECTRIC CIRCUIT DEVICE

CROSS-REFERENCE TO RELATED APPLICATIONS

This application is a divisional of U.S. application Ser. No. 11/851,776, filed Sep. 7, 2007, now U.S. Pat. No. 8,294,537, issued Oct. 23, 2012, the entire content of which is incorporated herein by reference, and claims priority under 35 U.S.C. 119 to Japanese Application Nos. 2006-244707 filed Sep. 8, 2006; 2007-166362 filed Jun. 25, 2007; and 2007-219967 filed Aug. 27, 2007.

TECHNICAL FIELD

The present invention relates to variable resonator, variable bandwidth filter and electric circuits using the same.

BACKGROUND ART

In the field of radio communications using high frequencies, signals having specific frequencies are extracted from a number of signals, so that necessary signals and unnecessary signals are separated from each other. Circuits having such a function are called filters and are installed in various radio communication devices.

Generally, filters have invariable bandwidths as design parameters. When using various frequency bandwidths in radio communication devices using such filters, it may easily occur that a plurality of filters are prepared for those bandwidths to be used and are switched by switches and so on. This method requires filters as many as required number of bandwidths and thus increases the scale of the circuit, resulting in a large device size. Further, such devices cannot be operated at frequencies other than frequencies having the frequency characteristics of prepared filters.

In order to solve this problem, in Patent literature 1, a piezoelectric element is used for a resonator composing a filter and the frequency characteristics of the piezoelectric element are changed by applying a bias voltage to the piezoelectric element from the outside, so that the bandwidth is changed.

Patent literature 1: Japanese Patent Application Laid-Open No. 2004-7352

Although the variable filter disclosed in Patent literature 1 is formed as a ladder filter to provide a certain bandwidth, a change in the center frequency is as small as under 1%, due to restrictions imposed by the characteristics of the piezoelectric element, allowing change in the bandwidth to a similar extent, so that the bandwidth cannot be largely changed.

DISCLOSURE OF THE INVENTION

In view of these circumstances, an object of the present invention is to provide a variable resonator, a variable bandwidth filter, and an electric circuit device which can largely change a bandwidth.

In order to solve this problem, a variable resonator according to a first aspect of the present invention is configured as follows: the variable resonator includes a ring-shaped conductor line provided on a dielectric substrate and having a circumferential length of one or an integral multiple of a wavelength at a resonance frequency, and two or more first circuit switches, wherein the first circuit switches have one ends electrically connected to different portions on the ring-shaped conductor line and the other ends electrically connected to a ground conductor formed on the dielectric substrate, and can switch electrical connection/disconnection between the ground conductor and ring-shaped conductor line.

With this configuration, a bandwidth around the resonance frequency can be largely changed by switching the circuit switches to be electrically connected.

The ground conductor and the other end of the circuit switch electrically connected to the ground conductor may be electrically connected to each other via a passive element.

The passive element includes, for example, a resistor, a variable resistor, a capacitor, a variable capacitor, an inductor, and a variable inductor.

In this variable resonator, the loss of a signal at the resonance frequency is mainly contributed by conductor lines composing the variable resonator, and the influence of an insertion loss caused by the circuit switch and so on is small. Thus the configuration can include the passive element.

When such a passive element is provided, a switch may be provided to switch electrical connection between the ground conductor and the ring-shaped conductor line either via the passive element or directly.

A variable resonator according to a second aspect of the present invention includes a ring-shaped conductor line provided on a dielectric substrate and having a circumferential length of one or an integral multiple of a wavelength at a resonance frequency, and two or more first circuit switches, wherein the first circuit switches have one ends electrically connected to different portions on the ring-shaped conductor line and the other ends electrically connected to a transmission line formed on the dielectric substrate, and can switch electrical connection/disconnection to the ring-shaped conductor line.

When the variable resonator according to the first or second aspect is used for, for example, a variable bandwidth filter provided mainly to allow the passage of a signal having a desired frequency, the circuit switch is not provided on the ring-shaped conductor line at the connecting portion of the transmission line or a position of a half wavelength or integral multiple thereof at the resonance frequency from the connecting portion. Even if the circuit switches are provided on these positions, a signal cannot be derived therefrom. The reason will be described later.

The ring-shaped conductor line may be closed by combining a plurality of conductor lines having different line widths. The ring-shaped conductor line enabling selection of different characteristics may be formed by providing a first conductor line, a plurality of second conductor lines having different characteristics, and a second circuit switch which electrically connects the first conductor line and selected one of the second conductor lines to form a closed path.

Further, the first variable resonator according to the first or second aspect and the second variable resonator according to the first or second aspect may be electrically connected to each other via the second circuit switch, and the second variable resonator may be disposed inside the ring-shaped conductor line of the first variable resonator.

In this configuration, the first variable resonator and the second variable resonator are connected to two different positions via the two second circuit switches. Relative to the connecting position of one of the second circuit switches, the other second circuit switch is disposed on the position of a half wavelength or integral multiple thereof at the resonance frequency of the first variable resonator on the ring-shaped conductor line of the first variable resonator, and is disposed on a position at a half wavelength or integral multiple thereof at the resonance frequency of the second variable resonator on the ring-shaped conductor line of the second variable resonator.

In order to solve the problem, the variable bandwidth filter according to a third aspect of the present invention is configured as follows: the variable bandwidth filter includes at least one variable resonator according to the first aspect and an input/output line, wherein the variable resonator and the input/output line are electrically connected to each other.

By using the variable resonator, the passband width can be largely changed.

Moreover, the at least one variable resonator may be connected in parallel to the input/output line on the connecting portion. Further, the at least two variable resonators may be connected in parallel to the input/output line on the connecting portion. The second circuit switches capable of switching electrical connection/disconnection between the input/output line and the variable resonators may be provided on the connecting portions. All or some of the variable resonators may be electrically connected to the input/output line by selecting the second circuit switches.

Alternatively, the at least one variable resonator may be connected in series with the input/output line on the two connecting portions. The two connecting portions are each disposed on the position of a half wavelength or integral multiple thereof at the resonance frequency of the variable resonator on the ring-shaped conductor line of the variable resonator, and the circuit switches may not be connected to the connecting portions.

In order to solve the problem, an electric circuit device according to a fourth aspect of the present invention is configured as follows: The electric circuit device includes the variable resonator according to the first or second aspect, a first input/output line, and a second input/output line, wherein the end of the second input/output line is connected to the connecting portion of the end of the first input/output line and the ring-shaped conductor line of the variable resonator, the first input/output line, the second input/output line, and the ring-shaped conductor line are electrically connected to one another, and on the connecting portion, the end of the first input/output line and the end of the second input/output line are disposed on different planes.

Alternatively, the electric circuit device may include a variable resonator according to the first or second aspect and an input/output line having a bent portion, and the bent portion of the input/output line and the ring-shaped conductor line of the variable resonator may be electrically connected to each other.

Further, the ring-shaped conductor line of the variable resonator may be combined with the input/output line to form an angle on and near a portion where the bent portion of the input/output line and the ring-shaped conductor line of the variable resonator are electrically connected to each other.

Effects of the Invention

According to the present invention, a given circuit switch is selected from a plurality of circuit switches and is turned on (electrically connected) and thus it is possible to largely change a bandwidth while keeping a resonance frequency constant.

Further, in the variable resonator of the present invention, the loss of a signal at the resonance frequency is mainly controlled by a conductor line composing the variable resonator, thereby reducing the influence of an insertion loss caused by a circuit switch and so on. For this reason, even when a filter is configured using a circuit switch having a large loss for the variable resonator, it is possible to reduce the loss of the passband of a signal.

Further, in an electric circuit device of the present invention, by using the variable resonator of the present invention, it is possible to largely change a bandwidth around the resonance frequency and suppress an insertion loss caused by connecting the variable resonator.

BRIEF DESCRIPTION OF THE DRAWINGS

FIG. 12A shows the frequency characteristics of the variable bandwidth filter shown in FIG. 11B, where one of the switches is turned on;

FIG. 12B shows the frequency characteristics of the variable bandwidth filter shown in FIG. 11B, where both of the switches are turned on;

FIG. 12C shows the frequency characteristics of the variable bandwidth filter shown in FIG. 11B, where the characteristic impedances of variable resonators are respectively set at twice and a half that of an input/output line, one switch is turned off, and the other switch is turned on;

FIG. 30B is a graph showing frequency characteristics when a switch is turned on;

FIG. 30C is a graph showing frequency characteristics when a switch is turned on;

BEST MODES FOR CARRYING OUT THE INVENTION

Figure 1A:
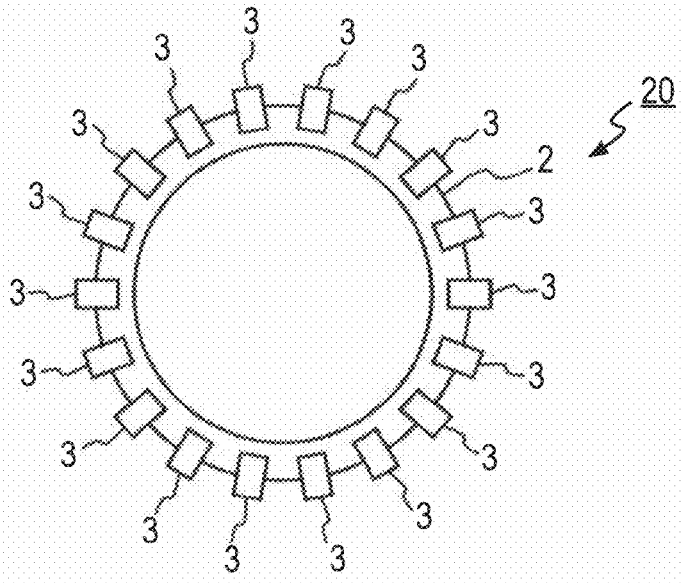
FIG. 1A is a plan view showing a variable resonator according to an embodiment of the present invention.
Figure 1B:
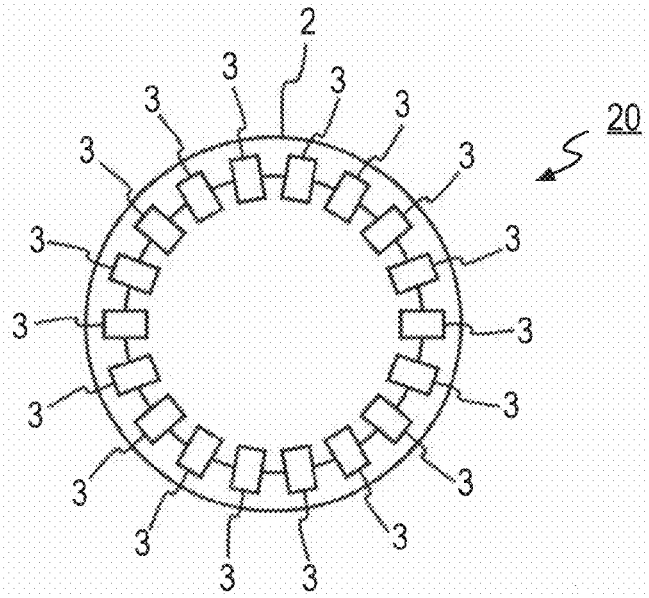
FIG. 1B is a plan view showing a variable resonator according to another embodiment.
Figure 1C:
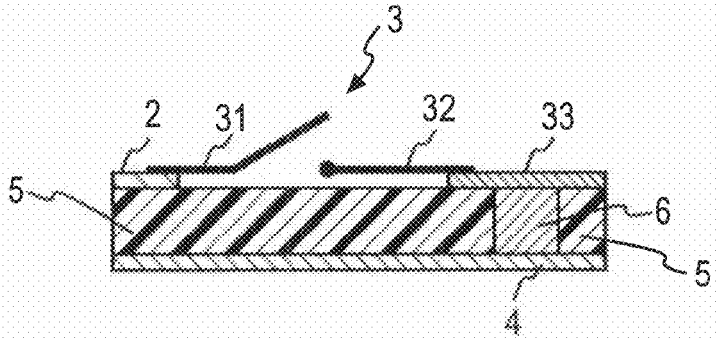
FIG. 1C is a sectional view showing a switch of the variable resonator.

FIGS. 1A and 1B show variable resonators 20 of the present invention having ring-shaped microstrip line structures of two patterns. FIG. 1C is a cross-sectional example in which the ring of the variable resonator 20 of FIG. 1A or 1B is cut on the position of one switch 3. The variable resonators 20 of FIGS. 1A and 1B are each made up of a ring-shaped conductor line 2 (hereinafter, simply will be referred to as a ring-shaped line) and the switches 3 which are at least two circuit switches. "Ring-shaped" does not always have to be a circular shape, as will be described later, as long as the line forms a closed loop. As shown in the cross-sectional view of FIG. 1C, the ring-shaped line 2 is formed of a metal on one of the surfaces of a dielectric substrate 5. The dielectric substrate 5 has a ground conductor 4 formed of a metal on the opposite surface (will be referred to as the backside) from the surface having the ring-shaped line 2. The switch 3 has one end 31 electrically connected to the ring-shaped line 2 and the other end 32 electrically connected to the ground conductor 4 on the backside of the dielectric substrate 5 via a conductor 33 and a via hole 6. Since the shape and so on of the conductor 33 are not limited at all, the conductor 33 is not shown in FIGS. 1A and 1B. The layout of the switches 3 is not limited to equal spacings and may be freely designed to obtain a desired bandwidth. In the present specification, the switches are not limited to contact type switches and thus may be so-called switching elements using, for example, diodes, transistors, MOS devices, and so on and may have a circuit switching function with no contacts provided in a network. To be specific, switching diodes and the like are available.

The ring-shaped line 2 has a length allowing a phase change of 2π, that is, 360° at a desired resonance frequency. In other words, the ring-shaped line has a length which is a wavelength at the resonance frequency or an integral multiple of the wavelength. In the variable resonators 20 of FIGS. 1A and 1B, the ring-shaped lines are circular lines.

In this case, "length" means the circumferential length of the ring-shaped line.

"Desired resonance frequency" is a factor of performance generally required for resonators and is a given design matter. The variable resonance circuit of the present invention can be used in an alternating-current circuit and the target resonance frequency is not particularly limited. For example, the variable resonance circuit is useful when the resonance frequency is a high frequency of 100 kHz or higher.

A difference between the variable resonators 20 of FIG. 1A and FIG. 1B is whether the other end 32 of the switch 3 is disposed inside or outside the ring-shaped line 2. In the variable resonator 20 of FIG. 1A, the other end 32 of the switch 3 is disposed outside the ring-shaped line 2. In the variable resonator 20 of FIG. 1B, the other end 32 of the switch 3 is disposed inside the ring-shaped line 2.

The features of the two embodiments are applicable to, for example, the configurations of FIGS. 8, 11 and 27 (will be described later).

Figure 2A:
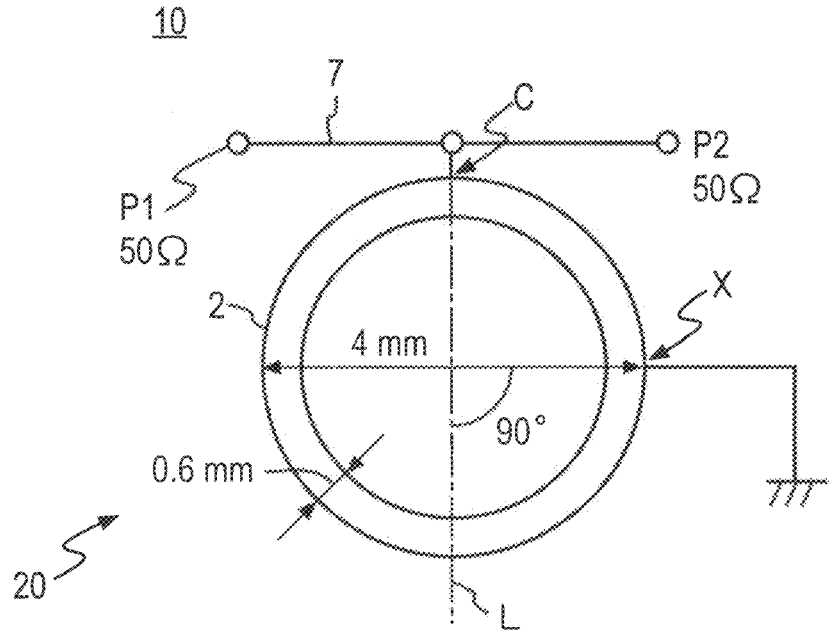
FIG. 2A is a circuit diagram for electromagnetic field simulations, showing the characteristics of the variable resonator.
Figure 2B:
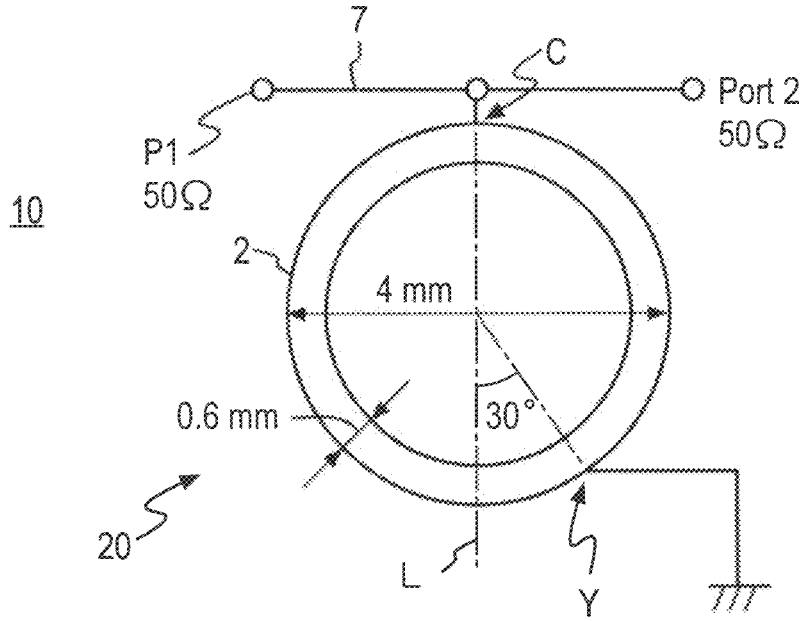
FIG. 2B is a circuit diagram for electromagnetic field simulations, showing the characteristics of the variable resonator.

The characteristics of the variable resonator 20 are represented by the electromagnetic field simulations of circuits 10 shown in FIGS. 2A and 2B.

In each of the circuits 10 of FIGS. 2A and 2B, the variable resonator 20 of either FIG. 1A or 1B is connected in parallel to the input/output line 7 illustrated as a transmission line between ports P1 and P2 and the circuit 10 act as a variable bandwidth filter. In the electromagnetic field simulations, the dielectric substrate 5 had a relative dielectric constant $\in_r$ of 9.6 and a thickness of 0.635 mm, and the ring-shaped line 2 had an outside diameter of 4 mm and an inside diameter of 3.4 mm. A conductor composing the ring-shaped line 2, a conductor forming the via hole 6, and the ground conductor 4 all had a resistance of 0. Further, the port impedance of the input/output line 7 was 50Ω. The illustration of the switches 3 is omitted for the sake of simplicity and the simulations were performed while changing the position of the via hole 6 instead.

Figure 3A:
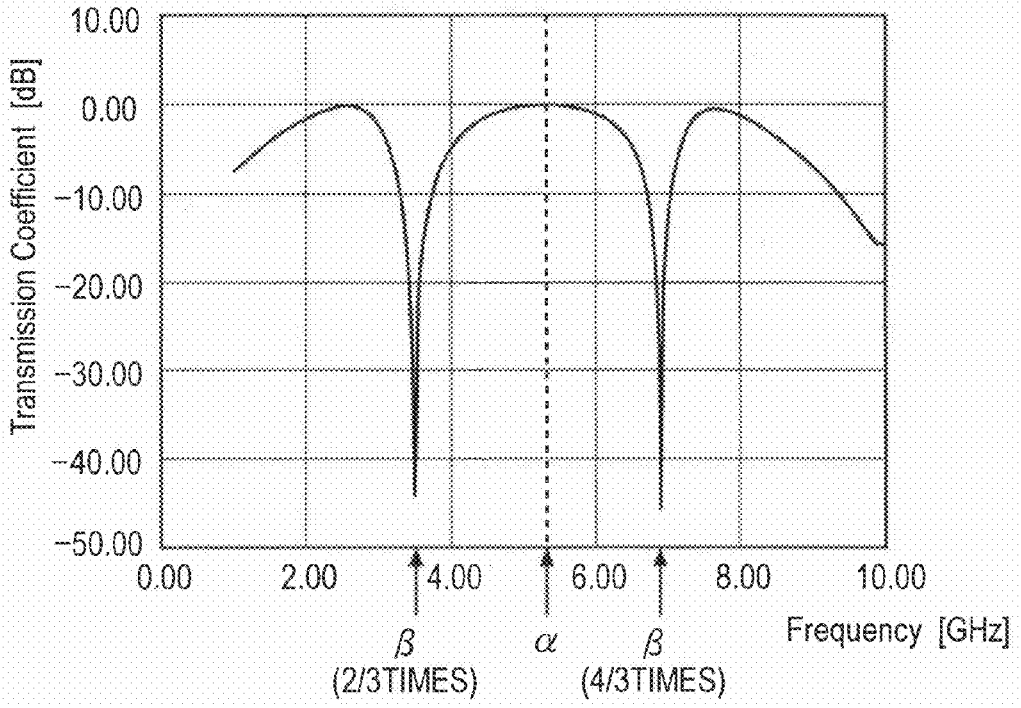
FIG. 3A is a graph showing the frequency characteristics of the circuit of FIG. 2A through electromagnetic field simulations.
Figure 3B:
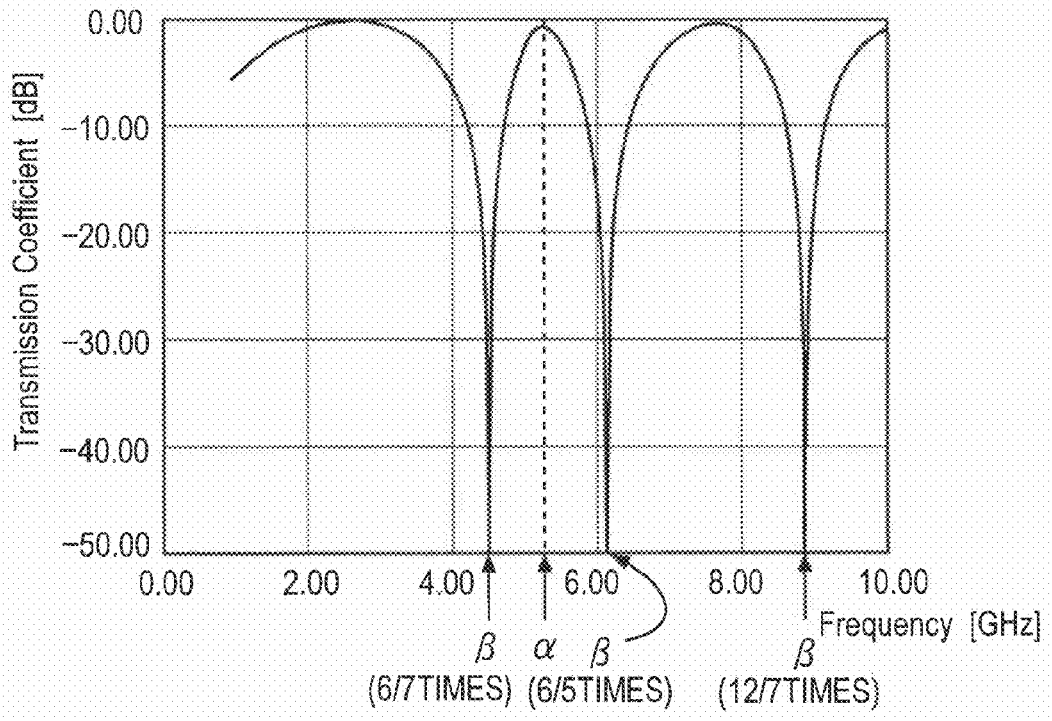
FIG. 3B is a graph showing the frequency characteristics of the circuit of FIG. 2B through electromagnetic field simulations.

FIGS. 3A and 3B show simulation results on the frequency characteristics of the transmission coefficient of the circuit 10.

FIG. 3A shows frequency characteristics when a position X is grounded through the via hole 6 having a diameter of 0.3 mm. The position X is one of the intersecting positions of the ring-shaped line 2 and a line passing through the center of the ring-shaped line 2 and intersecting a line L at π/2, that is, 90° as shown in FIG. 2A. The position X is set at ¾ of the length of the ring-shaped line 2 from a connecting portion C, which connects to the input/output line 7, in a counterclockwise direction (¼ in a clockwise direction) and the ring-shaped line 2 is grounded on the position X. In this case, "clockwise" and "counterclockwise" indicate circumferential directions in FIG. 2A (the same is true in the following description). A line connecting the input/output line 7 and the connecting portion C indicates that the input/output line 7 and the ring-shaped line 2 are electrically connected to each other in the circuit 10 to be simulated.

FIG. 3B shows frequency characteristics when the position of the via hole 6 is set at a position Y as shown in FIG. 2B. The position Y is set at 7/12 of the length of the ring-shaped line 2 from a connecting portion C, which connects to the input/output line 7, in a counterclockwise direction (5/12 in a clockwise direction) and the ring-shaped line 2 is grounded on the position Y.

As is evident from the frequency characteristics shown in FIGS. 3A and 3B, in the variable resonator 20, the position of the via hole 6 is changed, that is, the position of the switch 3 to be turned on (electrically connected) is changed, so that a frequency (a frequency having the minimum transmission coefficient) β for rejecting a signal can be largely changed without changing a frequency a allowing the passage of a signal. In other words, the bandwidth of a signal to be propagated can be largely changed according to the position of the switch 3 to be turned on. Generally, the minimum point appearing on the frequency characteristics of a transmission coefficient is called a transmission zero.

These operations will be described below in accordance with a lossless transmission line model.

Figure 4A:
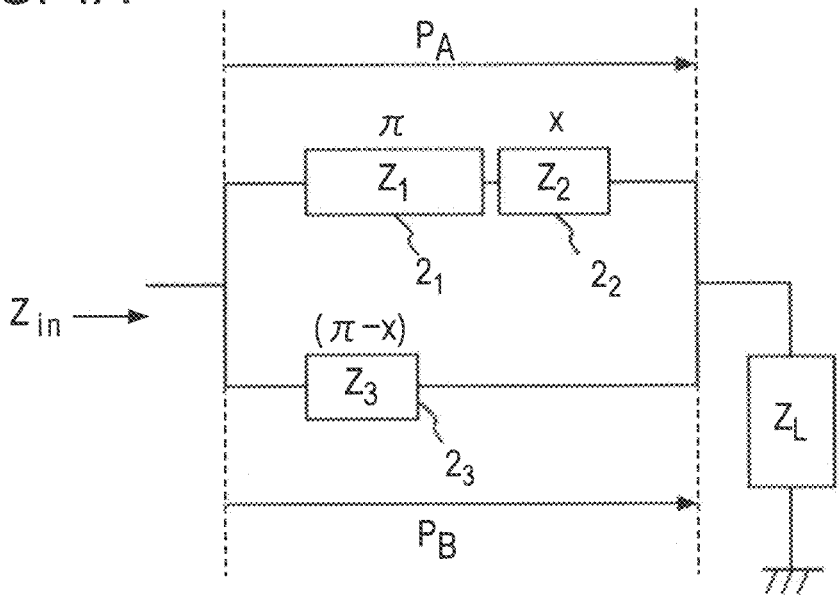
FIG. 4A shows a lossless transmission line model of the circuits shown in FIGS. 2A and 2B.

FIG. 4A shows a lossless transmission line model for the resonator part of the circuit 10 shown in FIGS. 2A and 2B. The operations of the circuit 10 will be described by determining an input impedance $Z_{in}$ of this model. In a resonance frequency $f_r=\alpha$ (FIGS. 3A and 3B), a transmission line $\mathbf{2}_1$ has an electric length of it and a characteristic impedance of $Z_1$, a transmission line $\mathbf{2}_2$ has an electric length of x (radian) and a characteristic impedance of $Z_2$, and a transmission line $\mathbf{2}_3$ has an electric length of (π-x) and a characteristic impedance of $Z_3$. As is evident from this model, the sum of the electric lengths of the transmission lines $\mathbf{2}_1$, $\mathbf{2}_2$ and $\mathbf{2}_3$ is 2π, that is, 360°.

A path $P_A$ made up of the transmission lines $\mathbf{2}_1$ and $\mathbf{2}_2$ is a counterclockwise path from the connecting portion C to the position of the via hole 6 in FIGS. 2A and 2B, that is, to the positions represented as X and Y in FIGS. 2A and 2B. A path $P_B$ including the transmission line $\mathbf{2}_3$ is a clockwise path from the connecting portion C to the position of the via hole 6 in FIGS. 2A and 2B, that is, to the positions represented as X and Y in FIGS. 2A and 2B. Reference character $Z_L$ denotes an impedance to the ground on the position of the via hole 6.

In this case, an input impedance $Z_{in}$ is expressed by formula (I) where j represents an imaginary unit.

$$Z_{in} = \frac{y_{22} + Y_L}{y_{11}(y_{22} + Y_L) - y_{12}y_{21}} \tag{1}$$

where $y_{11}=-jY_2 \cot x+jY_3 \cot X$ $y_{12}=-jY_2 \csc x+jY_3 \csc x$ $y_{21}=-jY_2 \csc x+jY_3 \csc x$ $y_{22}=-jY_2 \cot x+jY_3 \cot x$ $Y_2=1/Z_2$, $Y_3=1/Z_3$, $Y_L=1/Z_L$ In the case of $Y_2=Y_3$ and in all the cases other than $x=n\pi$ (n=0, 1, 2, 3, . . . ), $Z_{in}$ becomes infinite for whatever value of $Z_L$ and exerts the same characteristics as LC parallel resonance. Thus, in FIGS. 2A and 2B, a signal inputted from the input port is propagated to the output port. In the case of $Y_2=Y_3$ and x=nit, $Z_{in}=Z_L$ is obtained. Thus if $Z_L$ is 0, the connecting portion C between the variable resonator 20 and the input/output line 7 in FIGS. 2A and 2B is short-circuited at this frequency and the signal is not propagated.

Therefore, in the case where a variable resonator and a transmission line are connected in parallel in the configuration of a variable bandwidth filter (will be described later), when allowing the passage of a signal at a frequency whose wavelength is the conductor line length of the variable resonator, it is necessary to prevent the position of a switch to be turned on from being an integral multiple of π in terms of an electric length from the connecting portion of the transmission line and the variable resonator. Conversely, when preventing the passage of a signal at the frequency whose wavelength is the conductor line length of the variable resonator, it is sufficient to set the position of a switch to be turned on at an integral multiple of π in terms of an electric length from the connecting portion of the transmission line and the variable resonator.

In the above explanation, $Y_2=Y_3$ was set from an analytical point of view according to formula (1). However, the effect of the present invention is not strictly obtained only by $Y_2=Y_3$. For example, when $Y_2\neq Y_3$ but not so different from each other, that is, in the case of $Y_2\approx Y_3$, the resonance frequency of the variable resonator may be slightly deviated and may not be constant (in short, a desired resonance frequency cannot be kept), nevertheless, a wide bandwidth can be obtained depending on a position where the switch 3 is turned on. Thus, there would be no significant difference between a bandwidth with the desired resonance frequency and a bandwidth with a slightly deviated resonance frequency, resulting in no influence in practical use.

In other words, when a somewhat wide bandwidth is made variable, design conditions strictly requiring $Y_2=Y_3$ are not necessary from a practical point of view. Thus when a somewhat wide bandwidth is made variable, it is not always necessary to strictly set the circumferential length of the ring-shaped line 2 one wavelength or the integral multiple of the wavelength at the resonance frequency.

Therefore, the setting of the circumferential length of the ring-shaped line 2 at a wavelength or the integral multiple of the wavelength at the resonance frequency should be understood as a technical matter including the foregoing meaning.

Figure 4B:
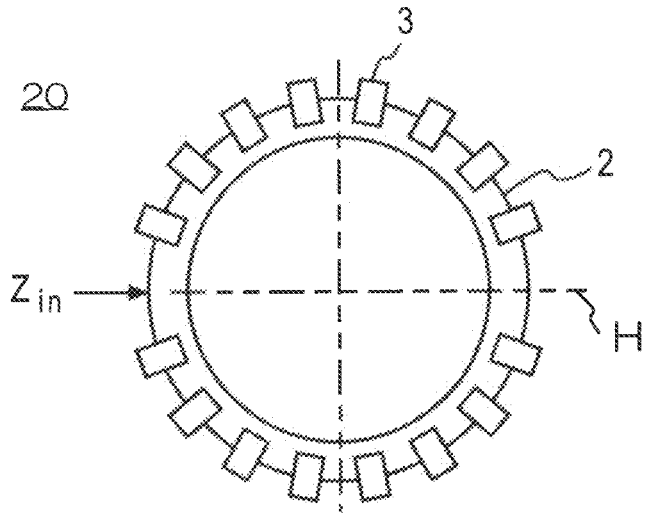
FIG. 4B is a plan view showing the variable resonator.

When the variable bandwidth filter is configured not to reject a signal but mainly to allow the passage of a signal having a desired frequency, it is not originally necessary to set the switches 3 on the positions of the integral multiples of π in terms of an electric length. Thus as shown in FIG. 4B, the switches 3 are disposed on positions other than the positions of the integral multiples of π t in terms of an electric length. To be more specific, in the variable resonator of FIG. 4B, no switches are disposed on a portion indicated by the input impedance $Z_{in}$ where connection is to be made to the transmission line, and a portion which is π away in terms of an electric length from the former portion.

Further, as is evident from the lossless transmission line model of FIG. 4A, the clockwise path and the counterclockwise path from the connecting point between the ring-shaped line 2 and the input/output line 7 to the position of the electric length π are symmetrical to each other (in the case of the ring-shaped line of FIGS. 2A and 2B, the paths are symmetrical to each other with respect to the line L), so that switch 3 may not be provided on one of the symmetric positions.

In the example of the variable resonator 20 shown in FIG. 4B, all of the switches 3 on either upper side or lower side of a line H (corresponding to the line L in FIGS. 2A and 2B) in FIG. 4B may not be provided.

The following will discuss characteristics at frequencies represented by β in FIGS. 3A and 3B. A signal does not propagate at these frequencies because the input impedance $Z_{in}$ is 0 on the connecting portion between the input/output line 7 and the variable resonator 20.

In FIG. 4A, when x is π/2, that is, 90° in terms of a resonance frequency $f_r$ of the variable resonator 20, the lossless transmission line model corresponds to the circuit of FIG. 2A and exerts characteristics shown in FIG. 3A. The electric length of the path $P_A$ is 3π/2, that is, 270° in terms of the resonance frequency $f_r$. This electric length is equivalent to π, that is, 180° at a frequency 2/3 times as high as the resonance frequency $f_r$ and the path can be regarded as a half-wavelength stub with a short-circuited end. Thus, the input impedance $Z_{in}$ on a contact between the input/output line 7 and the variable resonator 20 is 0. Further, at a frequency 4/3 times as high as (that is, twice as high as 2/3 times) the resonance frequency $f_r$, the path $P_A$ can be regarded as a one-wavelength stub with a short-circuited end and thus exerts the same characteristics. Since the other path $P_B$ has an electric length of π/2, that is, 90° at the resonance frequency $f_r$, the path can be regarded as a half-wavelength stub with a short-circuited end at a frequency twice as high as the resonance frequency $f_r$. Thus, the input impedance $Z_{in}$ on the contact between the input/output line 7 and the variable resonator 20 is 0. However, in this case, the frequency is out of the range of the frequency axis (horizontal axis) shown in FIG. 3A and thus is not shown in FIG. 3A.

In FIG. 4A, when x is π/6, that is, 30° at the resonance frequency $f_r$ of the variable resonator 20, the lossless transmission line model corresponds to the circuit of FIG. 2B and exerts characteristics shown in FIG. 3B. The electric length of the path $P_A$ is 7π/6, that is, 210° at the resonance frequency $f_r$. The electric length is π, that is, 180° at a frequency 6/7 times as high as the resonance frequency $f_r$ and the path can be regarded as a half-wavelength stub with a short-circuited end. Thus the input impedance $Z_{in}$ on the contact between the input/output line 7 and the variable resonator 20 is 0. Further, regarding a frequency 12/7 times as high as (that is, twice as high as 6/7 times) the resonance frequency $f_r$, the path $P_A$ can be regarded as a one-wavelength stub with a short-circuited end and thus exerts the same characteristics. Since the other path $P_B$ has an electric length of 5π/6, that is, 150° at the resonance frequency $f_r$, the path can be regarded as a half-wavelength stub with a short-circuited end at a frequency 6/5 times as high as the resonance frequency $f_r$. Thus the input impedance $Z_{in}$ on the contact between the input/output line 7 and the variable resonator 20 is 0.

As described above, a signal does not propagate at frequencies represented by β in FIGS. 3A and 3B.

Figure 5A:
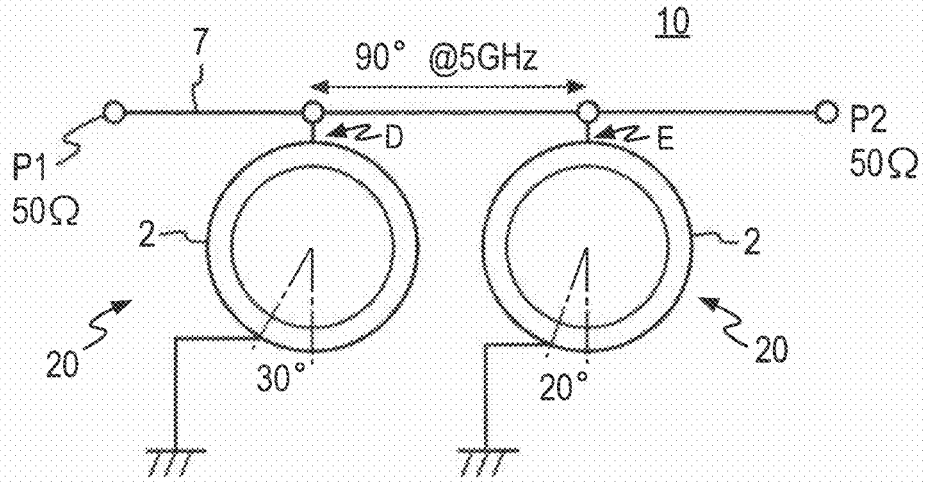
FIG. 5A shows an embodiment of a variable bandwidth filter using two variable resonators.
Figure 5B:
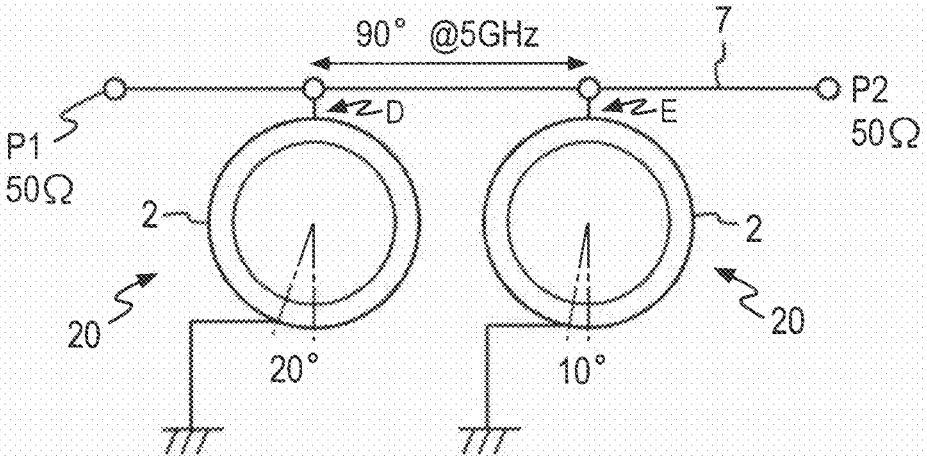
FIG. 5B shows another embodiment of the variable bandwidth filter using the two variable resonators.
Figure 6A:
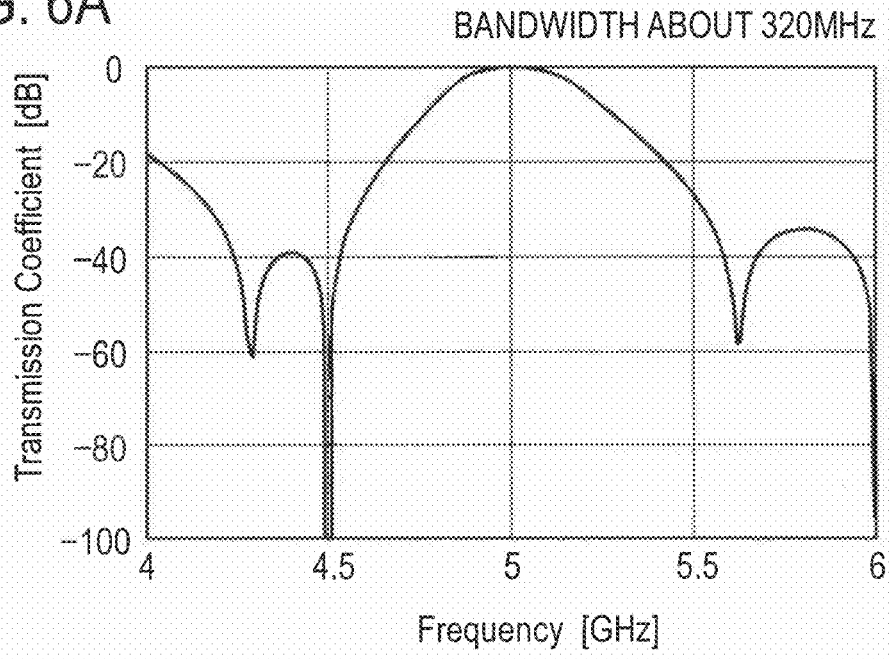
FIG. 6A is a graph showing the frequency characteristics of the variable bandwidth filter shown in FIG. 5A.
Figure 6B:
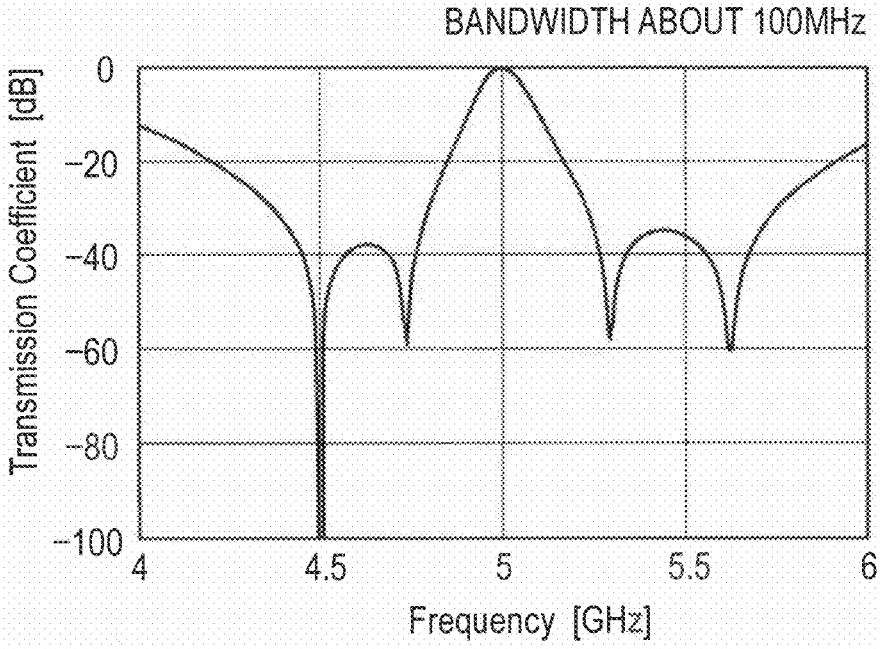
FIG. 6B is a graph showing the frequency characteristics of the variable bandwidth filter shown in FIG. 5B.

FIGS. 5A and 5B show a variable bandwidth filter 10 configured using the two variable resonators 20 according to the present invention. The variable bandwidth filter 10 has the two variable resonators 20 electrically connected in parallel with respect to the input/output line 7. FIGS. 6A and 6B show linear circuit simulation results on the frequency characteristics of the variable bandwidth filter 10. The illustration of the switches 3 is omitted for the sake of simplicity and the position of the via hole 6 is changed for the simulations. Further, the resonance frequency of the variable resonator 20 is set at 5 GHz in the linear circuit simulations.

Moreover, in the linear circuit simulations, the variable bandwidth filters 10 shown in FIGS. 5A and 5B each have the two variable resonators 20 connected to each other via a line having a quarter wavelength (corresponding to a phase change of 90°) at 5 GHz which is the resonance frequency of the variable resonator.

In the linear circuit simulations, the variable bandwidth filters 10 were simulated as to the positioning of the via holes of the two cases shown in FIGS. 5A and 5B.

In the variable bandwidth filter 10 of FIG. 5A, the positions of the via holes 6 of the two variable resonators 20 are different from each other. To be specific, the via hole 6 of the variable resonator 20 on the left of FIG. 5A is placed at 5/12 of the length of the ring-shaped line 2 from a connecting portion D in a counterclockwise direction, and the via hole 6 of the variable resonator 20 on the right of FIG. 5A is placed at 4/9 of the length of the ring-shaped line 2 from a connecting portion E in a counterclockwise direction.

In the variable bandwidth filter 10 of FIG. 5B, the positions of the via holes 6 of the two variable resonators 20 are different from those of FIG. 5A. To be specific, the via hole 6 of the variable resonator 20 on the left of FIG. 5B is placed at 4/9 of the length of the ring-shaped line 2 from a connecting portion D in a counterclockwise direction, and the via hole 6 of the variable resonator 20 on the right of FIG. 5B is placed at 17/36 of the length of the ring-shaped line 2 from a connecting portion E in a counterclockwise direction.

As shown in FIGS. 6A and 6B, the bandwidth (in this case, a bandwidth of −3 dB around 5 GHz) of the variable bandwidth filter 10 shown in FIG. 5A is about 320 MHz and the bandwidth of the variable bandwidth filter 10 shown in FIG. 5B is about 100 MHz.

As is evident from the above description, the variable bandwidth filter 10 of the present invention makes it possible to greatly change the bandwidth while keeping the center frequency (in this case, 5 GHz) constant, by changing the position of the via hole 6, that is, the position of the switch 3.

Although the two variable resonators 20 are used in the variable bandwidth filters 10 of FIGS. 5A and 5B, the number of the variable resonators 20 is not particularly limited to two. The variable bandwidth filter 10 can be configured using at least one variable resonator 20. The variable bandwidth filter 10 using one variable resonator 20 is configured as shown in FIG. 2.

Although it is desirable to connect the variable resonators 20 by the line having a quarter wavelength at the resonance frequency of the variable resonator 20, the configuration is not particularly limited.

The variable bandwidth filter 10 of the present invention is also characterized by a small insertion loss in a passband having the center at the resonance frequency of the variable resonator 20. The influence of the switches which increase an insertion loss and are used in the variable resonator is examined in the following description.

Figure 7A:
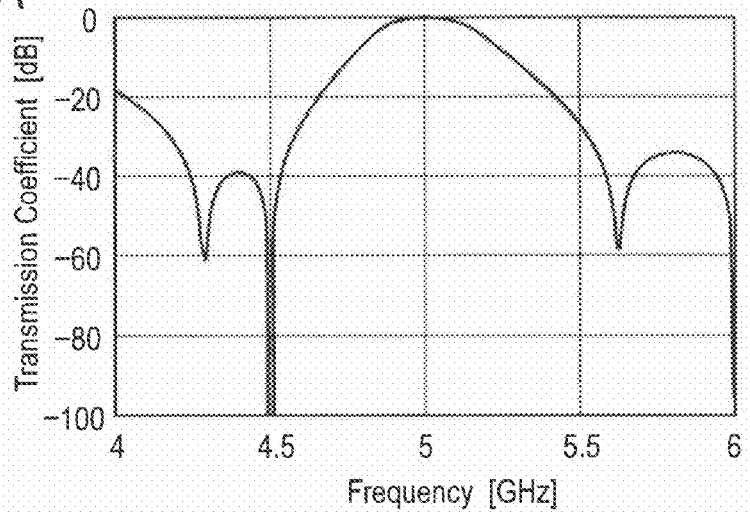
FIG. 7A is a graph showing the frequency characteristics of the variable bandwidth filter shown in FIG. 5A.
Figure 7B:
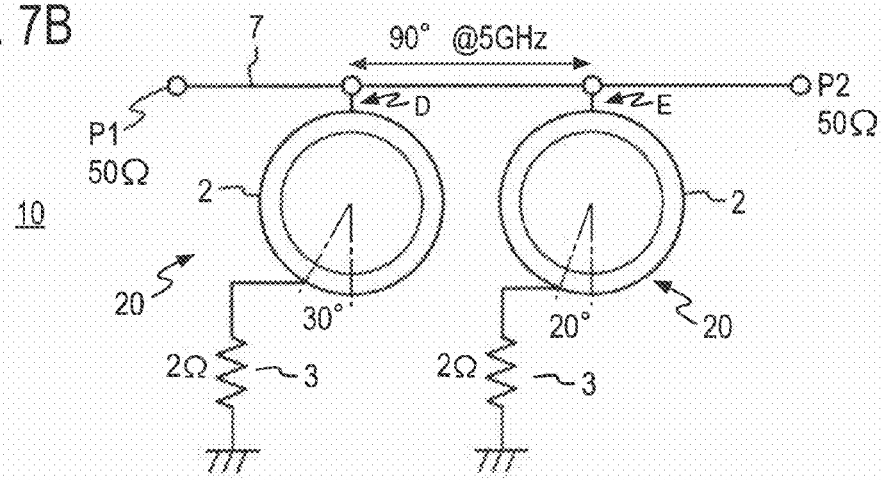
FIG. 7B shows a variable bandwidth filter in which resistors are disposed between switches and a ground conductor.
Figure 7C:
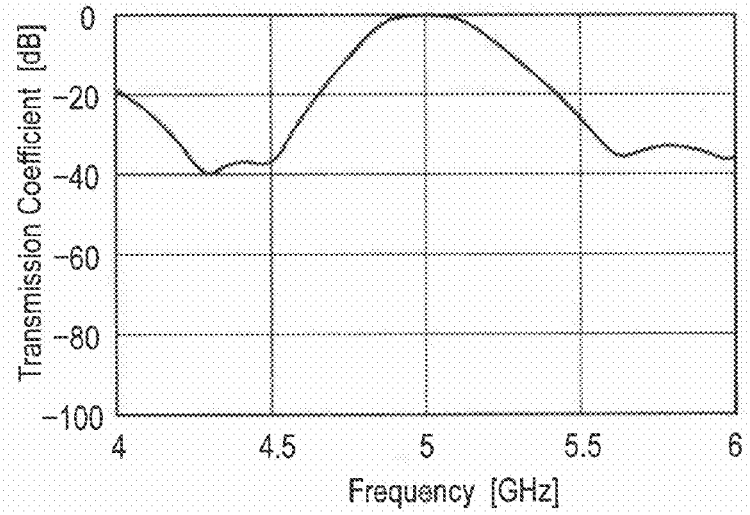
FIG. 7C is a graph showing the frequency characteristics of the variable bandwidth filter shown in FIG. 7B.

The frequency characteristics of the variable bandwidth filter 10 were simulated in the cases where the switch 3 of the variable bandwidth filter 10 in FIG. 5A has a resistance of 0Ω and a resistance of 2Ω. FIGS. 7A and 7C show the simulation results. FIG. 7A shows the case where the switch 3 has a resistance of 0Ω as shown in FIG. 5A. FIG. 7C shows the case where the switch 3 has a resistance of 2Ω as shown in FIG. 7B. As is evident from comparisons between FIGS. 7A and 7C, even when the resistance of the switch 3 is increased, the insertion loss in a passband around the center frequency (in this case, 5 GHz) hardly changes. This finding is based on the fact that the operation of the variable resonator 20 described with FIG. 4A makes the input impedance $Z_{in}$ infinite at the resonance frequency $f_r$ regardless of the impedance $Z_L$. Thus, it is understood that in the variable bandwidth filter 10 of the present invention, characteristics with a low insertion loss can be obtained even using a switch having a somewhat high resistance.

Figure 7D:
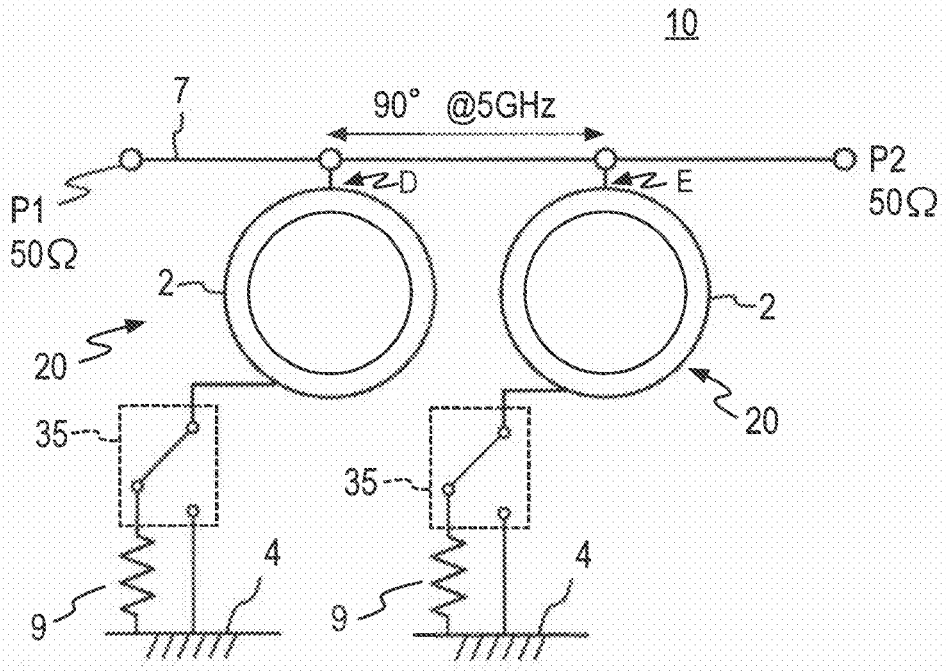
FIG. 7D shows a variable bandwidth filter using switches for switching over connection to a ground conductor via a resistor and direct connection to a ground conductor.

Conversely, the configuration taking the advantage of a resistance can also be used. For example, as shown in FIG. 7D, it is possible to actively use a resistance by switching the case where the ring-shaped line 2 is directly connected to the ground conductor 4 by using a switch 35 acting as a low-resistance switch and the case where the ring-shaped line 2 is connected to the ground conductor 4 via a resistor 9 having a resistance of several ohms to several tens ohms which is higher than the resistance of the switch 35. In this case, it is possible to select the case where the propagation of a signal is suppressed in a band affected by the resistor 9 having a resistance of several ohms to several tens ohms and the case where even a signal around the band which would be affected by the resistance can also be propagated by minimizing the resistance.

Although the foregoing examples show the use of a resistor, the use of an element is not limited to a resistor. It is possible to use such a passive element as variable resistor, inductor, variable inductor, capacitor, variable capacitor, or piezoelectric element. Of course, in FIGS. 1A and 1B and other embodiments, too, the switches 3 of the ring-shaped line 2 may be grounded through such a passive element, or may be made selectable by a switch 35 to ground either via such passive element or directly.

Figure 8:
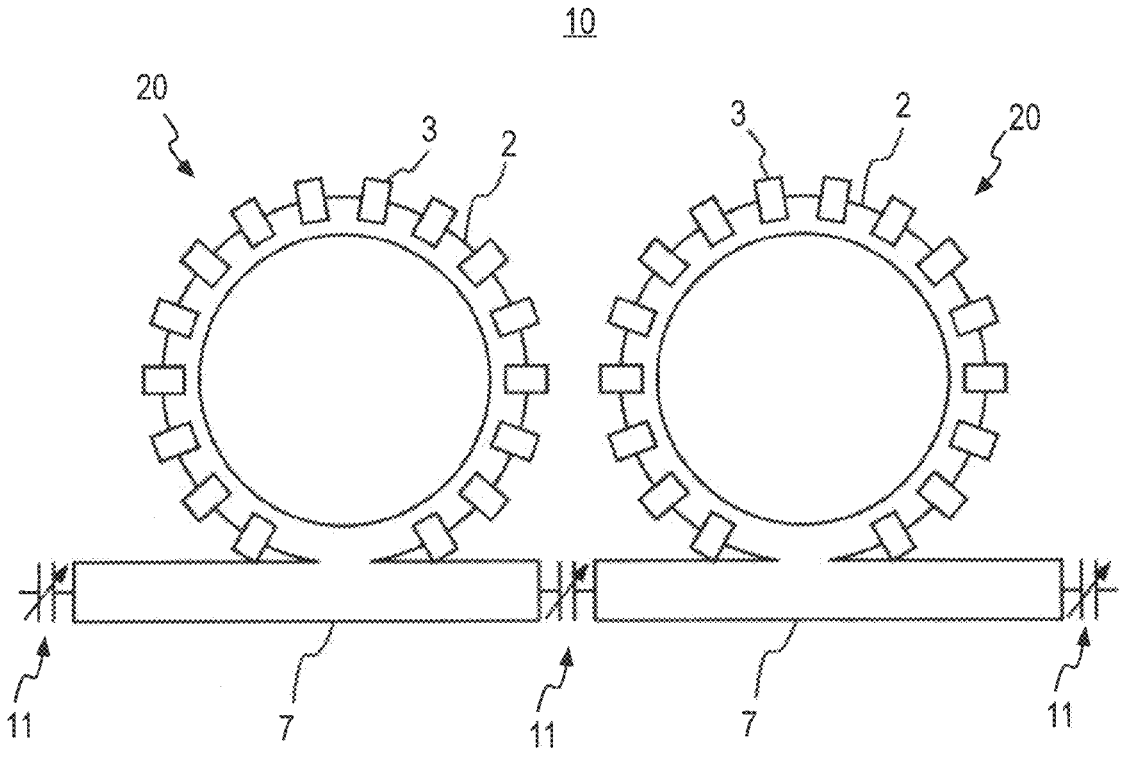
FIG. 8 shows an embodiment of a variable bandwidth filter configured by connecting two variable resonators in parallel.

In addition to the variable bandwidth filter 10 configured by connecting the variable resonators 20 to the transmission line as shown in FIGS. 5A and 5B, the variable bandwidth filter 10 may be configured by connecting the input/output lines 7, which are electrically connected to the variable resonators 20, with each other via a variable capacitor 11 as shown in FIG. 8. A circuit element is not limited to a variable capacitor. For example, a circuit element such as a capacitor, an inductor, a variable inductor, and a transistor may be used.

Figure 9:
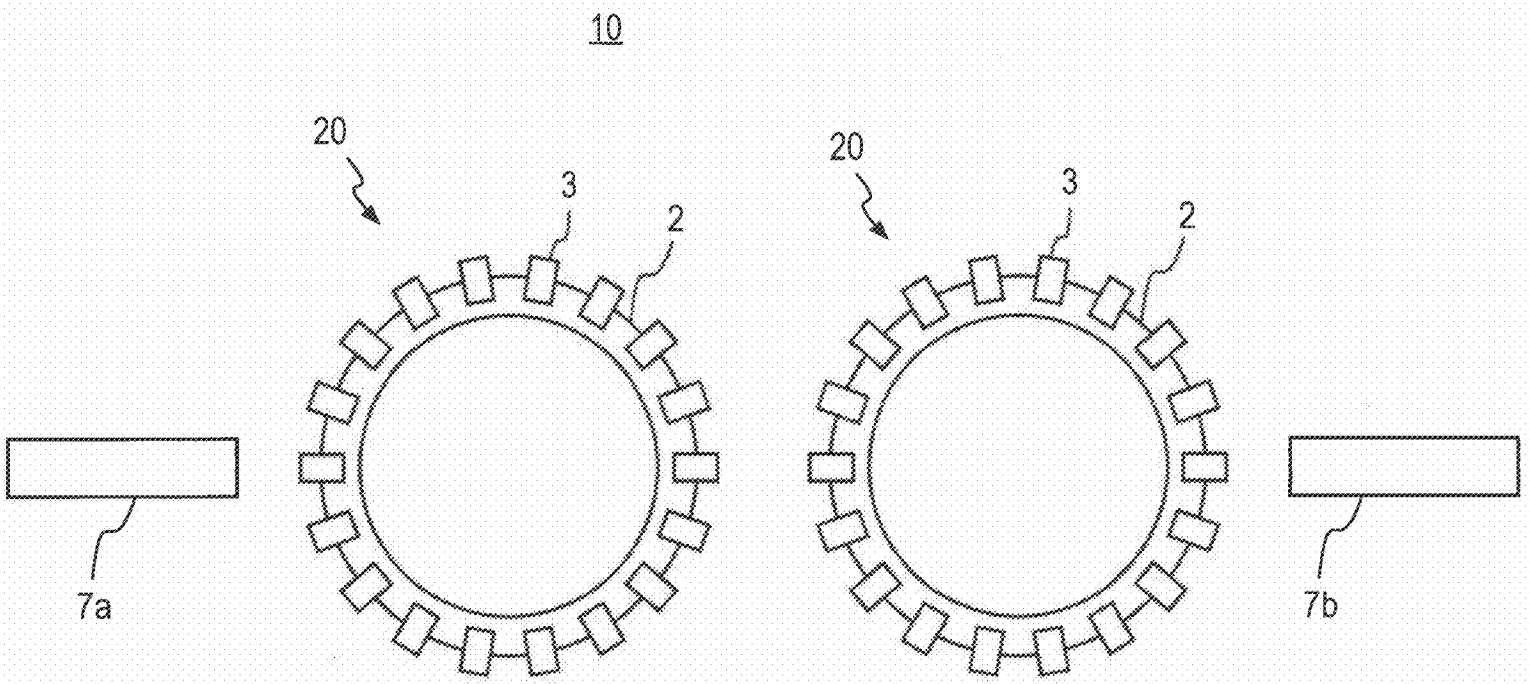
FIG. 9 shows an embodiment of a variable bandwidth filter in electric field coupling.
Figure 10:
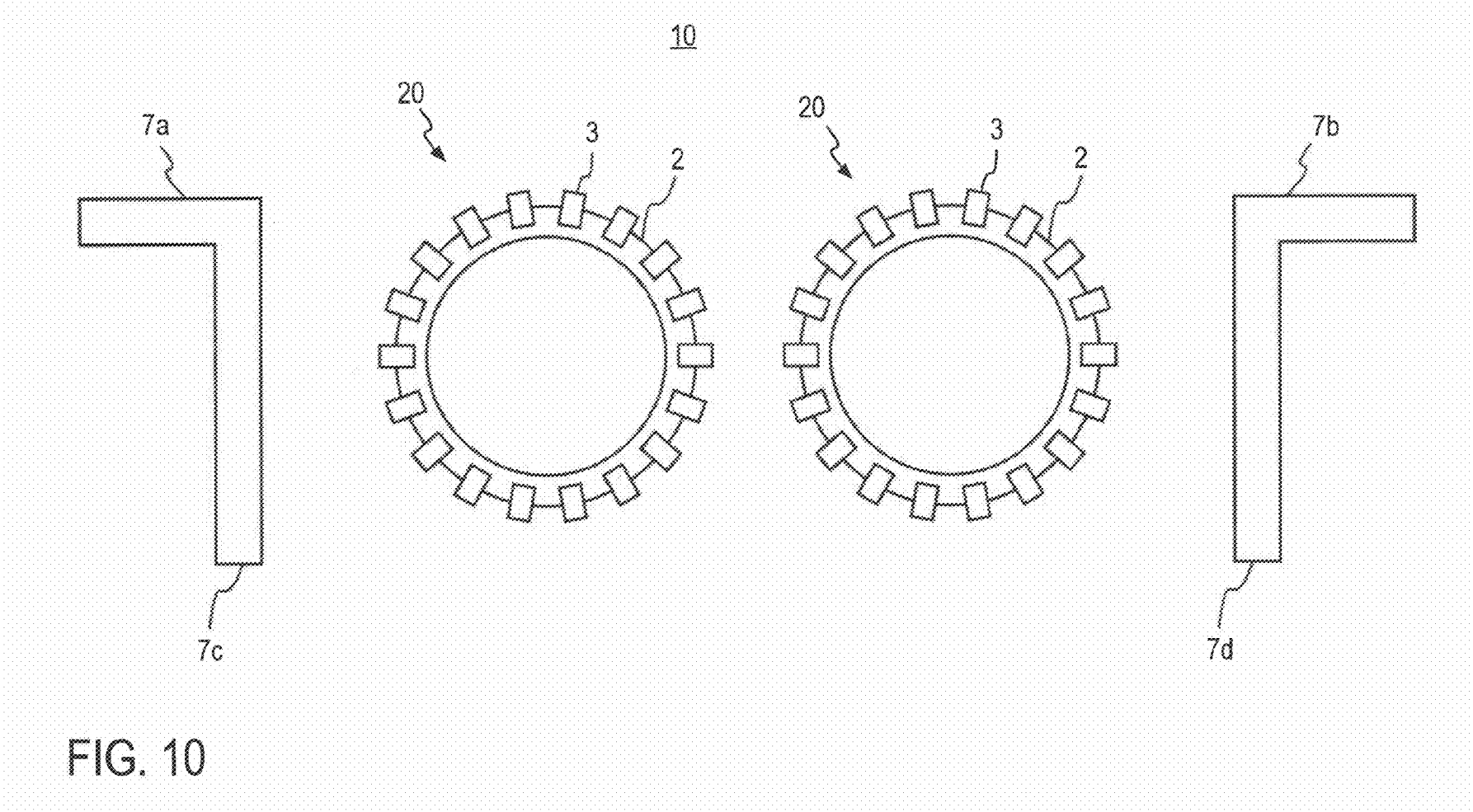
FIG. 10 shows an embodiment of a variable bandwidth filter in magnetic field coupling.

Further, the variable bandwidth filter can be configured by connecting the input/output lines 7 with each other through electric field coupling or magnetic field coupling. FIG. 9 shows the variable bandwidth filter 10 configured by electric field coupling and FIG. 10 shows the variable bandwidth filter 10 configured by magnetic field coupling. In the electric field coupling of FIG. 9, two variable resonators 20 are spaced between two input/output lines 7*a* and 7*b* extended on the same straight line. In the magnetic field coupling of FIG. 10, lines 7*c* and 7*d* extended at right angles on the same side from the opposed ends of the input/output lines 7*a* and 7*b* on the same straight line of FIG. 9 are formed in parallel with each other, and the two variable resonators 20 are spaced between the parallel lines 7*a* and 7*b*.

Figure 11A:
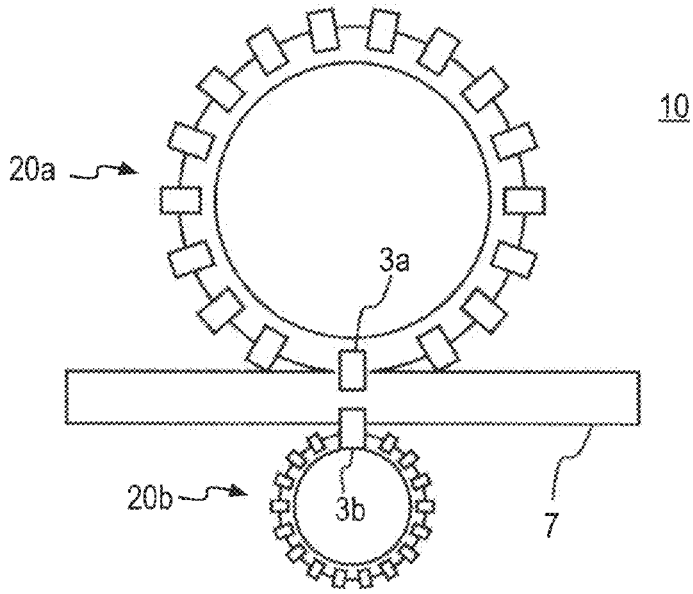
FIG. 11A shows an embodiment of a variable bandwidth filter using variable resonators having different characteristic impedances at different resonance frequencies.
Figure 11B:
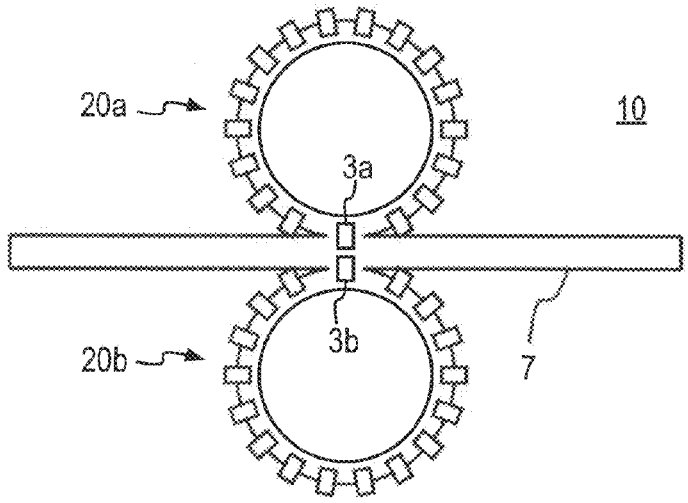
FIG. 11B shows another embodiment of a variable bandwidth filter using variable resonators having the same characteristic impedance at the same resonance frequency.
Figure 11C:
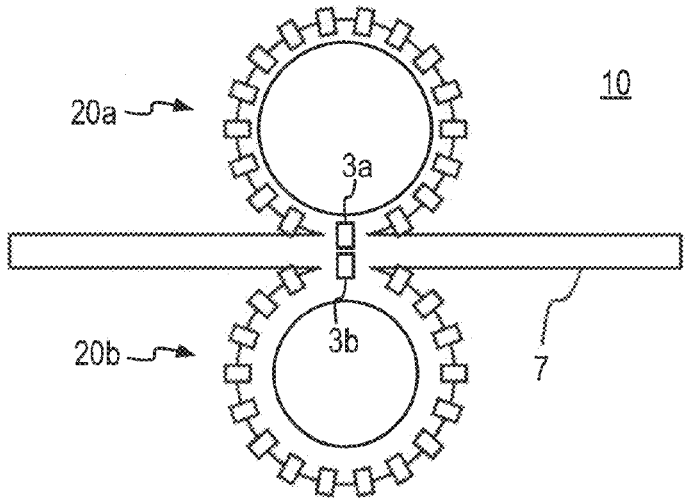
FIG. 11C shows still another embodiment of a variable bandwidth filter using variable resonators having different characteristic impedance at the same resonance frequency.

FIGS. 11A, 11B and 11C show embodiments of the variable bandwidth filter according to the present invention. The variable bandwidth filter 10 of FIG. 11A is made up of two variable resonators 20*a* and 20*b* having different sizes and switches 3*a* and 3*b* serving as circuit switches provided between the variable resonators and an input/output line 7 acting as a transmission line. The center frequency of the variable bandwidth filter 10 can also be made variable using the two variable resonators 20*a* and 20*b* having resonance frequencies varied with different circumferential lengths of the ring-shaped lines.

As to the resonance frequencies of the variable resonators 20*a* and 20*b*, the connecting portions between the variable resonators 20*a* and 20*b* and the switches 3*a* and 3*b* have high impedances. Thus the resistances of the switches 3*a* and 3*b* between the variable resonators 20*a* and 20*b* and the input/output line 7 hardly affect the insertion loss of a passband. Thus in addition to the characteristic of the variable resonator of the present invention in which the switches between the variable resonators and the ground conductor hardly affect an insertion loss at the resonance frequency, the variable bandwidth filter of FIG. 11A is characterized in that the center frequency and the bandwidth can be changed and a passband characteristic can be obtained with a low loss regardless of the resistances of the used switches 3*a* and 3*b*.

The variable bandwidth filter 10 of FIG. 11B is made up of two variable resonators 20*a* and 20*b* having the same resonance frequency and switches 3*a* and 3*b* which are circuit switches provided between the variable resonators and an input/output line 7 acting as a transmission line. The variable bandwidth filter 10 of FIG. 11C has a configuration similar to that of the variable bandwidth filter 10 of FIG. 11B. However, the variable bandwidth filter 10 of FIG. 11C is different from that of FIG. 11B in that the variable bandwidth filter 10 of FIG. 11B uses the two variable resonators 20*a* and 20*b* having the same characteristic impedance and the variable bandwidth filter 10 of FIG. 11C uses the two variable resonators 20*a* and 20*b* having different characteristic impedances.

In the case of the variable bandwidth filter 10 of FIG. 11B, two states are selectable, that is, a state where only one of the variable resonators is connected via the switches 3*a* and 3*b* and a state where the variable resonators 20*a* and 20*b* are both connected via the switches 3*a* and 3*b*. In these states, the resonance frequency is the same but the frequency characteristics are different. When both of the variable resonators are connected, the attenuation of a signal becomes large at a frequency away from the resonance frequency as compared with the case where only one of the variable resonators is connected. This is because the two parallel-connected variable resonators equivalently have a half characteristic impedance of a single variable resonator.

Figure 12A:
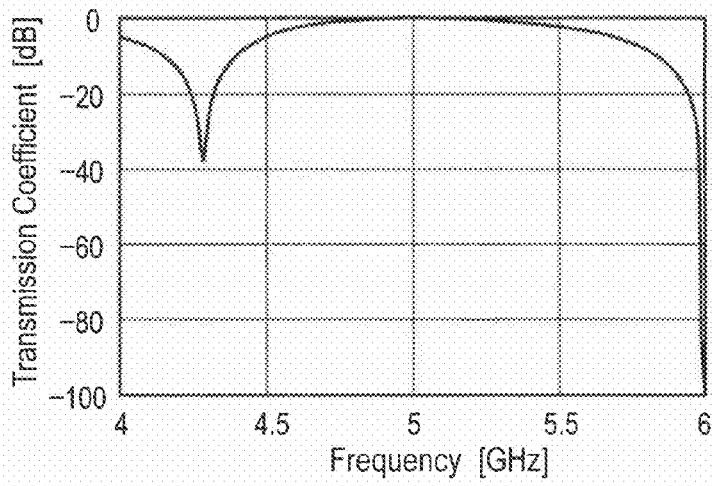
Figure 12B:
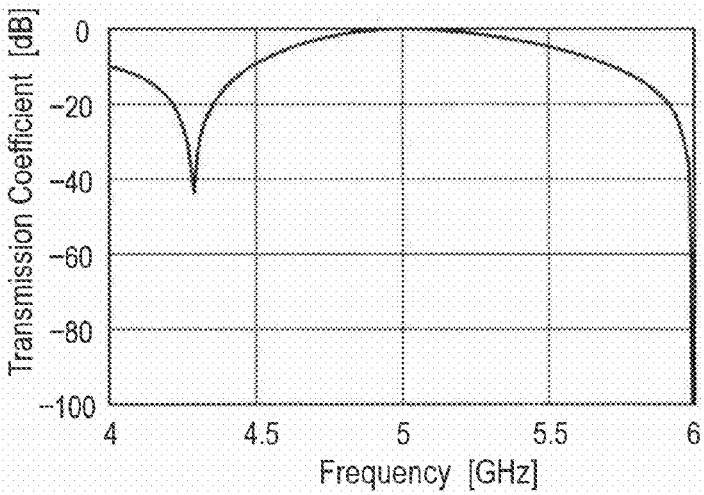
Figure 12C:
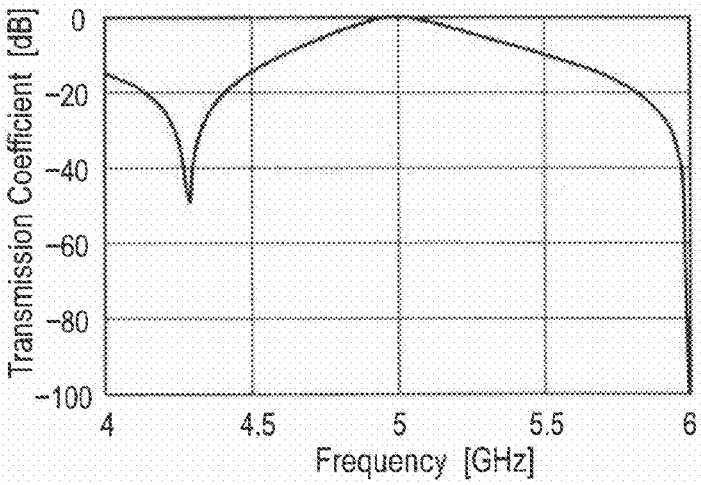

FIGS. 12A, 12B and 12C show the frequency characteristics of the variable bandwidth filter for each relationship between the characteristic impedances of the variable resonator and the input/output line 7. FIG. 12A shows the frequency characteristics of the variable bandwidth filter when the characteristic impedance of the variable resonator is twice that of the input/output line 7. FIG. 12B shows the frequency characteristics of the variable bandwidth filter when the characteristic impedance of the variable resonator is the same as that of the input/output line 7. FIG. 12C shows the frequency characteristics of the variable bandwidth filter when the characteristic impedance of the variable resonator is half that of the input/output line 7.

As is evident from the frequency characteristics of FIGS. 12A to 12C, when the variable resonator is lower in characteristic impedance than the input/output line 7, the amount of attenuation of a signal increases as the frequency moves away from the resonance frequency, that is, the bandwidth decreases.

This finding will be described below with reference to the variable bandwidth filter 10 of FIG. 11B. For example, when the characteristic impedances of the variable resonators 20*a* and 20*b* are set twice as high as that of the input/output line 7, the frequency characteristics of FIG. 12A correspond to the frequency characteristics of the variable bandwidth filter 10 when one of the switches 3*a* and 3*b* of FIG. 11B is turned on, and the frequency characteristics of FIG. 12B correspond to the frequency characteristics of a variable bandwidth filter (55) when both of the switches 3*a* and 3*b* are turned on.

Further, this finding will be described below with reference to the variable bandwidth filter 10 of FIG. 11C. For example, when the characteristic impedance of the variable resonator 20*a* is set twice as high as that of the input/output line 7 and the characteristic impedance of the variable resonator 20*b* is set at half that of the input/output line 7, the frequency characteristics of FIG. 12A correspond to the frequency characteristics of the variable bandwidth filter 10 in which the switch 3*a* is turned on and the switch 3*b* is turned off. The frequency characteristics of FIG. 12C correspond to the frequency characteristics of the variable bandwidth filter 10 in which the switch 3*a* is turned off and the switch 3*b* is turned on.

Thus in the variable bandwidth filter 10 of FIG. 11B, the characteristic impedances of the variable resonators can be switched relative to the input/output line 7 by changing the on/off states of the switches 3*a* and 3*b*, and the frequency characteristics of the variable bandwidth filter 10 can be changed in response to the two states.

In the variable bandwidth filter 10 of FIG. 11C, three states are selectable, that is, a state where either one of the variable resonators is connected via the switches 3*a* and 3*b* and a state where the variable resonators are both connected via the switches 3*a* and 3*b*. In these states, the resonance frequency is the same but the frequency characteristics are different.

As in the variable bandwidth filter 10 of FIG. 11B, in the variable bandwidth filter 10 of FIG. 11C, the characteristic impedances of the variable resonators are switched by changing the on/off states of the switches 3*a* and 3*b*, and the frequency characteristics of the variable bandwidth filter 10 can be changed in response to the three states.

Figure 13:
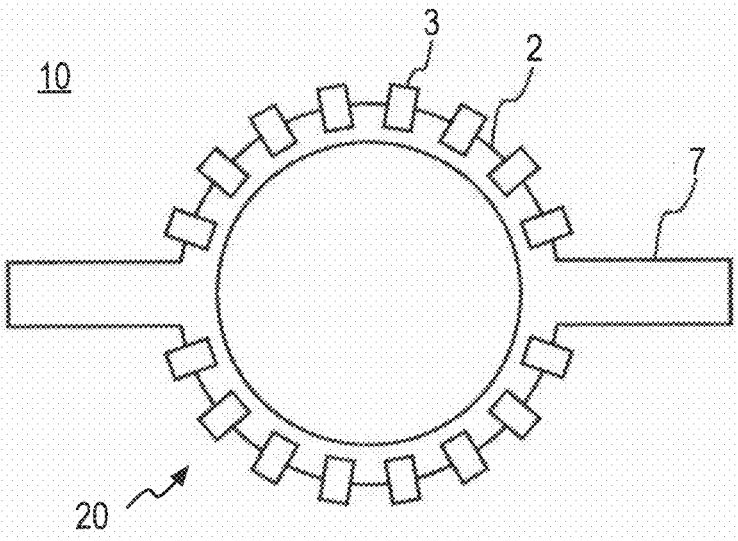
FIG. 13 shows an embodiment of a variable bandwidth filter configured by inserting a variable resonator in series with an input/output line.

FIG. 13 shows another embodiment of the variable bandwidth filter according to the present invention.

Unlike the variable bandwidth filters 10 of FIGS. 5A and 5B, a variable resonator 20 is electrically connected in series to an input/output line 7. The input/output line 7 is connected to the variable resonator 20 on two portions separated from each other by a half wavelength at the resonance frequency of the variable resonator 20, that is, on portions separated by it in terms of an electric length on the variable resonator 20.

The operation of the variable resonator 20 of the present invention was explained in accordance with FIG. 4A. In the explanation, x=0 is set and the part having the impedance $Z_L$ is regarded as the input/output line 7. This case corresponds to the variable bandwidth filter 10 of FIG. 13. In this explanation, when x=0 is set in FIG. 4A, the impedance $Z_L$ is equal to the input impedance $Z_{in}$ at the resonance frequency of the variable resonator 20, which means that if the impedance $Z_L$ is not a short circuit but the input/output line 7, a signal propagates at the resonance frequency. Thus this configuration operates as a variable bandwidth filter.

Figure 14:
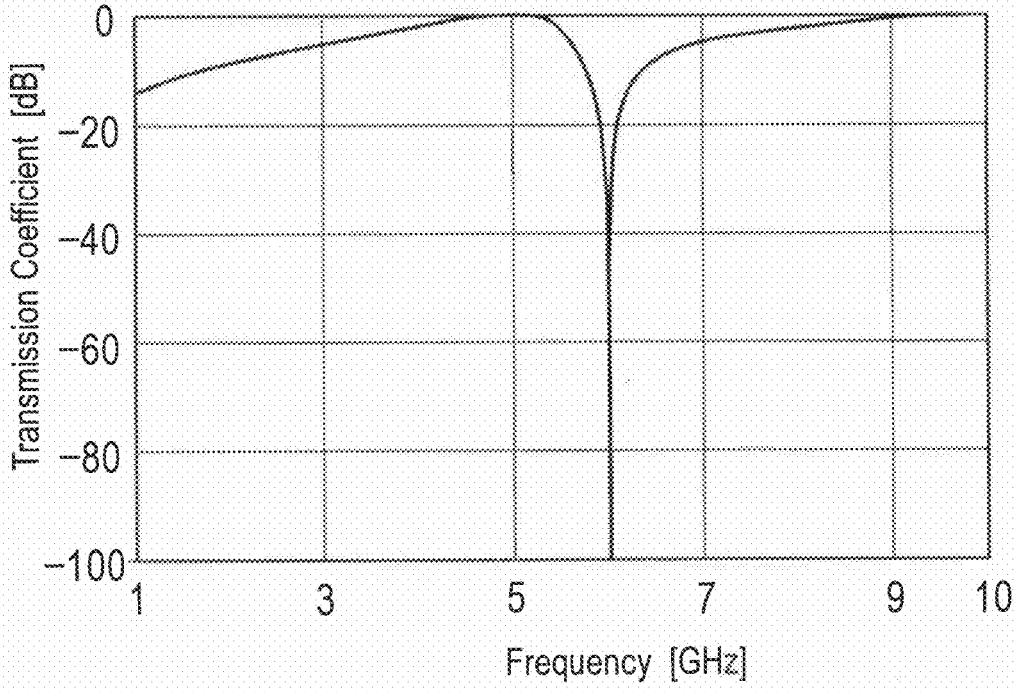
FIG. 14 is a graph showing the frequency characteristics of the variable bandwidth filter shown in FIG. 13.
Figure 15:
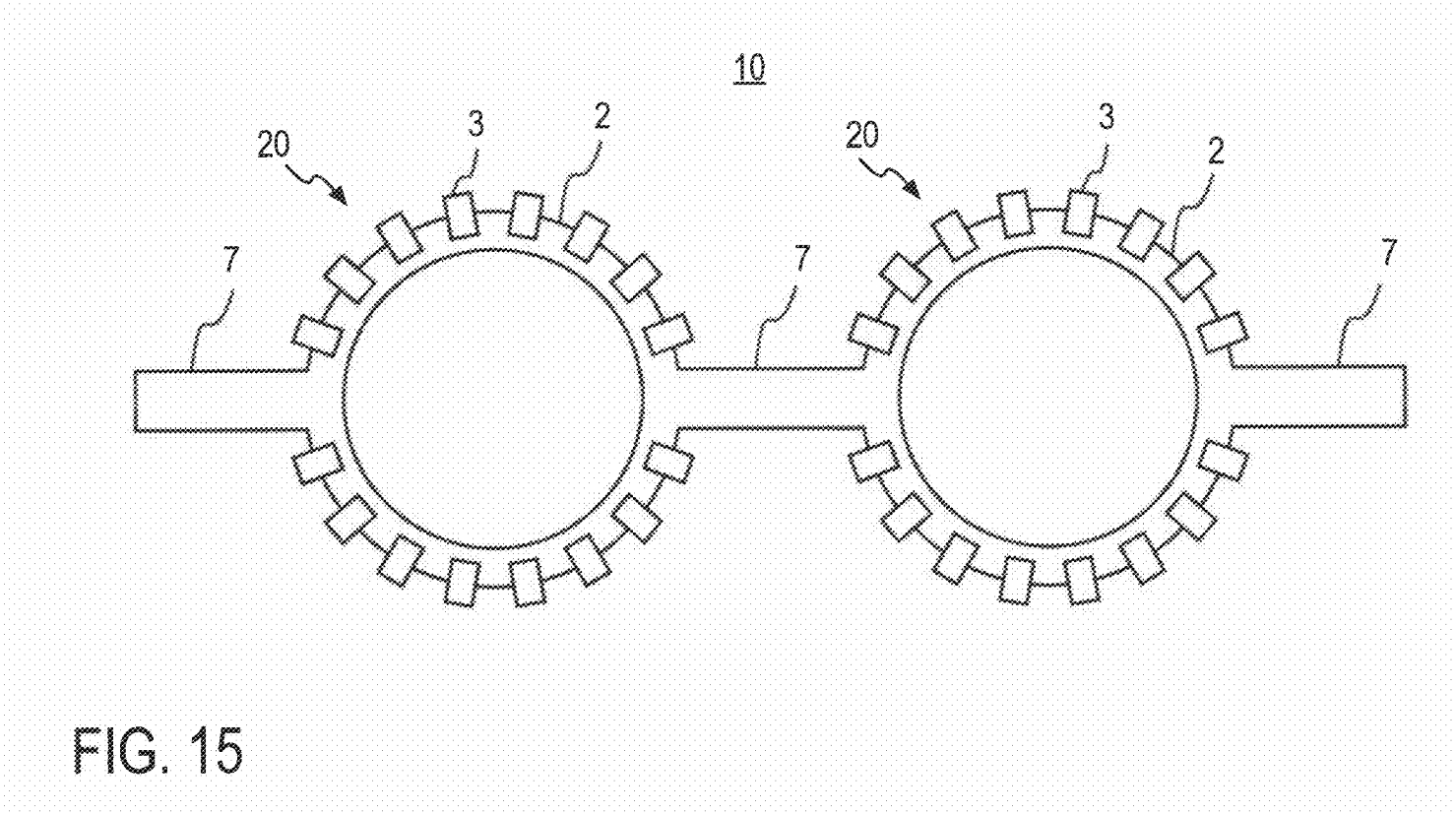
FIG. 15 shows an embodiment of a variable bandwidth filter configured by inserting two variable resonators in series with an input/output line.
Figure 16:
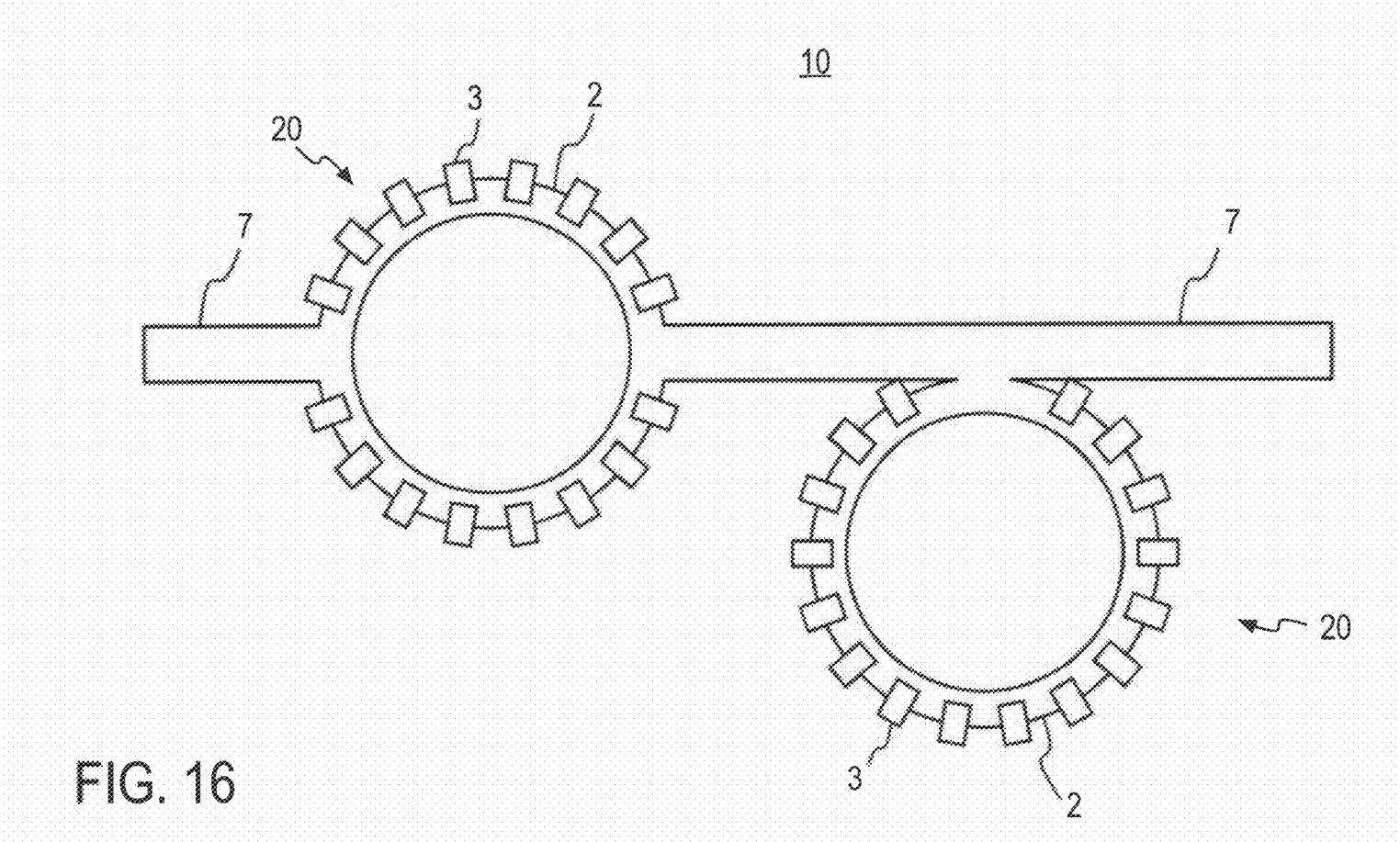
FIG. 16 shows an embodiment of a variable bandwidth filter configured by inserting one variable resonator in series with an input/output line and another variable resonator in parallel with the input/output line.

FIG. 14 shows the frequency characteristics of a variable bandwidth filter 10 of FIG. 13 as circuit simulation results. In this example, a switch 3 of θ=30° is turned on. As compared with the variable bandwidth filters 10 of FIGS. 5A and 5B having the variable resonators connected in parallel, a signal extremely attenuates at only one frequency and the number of such transmission zeros is half or less. This is because in the configuration of the variable bandwidth filter 10 of FIG. 13, a signal extremely attenuates only at a frequency set by the path $P_B$ of the lossless transmission line model of FIG. 4A. Although the single variable resonator is used in the variable bandwidth filter 10 of FIG. 13, a plurality of variable resonators 20 may be connected in series as shown in FIG. 15 or as shown in FIG. 16, some of the variable resonators 20 may be connected in parallel to the input/output line 7 while the other variable resonators are connected in series to the input/output line 7. In FIGS. 15 and 16, the two variable resonators are illustrated.

Figure 17:
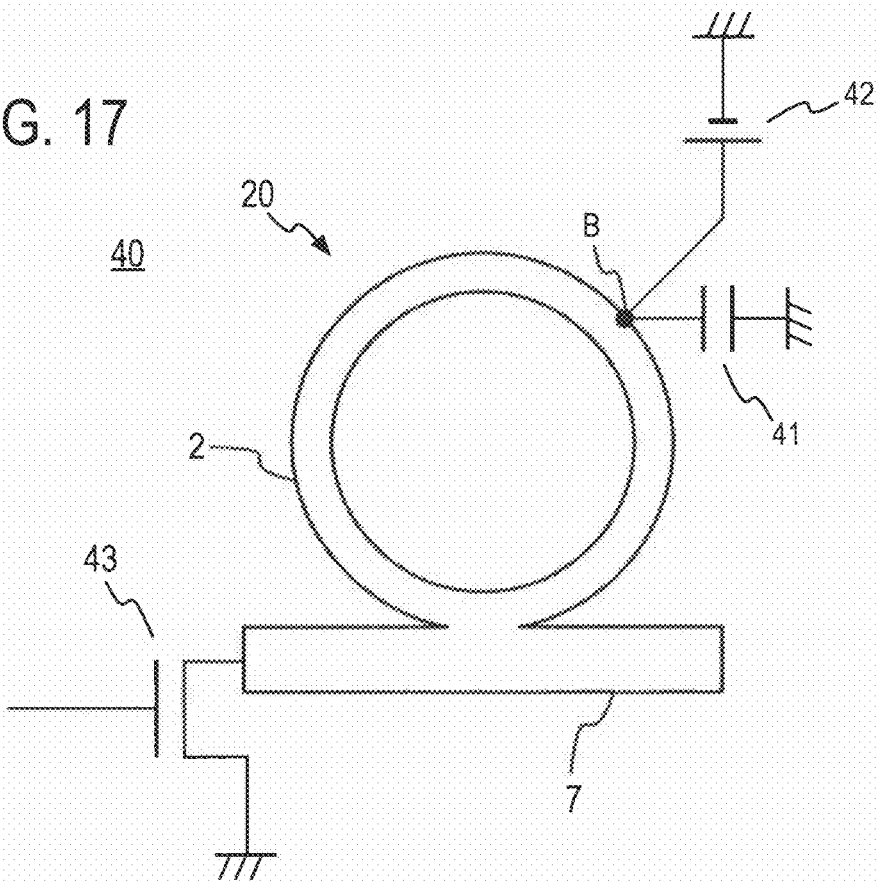
FIG. 17 shows an example of a bias circuit using a variable resonator.

As usage patterns of the variable resonator of the present invention, variable bandwidth filters have been mainly described in the foregoing. Referring to FIG. 17, an example of a bias circuit will be discussed as another usage pattern. In an illustrated bias circuit 40, a bias voltage is supplied to a field-effect transistor 43. In the bias circuit 40, by taking the advantage of the input impedance on the connecting portion between the input/output line 7 and the variable resonator 20 being infinite in the variable resonator 20 as long as a switch having been turned on is disposed on a position other than positions separated by nπ from the connecting portion between the input/output line 7 and the variable resonator 20, a bias supply point B can be disposed in a wide region on the variable resonator other than positions separated by nπ from the connecting portion. On the bias supply point B, a capacitor 41 plays the same role as the switch having been turned on (not shown). Thus by using the variable resonator of the present invention, it is possible to suppress the influence of the bias circuit on high-frequency characteristics without the need for high working accuracy for the bias circuit.

The bias circuit requires a mere resonator and not necessarily requires a variable resonator. However, the above example was described as an exemplary usage pattern of the variable resonator.

As is evident from this example, it should be noted that the variable resonator of the present invention is equivalent to a mere resonator in some usage patterns. In other words, when only one specific switch 3 is used, the variable resonator of the present invention simply acts as a fixed resonator. Furthermore, instead of switching electrical connection/disconnection by the switch 3, the capacitor 41 may be provided on, for example, a point on the ring-shaped line 2 to keep only the on state. In this case, the on state is kept not only by the capacitor 41 but also by an appropriate circuit element.

From this point of view, the variable bandwidth filter can be similarly configured as a fixed filter. To put it simply, for example, in FIG. 5A, the switch 3 is provided only on a predetermined position (at 30° in FIG. 5A) on the ring-shaped line 2 of the left resonator or the capacitor 41 is provided on the position to keep only an on state, and similarly the switch 3 is provided only on a predetermined position (at 20° in FIG. 5A) on the ring-shaped line 2 of the right resonator or the capacitor 41 is provided on the position to keep only the on state, so that a fixed filter operating in a predetermined bandwidth can be configured.

Figure 18:
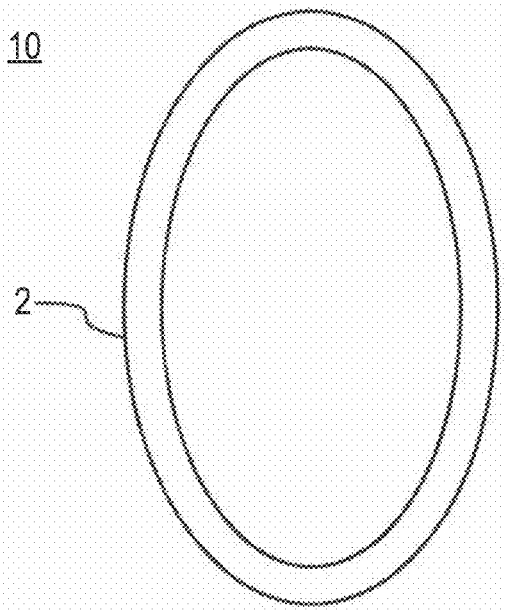
FIG. 18 shows an embodiment of a variable resonator using a ring-shaped line which is formed into an ellipse.
Figure 19:
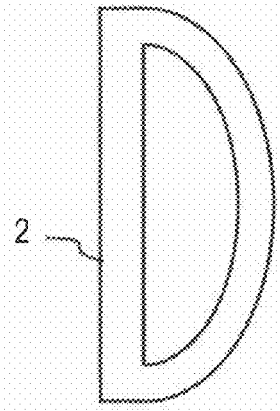
FIG. 19 shows an embodiment of a variable resonator using a ring-shaped line which is formed into an arc.

Although the above variable resonators and the variable resonators used in the variable bandwidth filter are all circular, the shape of the variable resonator is not particularly limited to a circle. In FIG. 4A, when a characteristic impedance $Z_2$ and a characteristic impedance $Z_3$ satisfy the condition of $Z_2=Z_3$ in the lossless transmission line model, the variable resonator may be oval as shown in FIG. 18 or may be arched as shown in FIG. 19.

Figure 20A:
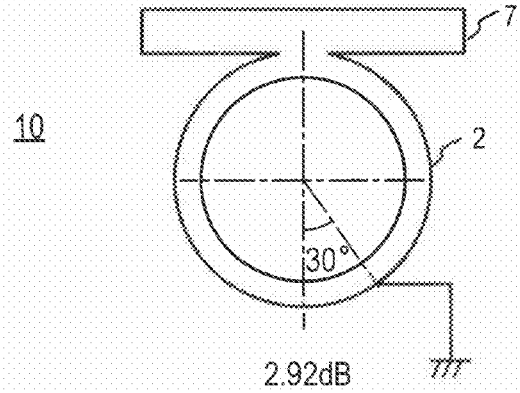
FIG. 20A shows a connection structure of a variable resonator having a circular ring-shaped line and a transmission line.
Figure 20B:
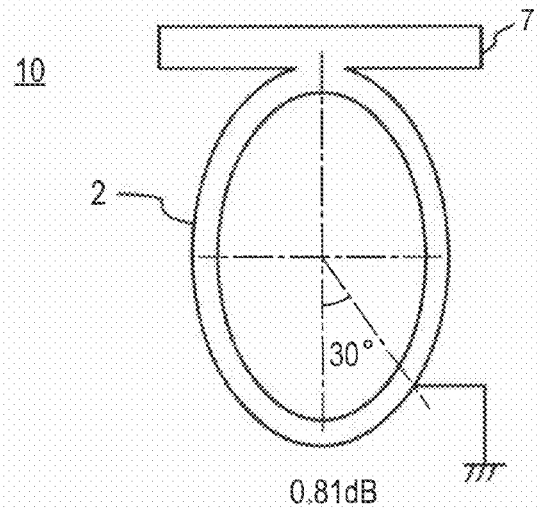
FIG. 20B shows a connection structure of a variable resonator having an oval ring-shaped line and a transmission line.

FIGS. 20A and 20B show modifications of the variable resonator and the connection of the variable resonator and the transmission line, from a viewpoint of an insertion loss which occurs on the transmission line due to the connection of the variable resonator.

Figure 25:
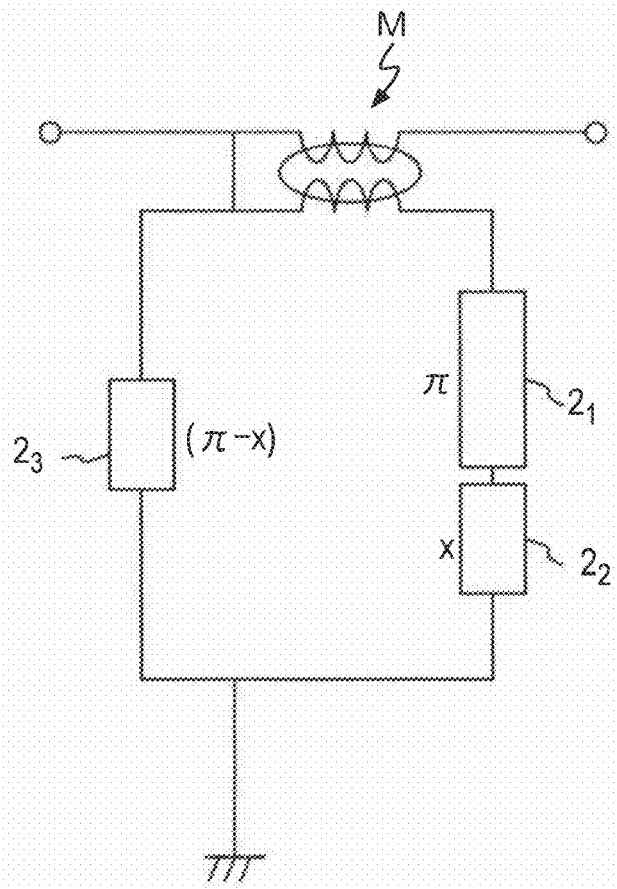
FIG. 25 shows a transmission line model for explaining electric field coupling.

FIG. 20A shows that a variable resonator having a circular ring-shaped line 2 is connected to an input/output line 7. The illustration of the switches 3 is omitted for the sake of simplicity and, instead, the grounding position is shown as a position of a via hole. As a result of electromagnetic field simulations, an insertion loss of 2.92 dB was obtained. The insertion loss occurs due to reflection on a connecting portion. The occurrence of the insertion loss will be described with reference to the transmission line model of FIG. 25. An impedance on a connecting portion decreases due to magnetic field coupling (represented as reference character M)

between a transmission line and a ring-shaped line and an input signal is reflected on the connecting portion, so that the loss occurs.

Thus, it is estimated that by lowering such magnetic field coupling, the insertion loss can be reduced.

As shown in FIG. 20B, when the variable resonator having an oval ring-shaped line 2 is connected to the input/output line 7, the insertion loss decreases to 0.81 dB. In other words, the insertion loss is reduced only by changing the shape of the ring-shaped line. This is because magnetic field coupling between the input/output line 7 and the ring-shaped line 2 is reduced by connecting the variable resonator to the input/output line such that the major axis of the ellipse, which is the shape of the ring-shaped line, intersects the input/output line 7.

In order to compare insertion losses under the same conditions, the same grounding portions are illustrated and the other conditions are the same (the same is true in the following description).

Figure 21A:
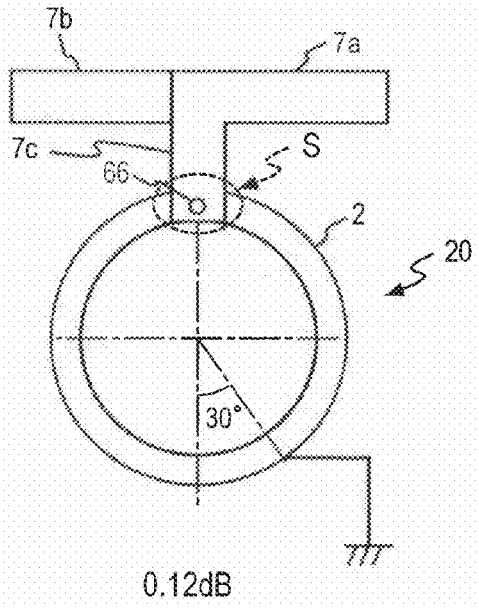
FIG. 21A shows a connection structure of a variable resonator and transmission lines in a five-layer structure.
Figure 21B:
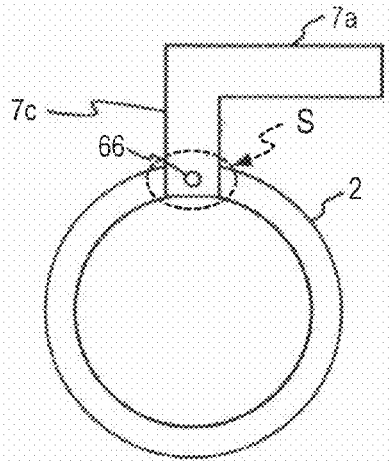
FIG. 21B is an explanatory drawing showing the relationship between a first layer and a second layer in the connection structure of the variable resonator and the transmission line in the case of the five-layer structure.
Figure 21C:
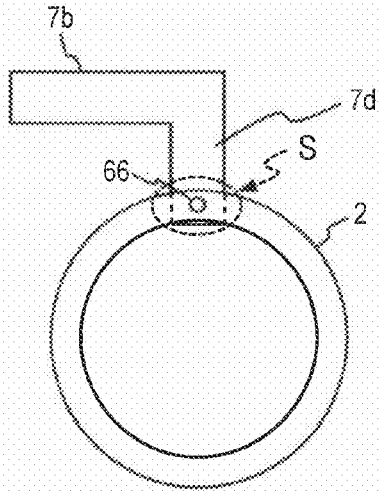
FIG. 21C is an explanatory drawing showing the relationship between the second layer and a third layer in the connection structure of the variable resonator and the transmission line in the case of the five-layer structure.

When a multilayer structure is acceptable as a design for a variable resonator, for example, the configuration of FIG. 21A may be used. When it is assumed that the closest layer in FIG. 21A is an upper layer and layers behind the upper layer are lower layers, an L-like input/output line 7*a* is disposed atop, a variable resonator is disposed under the input/output line 7*a*, and the end of a right-angled extended portion 7*c* of the input/output line 7*a* and the ring-shaped line 2 of the variable resonator overlap each other in an area S as shown in FIG. 21B. Further, as shown in FIG. 21C, an L-like input/output line 7*b* is disposed under the variable resonator and a right-angled extended portion 7*d* of the input/output line 7*b* and the ring-shaped line 2 of the variable resonator overlap each other in the area S. A via hole 66 is provided in the area S to electrically connect the input/output line 7*a*, the ring-shaped line 2, and the input/output line 7*b*.

Some modes of this multilayer structure will be further described with reference to sectional views taken along the line of sight of FIG. 21C. FIG. 21C is a plan view showing the multilayer structure. In the sectional views, an upper layer is disposed atop and lower layers are disposed under the top layer. The illustration of the switches 3 and so on is omitted to simplify the cross-sectional configurations.

Figure 22A:
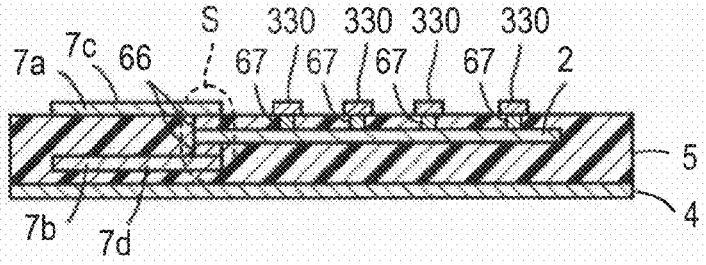
FIG. 22A shows a first example of the cross-sectional configuration of the connection structure shown in FIG. 21A.

In a first example of the multilayer structure, as shown in FIG. 22A, a ground conductor 4 serving as the bottom layer is formed under a laminated dielectric substrate 5 and an input/output line 7*a* is formed on the dielectric substrate 5. A ring-shaped line 2 and an input/output line 7*b* of the variable resonator are embedded and fixed in the dielectric substrate 5. The ring-shaped line 2 is disposed above the input/output line 7*b*. Further, a via hole 66 is provided in an area S to electrically connect the input/output line 7*a*, the ring-shaped line 2, and the input/output line 7*b*. For example, in order to activate the switches 3 (not shown) from the outside, via holes 67 are used to electrically connect the outside of the dielectric substrate and the switches 3 (not shown) on the ring-shaped line 2 which is embedded and fixed in the dielectric substrate 5, and the via holes 67 are electrically connected to uppermost conductors 330 formed on the top surface of the dielectric substrate 5. Such a multilayer structure can be obtained by forming the dielectric substrate 5 as a laminate structure. In FIG. 22A, it should be noted that the via hole 6, the conductor 33, and so on of FIG. 1C are not illustrated and the via hole 67 does not have the same function with the same object as the via hole 6.

Figure 22B:
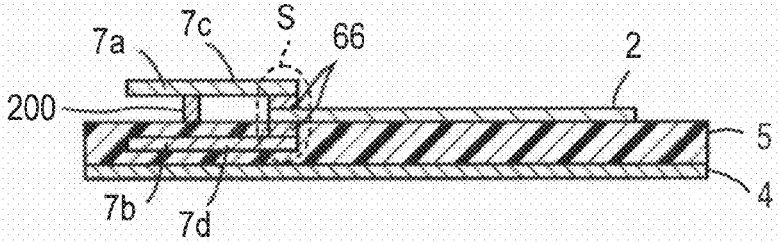
FIG. 22B shows a second example of the cross-sectional configuration of the connection structure shown in FIG. 21A.

In a second example, as shown in FIG. 22B, a ground conductor 4 serving as the bottom layer is formed under a dielectric substrate 5 and a ring-shaped line 2 is formed on the top surface of the dielectric substrate 5. An input/output line 7*b* is embedded and fixed in the dielectric substrate 5. An input/output line 7*a* is disposed above the ring-shaped line 2 and is supported by a support 200. In FIG. 22B, the support 200 is disposed between the input/output line 7*a* and the dielectric substrate 5 but the present invention is not limited to this configuration. Other configurations may be used as long as the input/output line 7*a* can be supported. The material of the support 200 can be freely selected according to the arrangement of the support 200. In the example of FIG. 22B, the support 200 may be made of either a metal or a dielectric. Further, a via hole 66 is provided in an area S to electrically connect the input/output line 7*a*, the ring-shaped line 2, and the input/output line 7*b*.

Figure 22C:
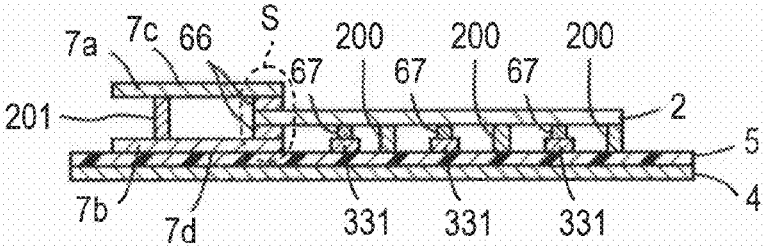
FIG. 22C shows a third example of the cross-sectional configuration of the connection structure shown in FIG. 21A.

In a third example, as shown in FIG. 22C, a ground conductor 4 serving as a bottom layer and a dielectric substrate 5 formed thereon are in contact with each other, and the dielectric substrate 5 is in contact with an input/output line 7*b* and conductors 331 which are formed thereon. A ring-shaped line 2 is supported above the input/output line 7*b* and the conductors 331 by supports 200. An input/output line 7*a* is supported above the ring-shaped line 2 by a support 201 disposed between the input/output line 7*a* and the input/output line 7*b*. In the configuration of FIG. 22C, the support 201 is made of a dielectric to prevent electrical connection between the input/output lines 7*a* and 7*b*. The conductors 331 and conductor columns 67 are disposed between the ring-shaped line 2 and the dielectric substrate 5 at positions corresponding to the switches 3. Further, a via hole 66 is provided in an area S to electrically connect the input/output line 7*a*, the ring-shaped line 2, and the input/output line 7*b*.

Figure 22D:
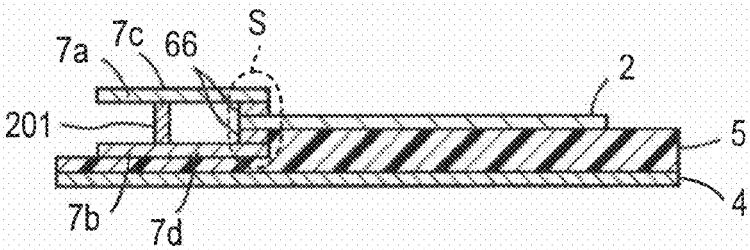
FIG. 22D shows a fourth example of the cross-sectional configuration of the connection structure shown in FIG. 21A.

In a fourth example, as shown in FIG. 22D, a ground conductor 4 serving as a bottom layer and a dielectric substrate 5 formed thereon are in contact with each other, and the dielectric substrate 5 is in contact with an input/output line 7*b* formed thereon. A ring-shaped line 2 formed on the dielectric substrate 5 is in contact with the dielectric substrate 5. As shown in FIG. 22D, since the dielectric substrate 5 has a stepped structure, the ring-shaped line 2 is disposed above the input/output line 7*b* while the input/output line 7*b* and the ring-shaped line 2 are both in contact with the dielectric substrate 5. An input/output line 7*a* is supported above the ring-shaped line 2 by the support 201 disposed between the input/output line 7*a* and the input/output line 7*b*. Further, a via hole 66 is provided in an area S to electrically connect the input/output line 7*a*, the ring-shaped line 2, and the input/output line 7*b*.

Figure 22E:
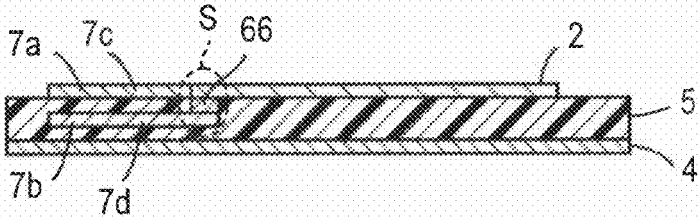
FIG. 22E shows a fifth example of the cross-sectional configuration of the connection structure shown in FIG. 21A.

In a fifth example, as shown in FIG. 22E, a ground conductor 4 serving as the bottom layer and a dielectric substrate 5 formed thereon are in contact with each other, and the dielectric substrate 5 is in contact with an input/output line 7*a* and a ring-shaped line 2 which are formed thereon. An input/output line 7*b* is embedded and fixed in the dielectric substrate 5. The input/output line 7*a* and the ring-shaped line 2 may be integrally formed as in, for example, the configurations of FIGS. 20A and 20B, or may be formed as separate members and electrically connected to each other. Further, a via hole 66 is provided in an area S to electrically connect the input/output line 7*a*, the ring-shaped line 2, and the input/output line 7*b*.

Figure 22F:
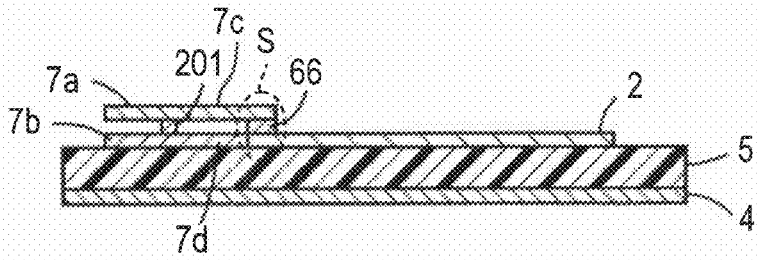
FIG. 22F shows a sixth example of the cross-sectional configuration of the connection structure shown in FIG. 21A.

In a sixth example, as shown in FIG. 22F, a ground conductor 4 serving as the bottom layer and a dielectric substrate 5 formed thereon are in contact with each other, and the dielectric substrate 5 is in contact with an input/output line 7*b* and a ring-shaped line 2 which are formed thereon. The input/output line 7*b* and the ring-shaped line 2 may be integrally formed as described above, or may be formed as separate members and electrically connected to each other. An input/output line 7*a* is supported above the ring-shaped line 2 and the input/output line 7*b* by the support 201 disposed between the input/output line 7*a* and the input/output line 7*b*. Further, a via hole 66 is provided in an area S to electrically connect the input/output line 7*a*, the ring-shaped line 2, and the input/output line 7*b*.

In the configuration of FIG. 21A, the insertion loss decreased to 0.12 dB according to the result of the electromagnetic field simulations.

Figure 23A:
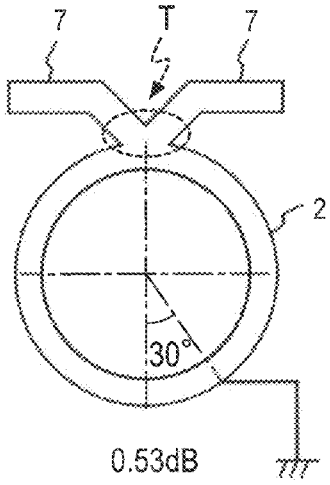
FIG. 23A shows a connection structure of a variable resonator and a transmission line having a bent portion.

Moreover, as shown in FIG. 23A, a V-shaped bent portion T may be provided on a part of the input/output line 7 and the bent portion T and the ring-shaped line 2 of the variable resonator may be connected to each other. In this way, the insertion loss can be reduced by increasing a distance between the input/output line 7 and the ring-shaped line 2. In this case, the insertion loss decreased to 0.53 dB according to the result of the electromagnetic field simulations.

Figure 23B:
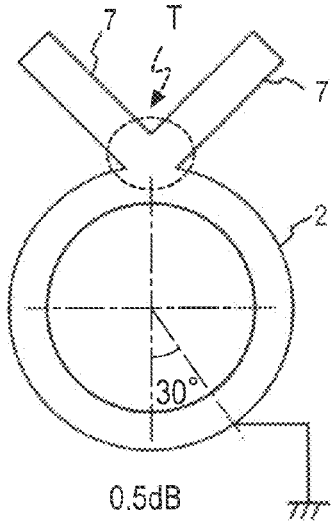
FIG. 23B shows a connection structure of a variable resonator and a transmission line having a bent portion.

For the convenience of a circuit configuration having a plurality of variable resonators, a variable resonator and an input/output line entirely shaped like V can be connected to each other as shown in FIG. 23B. In this case, the insertion loss decreased to 0.5 dB according to the result of the electromagnetic field simulations.

In FIGS. 23A and 23B, the ring-shaped line 2 and the input/output line 7 are electrically connected to each other in the same layer while being integrally formed or formed as separate members. However, the ring-shaped line 2 and the input/output line 7 can be configured as a multilayer structure as shown in FIG. 21A.

Figure 24:
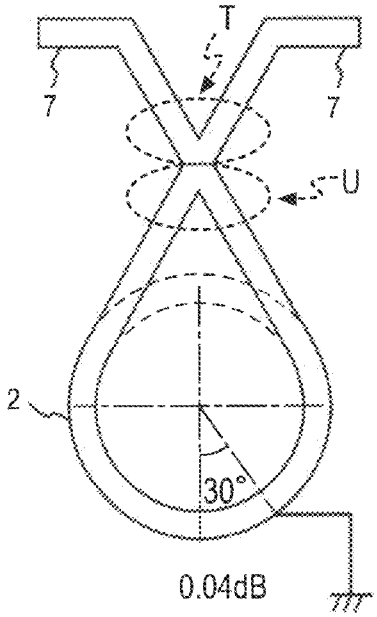
FIG. 24 shows a connection structure of a variable resonator and a transmission line having a bent portion.

Further, as a modification of the connecting configuration of FIG. 23A, as shown in FIG. 24, a ring-shaped line 2 is formed to extend in tangential directions from both ends of a circular portion indicated by a broken line, and the ring-shaped line 2 is combined with the top of the V-shaped bent portion of an input/output line 7 so as to form "X". The ring-shaped line 2 is deformed into a teardrop shape. With this configuration, the bent portion T of the input/output line 7 may be connected to a bent portion U of the ring-shaped line 2 which is shaped like a teardrop in the variable resonator.

In the configuration of FIG. 24, the insertion loss decreased to 0.04 dB according to the result of the electromagnetic field simulations.

As compared with the connecting configuration of FIG. 23A, the insertion loss is considerably reduced in the connecting configuration of FIG. 24. This is because the input/output line 7 and the line 2 of the variable resonator are further separated from each other, and in the connecting configuration of FIG. 24, the ring-shaped line 2 hardly has a portion parallel to the input/output line 7 near the connecting portion of the input/output line 7 and the ring-shaped line 2 in contrast to the connecting configuration of FIG. 23A in which the ring-shaped line 2 has a line portion parallel to the input/output line 7, so that magnetic field coupling is more unlikely to occur. According to this examination, the shape of the ring-shaped line 2 is not limited to the teardrop shape of FIG. 24 and any shape can be used as long as the connecting configuration of the input/output line 7 and the ring-shaped line 2 causes less magnetic field coupling.

Figure 26:
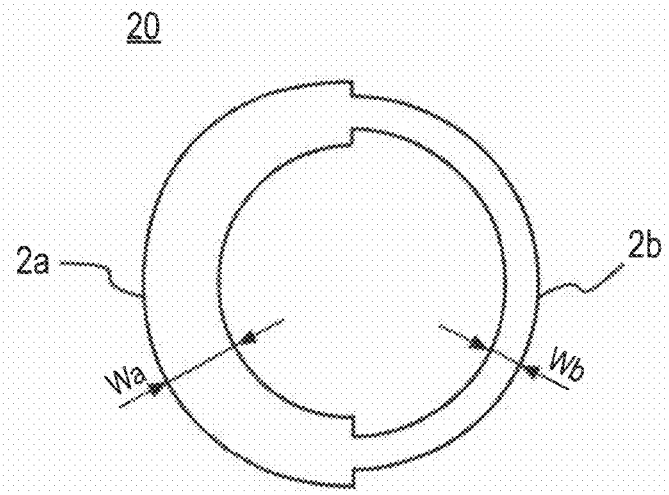
FIG. 26 shows an embodiment of a variable resonator using a ring-shaped conductor line made up of conductor lines having different line widths.

Further, as shown in FIG. 26, two input/output lines 2*a* and 2*b* having different line widths Wa and Wb may be connected like a loop to form a ring-shaped line 2 of the variable resonator. Although FIG. 26 shows two line widths, the number of line widths is not limited to two and thus lines having three or more different line widths can be similarly connected like a loop to form a ring-shaped line 2 of the variable resonator. Also in this case, the characteristic impedance $Z_2$ and the characteristic impedance $Z_3$ satisfy the condition of $Z_2=Z_3$ on paths relative to the electric length $\pi$ in the lossless transmission line model of FIG. 4A. In these drawings, illustration of the switches 3 is not shown.

Figure 27:
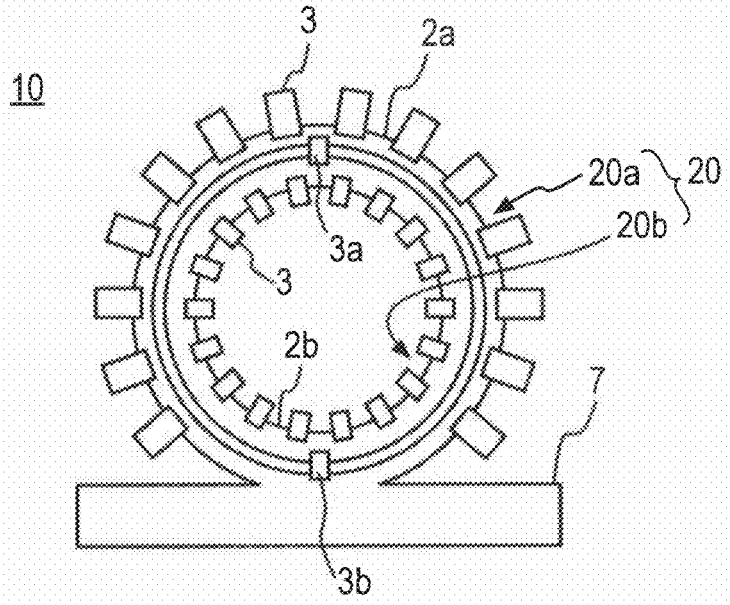
FIG. 27 shows an embodiment in which a variable resonator is configured by combining two variable resonators.

In a variable resonator 20 of FIG. 27, a variable resonator 20*b* having a different line width is provided inside a variable resonator 20*a*, and the variable resonators 20*a* and 20*b* are electrically connected to each other via switches 3*a* and 3*b* which are two circuit switches. The switch 3*b* is connected to the position of a half wavelength or integral multiple thereof at the resonance frequency of the variable resonator 20*a* from the position of the connected switch 3*a* on the ring-shaped line 2*a* of the variable resonator 20*a* and, at the same time, connected to the position of a half wavelength or integral multiple thereof at the resonance frequency of the variable resonator 20*b* from the position of the connected switch 3*a* on the ring-shaped line 2*b* of the variable resonator 20*b*. The variable resonator 20 is a modification of the variable bandwidth filter of FIG. 11C in which the two variable resonators having different characteristic impedances are used. This configuration makes it possible to reduce an area required for a circuit configuration. In this modification, the resonators having different line widths are combined. Resonators having the same line width may be combined instead.

Figure 28:
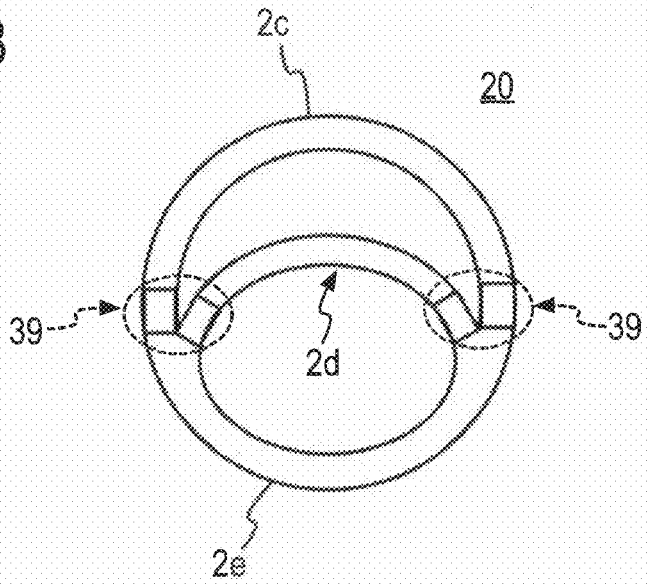
FIG. 28 shows an embodiment of a variable resonator capable of switching over conductor lines of two different line lengths.

In a variable resonator of FIG. 28, branching switches 39 acting as two circuit switches for selecting two lines having different lengths are provided on the ring-shaped line of a variable resonator 20. The synchronized switching of the branching switches 39 makes it possible to select one of line portions 2*c* and 2*d* having different lengths, achieving two kinds of variable resonators having different circumferential lengths. One of the variable resonators has a ring-shaped line closed by a common line portion 2*e* and the line portion 2*c* and the other variable resonator has a ring-shaped line closed by the common line portion 2*e* and the line portion 2*d*. The ring-shaped lines are selected thus by the branching switches 39, so that the line length of the variable resonator can be changed and the resonance frequency can be variable. Although the variable resonator of FIG. 28 has the same function as the variable resonator of FIG. 11A, the area required for the variable resonator of FIG. 28 can be smaller.

The ring-shaped line closed by the common line portion 2*e* and the line portion 2*c* and the ring-shaped line closed by the common line portion 2*e* and the line portion 2*d* have different lengths which are a wavelength at the resonance frequency or the integral multiple of the wavelength.

In this configuration, the two lines 2*c* and 2*d* are illustrated as an example. Three or more lines having different circumferential lengths can be similarly configured.

Regarding the two embodiments of the variable resonator 20 shown in FIGS. 1A and 1B, a supplementary explanation will be described below. In the variable resonator 20 of FIG. 1A, the other end 32 of each switch 3 is disposed outside the ring-shaped line 2. Thus, the provision of the switches 3 near the connecting portion between the variable resonator 20 and the input/output line 7 is limited in order to prevent contact with the input/output line 7. Meanwhile, in the variable resonator 20 of FIG. 1B, the other end 32 of each switch 3 is disposed inside the ring-shaped line 2 and thus such a limitation is not imposed. However, in the variable resonator 20 of FIG. 1B, for example, when a wire for operating each switch 3 is connected from the outside of the variable resonator 20, the wire may have to be extended to the inside of the variable resonator 20 over the ring-shaped line 2. Thus, it is difficult to realize the variable resonator 20 on a single-layer substrate. This difficulty can be easily overcome by forming a double-layer substrate in which, for example, the variable resonator 20 is disposed as a lower layer and the wires for operating the switches 3 are disposed as an upper layer. The variable resonator 20 of FIG. 1A does not cause this difficulty.

In the foregoing embodiments, microstrip line structures are used. The present invention is not limited to such a line structure, and thus line structures such as a coplanar waveguide may be used.

Figure 29:
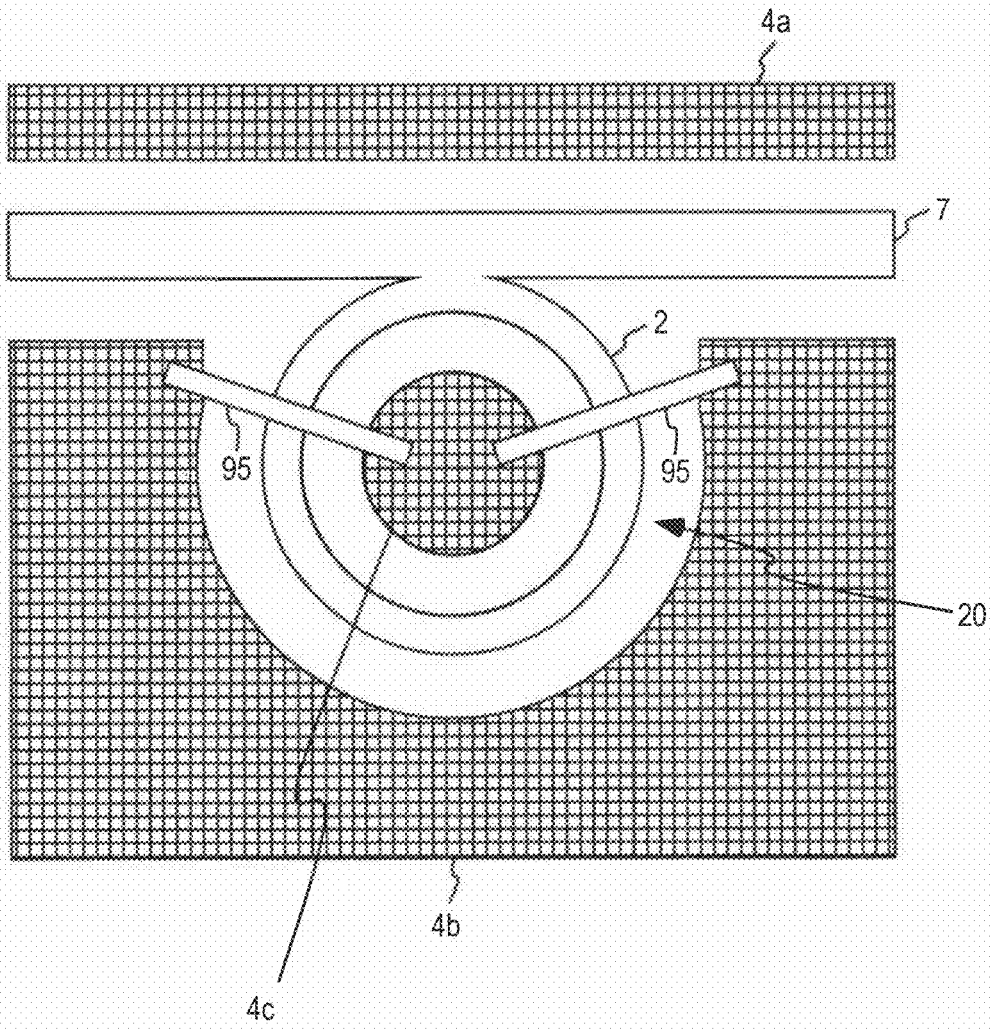
FIG. 29 shows a connection structure of a variable resonator and a transmission line when using a coplanar waveguide.

FIG. 29 shows the case of a coplanar waveguide. Ground conductors 4*a* and 4*b* are disposed on the same surface of a dielectric substrate, and an input/output line 7 connected to a variable resonator 20 is disposed in a gap between the ground conductors 4*a* and 4*b*. Further, a ground conductor 4*c* is disposed inside the ring-shaped line 2 of the variable resonator 20 without making contact with the ring-shaped line 2. The ground conductors 4*b* and 4*c* are electrically connected to each other via air bridges 95 to have an equal potential. The air bridges 95 are not necessary constituent elements when a coplanar waveguide is used. For example, the following configuration may be used: A rear ground conductor (not shown) is disposed on one of the surfaces of the substrate, the surface being opposite from the surface having the ground conductors 4*a*, 4*b* and 4*c* and the input/output line 7, the ground conductor 4*c* and the rear ground conductor are electrically connected to each other via a via hole, and the ground conductor 4*b* and the rear ground conductor are electrically connected to each other via a via hole, so that the ground conductors 4*b* and 4*c* have an equal potential.

In the foregoing embodiments, the impedances of the ports P1 and P2 are equal to that of the input/output line 7. In actual designs, these impedances may not be equal to each other. In this case, the resonance frequency may be deviated by changing the position of the switch to be turned on.

Figure 30A:
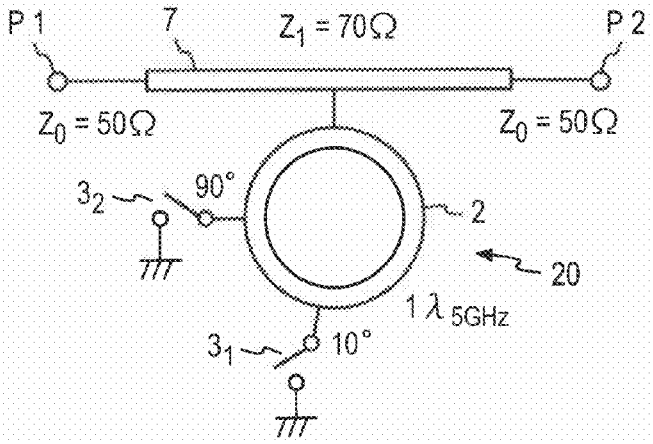
FIG. 30A is a circuit diagram for explaining a problem arises when a port impedance is different from the impedance of an input/output line.

FIG. 30A shows a specific example in which one of the variable resonators 20 of the present invention is connected to the input/output line 7. In the variable resonator 20, a ring-shaped line (the length is a wavelength of 5 GHz) 2 having a characteristic impedance of 50Ω is formed and the ends at a plurality of switches (two switches $3_1$ and $3_2$ in FIG. 30A) are connected to a ring-shaped line 2. The other ends of the switches are connected to the ground conductors. In FIG. 30A, the switches $3_1$ and $3_2$ are provided on the angular positions of 10° and 90° from the position of 180° in terms of an electric length from the connecting portion between the ring-shaped line 2 and the input/output line 7. The impedance $Z_0$ of the input/output ports P1 and P2 is 50Ω. The following will describe the case where the impedance $Z_1$ of the input/output line 7 is different from the impedance $Z_0$ of the input/output ports P1 and P2. In this example, the characteristic impedance $Z_1$ is 70Ω.

Figure 30B:
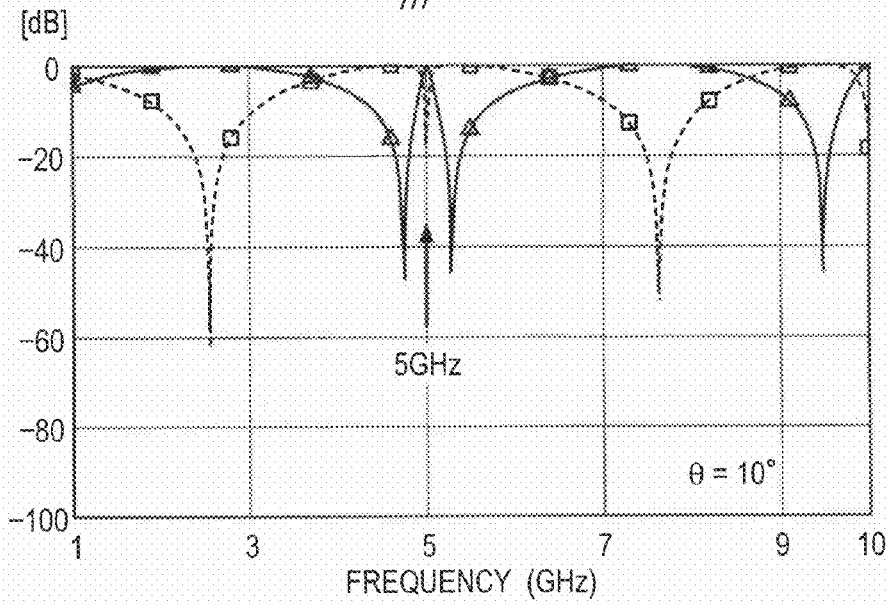
Figure 30C:
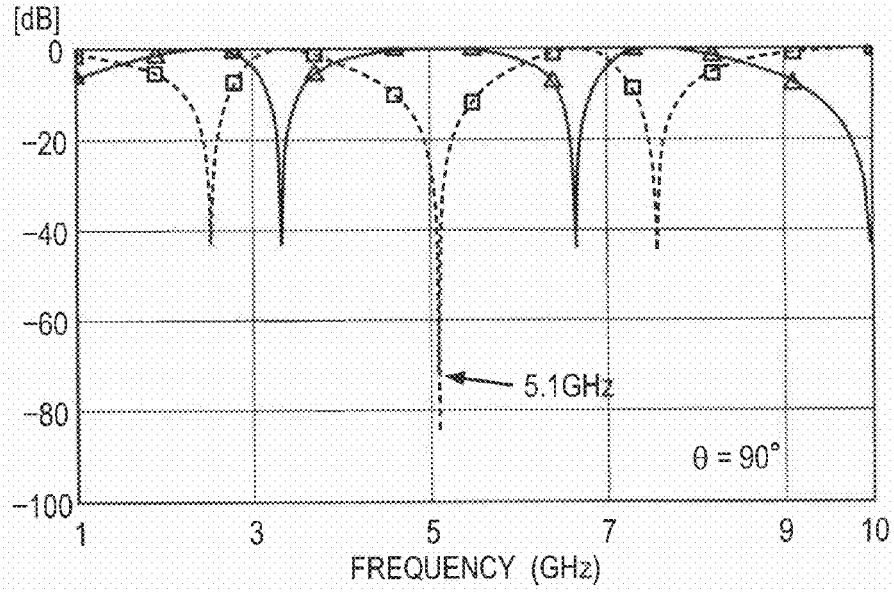

The present invention is characterized in that by selecting one to be turned on of the switches $3_1$ and $3_2$ connected to the ring-shaped line 2, the bandwidth can be changed while keeping the resonance frequency. However, as shown in FIG. 30A, when the variable resonator 20 is connected to the input/output line 7 having the characteristic impedance $Z_1$ different from the port impedance $Z_0$, the resonance frequency is changed by the switch to be turned on, as shown in FIGS. 30B and 30C indicating the frequency characteristics of a transmission coefficient (solid line) and a reflection coefficient (broken line) between the input/output ports when the switch $3_1$ is turned on and when the switch $3_2$ is turned on, respectively.

Figure 31:
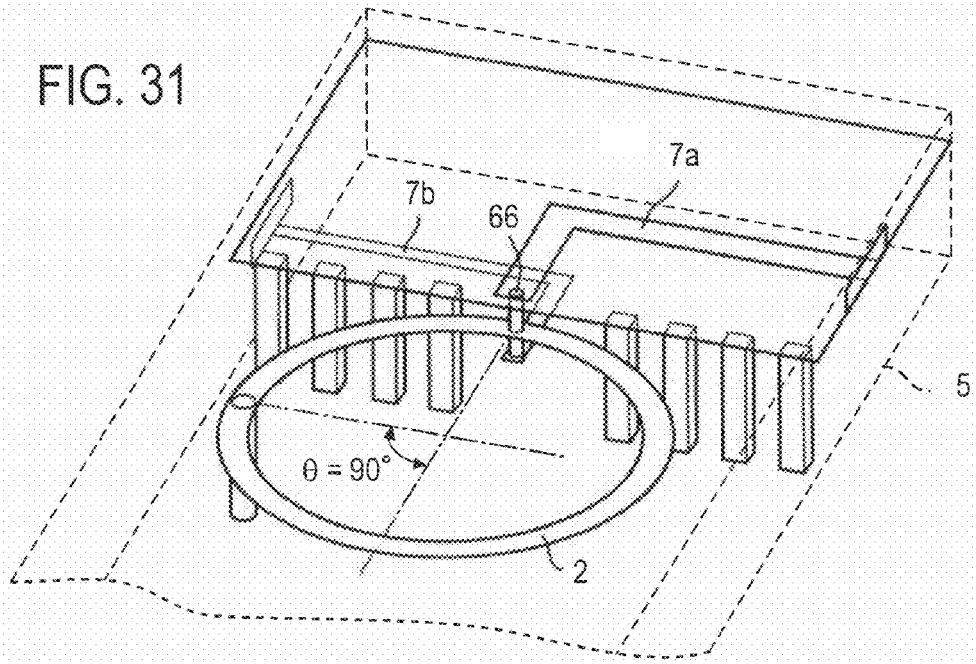
FIG. 31 shows an example of the multi-level structure of a resonator causing impedance mismatch.
Figure 32:
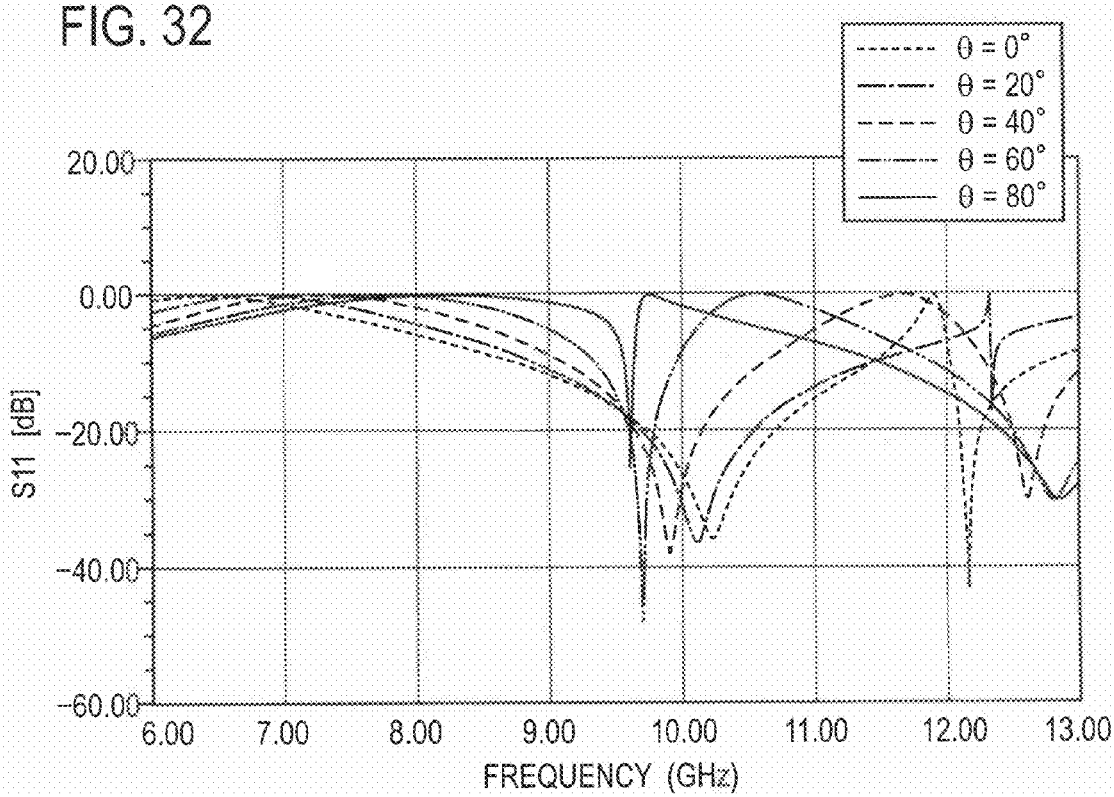
FIG. 32 is a graph showing an example of the frequency characteristics of the structure shown in FIG. 31.

This problem arises also in the circuit of FIG. 31. FIG. 31 shows an example of a multi-layer structure including lines 7*a* and 7*b* for inputting and outputting signals to and from the variable resonator 20. FIG. 32 shows the frequency characteristics of the reflection coefficient of FIG. 31. The angular position of the switch having been turned on corresponds to an angular position θ of FIG. 31. FIG. 32 shows that the switch to be turned on is selected by changing the value of θ to 0°, 20°, 40°, 60° and 80°. However, in this example, the resonance frequency of the variable resonator is about 10 GHz. As is evident from FIG. 32, the resonance frequency changes around 10 GHz according to the value of the angular position θ. The resonance frequency is changed by a mismatch between the characteristic impedance $Z_1$ and the port impedance $Z_0$. The mismatch is caused by electromagnetic field coupling occurring on a portion where the input/output lines 7*a* and 7*b* are vertically opposed to each other and on the via hole 66 connecting the upper and lower input/output lines 7*a* and 7*b* in FIG. 31. This phenomenon is similar to that of FIG. 30A. Even when the width of the input/output line 7 changes, the characteristic impedance $Z_1$ changes.

Figure 33A:
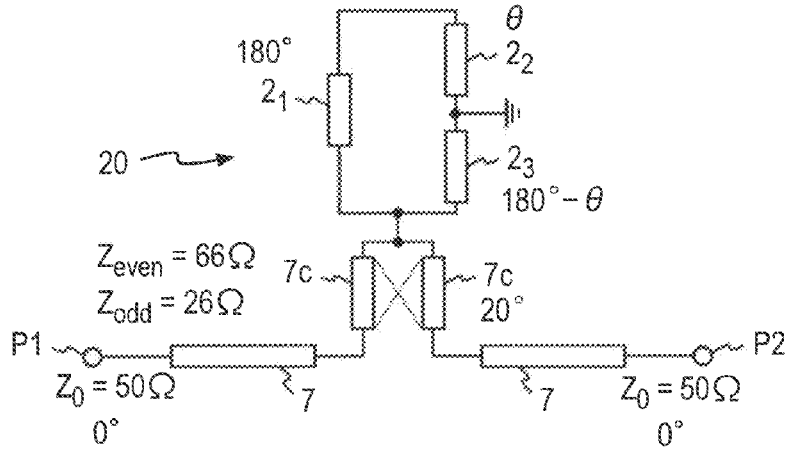
FIG. 33A shows circuit conditions for simulations.

FIG. 33A is a circuit for simulating the influence of change in the impedance of an input/output line 7 on a characteristic between input/output ports P1 and P2 caused by electromagnetic field coupling near portions connected to a variable resonator 20. For simulations, line portions near the connecting portion of this variable resonator are represented as lines 7*c* connecting input/output lines 7*a* and the variable resonator 20. Lines connecting the two lines 7*c* while intersecting each other represent electromagnetic field coupling on the input/output ends of the lines 7*c*.

Figure 33B:
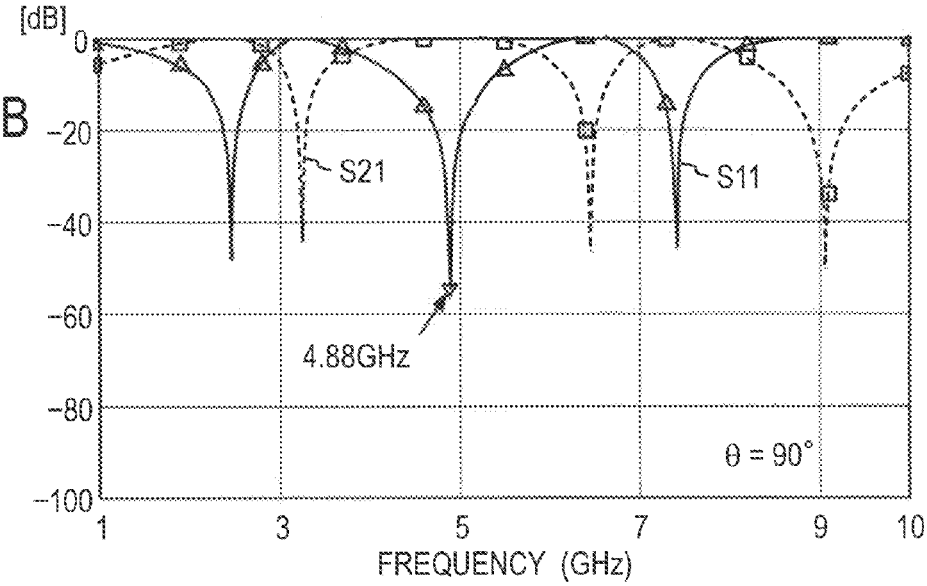
FIG. 33B is a graph showing the frequency characteristics for $\theta=90°$.
Figure 33C:
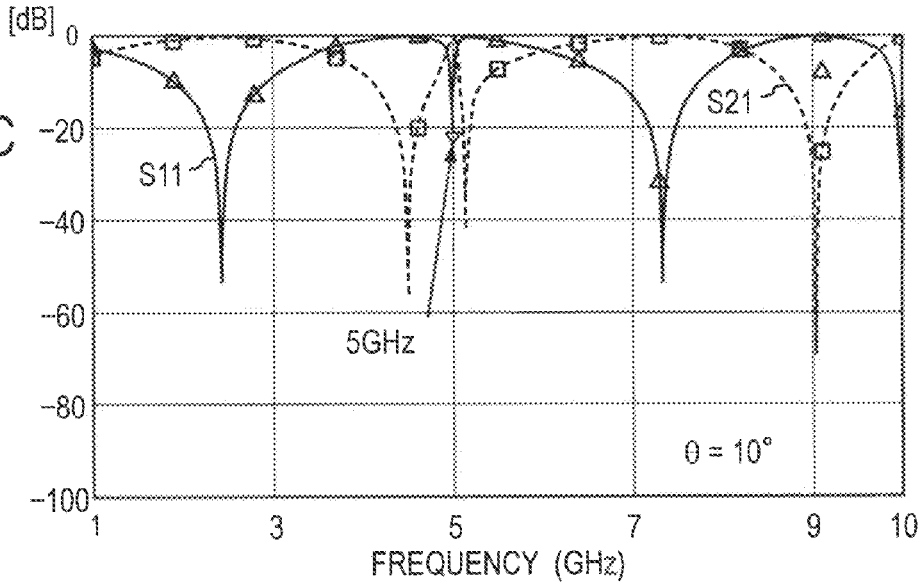
FIG. 33C is a graph showing the frequency characteristics for $\theta=10°$.

FIGS. 33B and 33C show frequency characteristics of a transmission coefficient (solid line) and a reflection coefficient (broken line) between ports P1 and P2 when the even mode impedance and the odd mode impedance of the input/output line 7 are 66Ω and 26Ω with the lines 7*c* brought close to each other. FIG. 33B shows characteristics when θ is 90° and FIG. 33C shows characteristics when θ is 10°. In this case, as in FIGS. 31 and 32, the resonance frequency for θ=90° is 4.88 GHz and the resonance frequency for θ=10° is 5 GHz. The resonance frequency changes in response to the switch to be turned on.

Figure 34A:
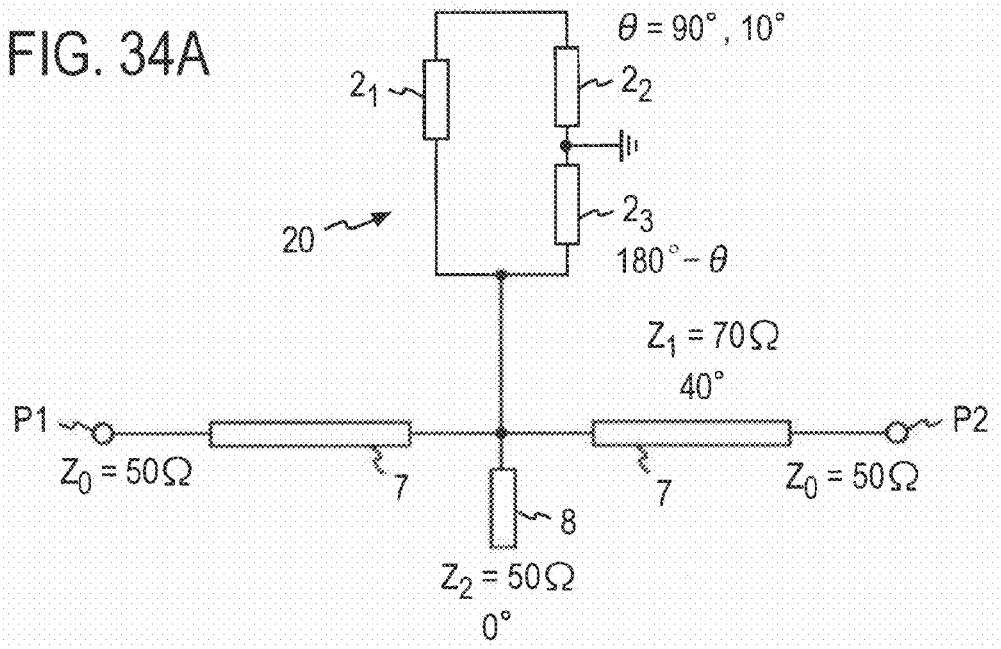
FIG. 34A shows circuit conditions for simulations when a stub length is 0.
Figure 36A:
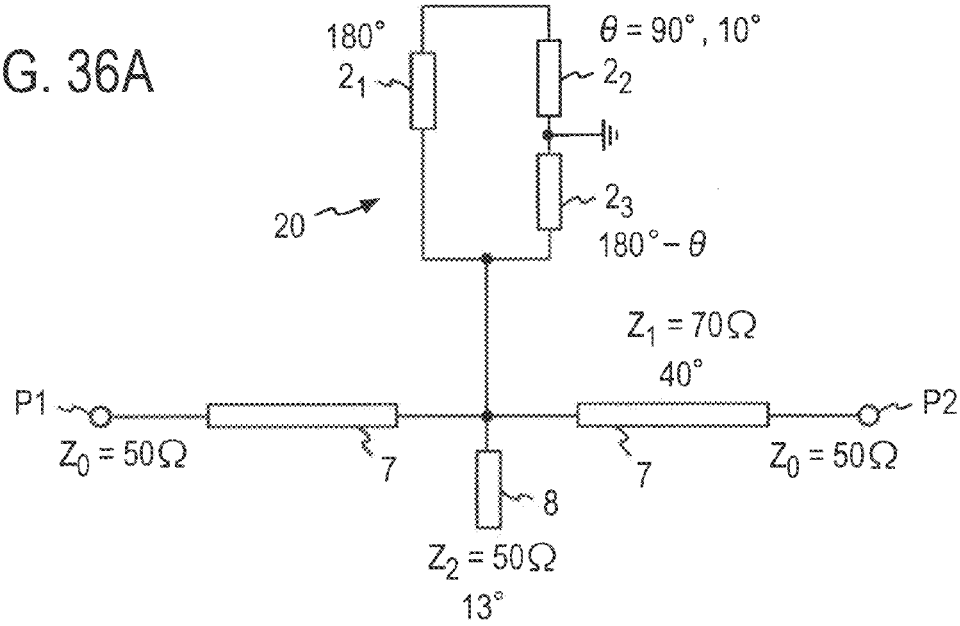
FIG. 36A shows circuit conditions for simulations when a stub length is 13°.

In order to solve this problem, in the following embodiment, a circuit adjustment element is added to a line and/or a resonator. FIGS. 34A and 36A are circuit diagrams for explaining the function of an added circuit adjustment element 8. In the following explanation, a stub having an open end is used as an example of the circuit adjustment element 8. Input/output lines 7 connected to a variable resonator 20 have a characteristic impedance of 70Ω and ports P1 and P2 have an impedance of 50Ω. The path length of the variable resonator 20 is equal to a wavelength at 5 GHz. On a position where the variable resonator 20 is connected to the input/output lines 7, an open-end stub 8 is connected.

Figure 34B:
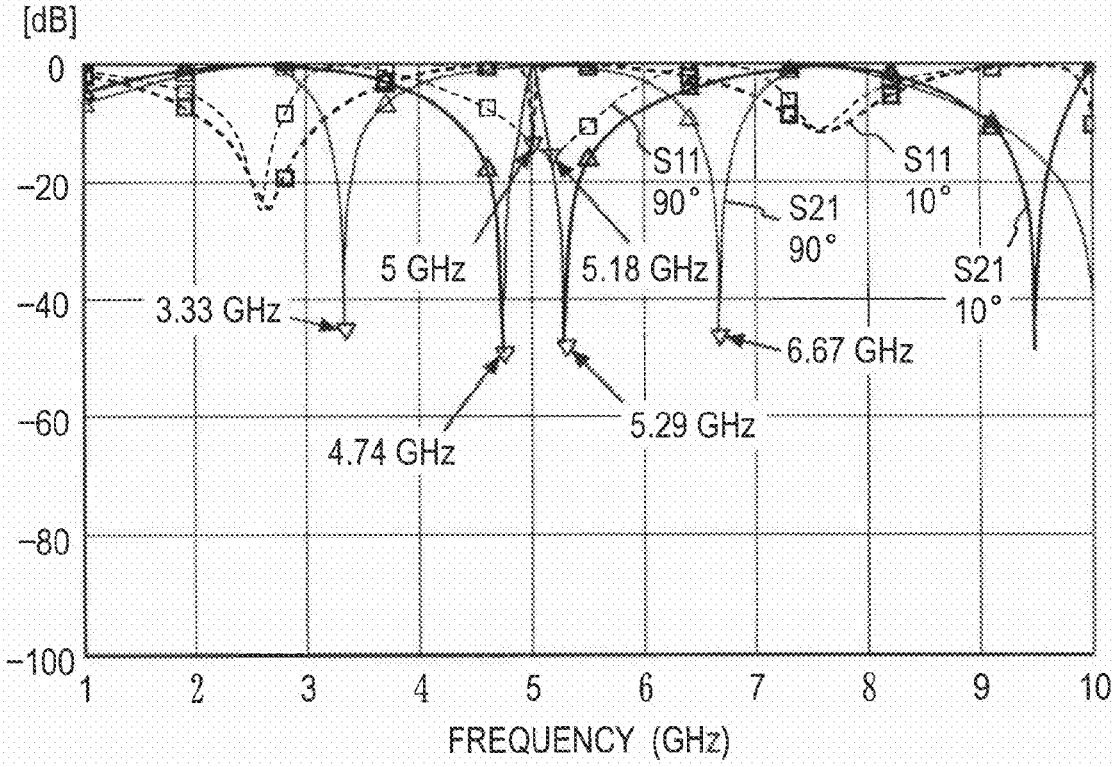
FIG. 34B is a graph showing frequency characteristics for different $\theta$.

First, when the stub 8 is not added, the electric length of the stub is represented as 0° in FIG. 34A and the frequency characteristics of S21 and S11 are obtained as shown in FIG. 34B. FIG. 34B shows four curves. A solid line indicates S21 (transmission coefficient), a broken line indicates S11 (reflection coefficient), a thick line indicates characteristics when a switch at 90° is turned on, and a thin line indicates characteristics when a switch at 10° is turned on. Resonance occurs at 5 GHz when the switch at 10° is turned on and at 5.1 GHz when the switch at 90° is turned on. The resonance frequency changes as in the above description.

Figure 35A:
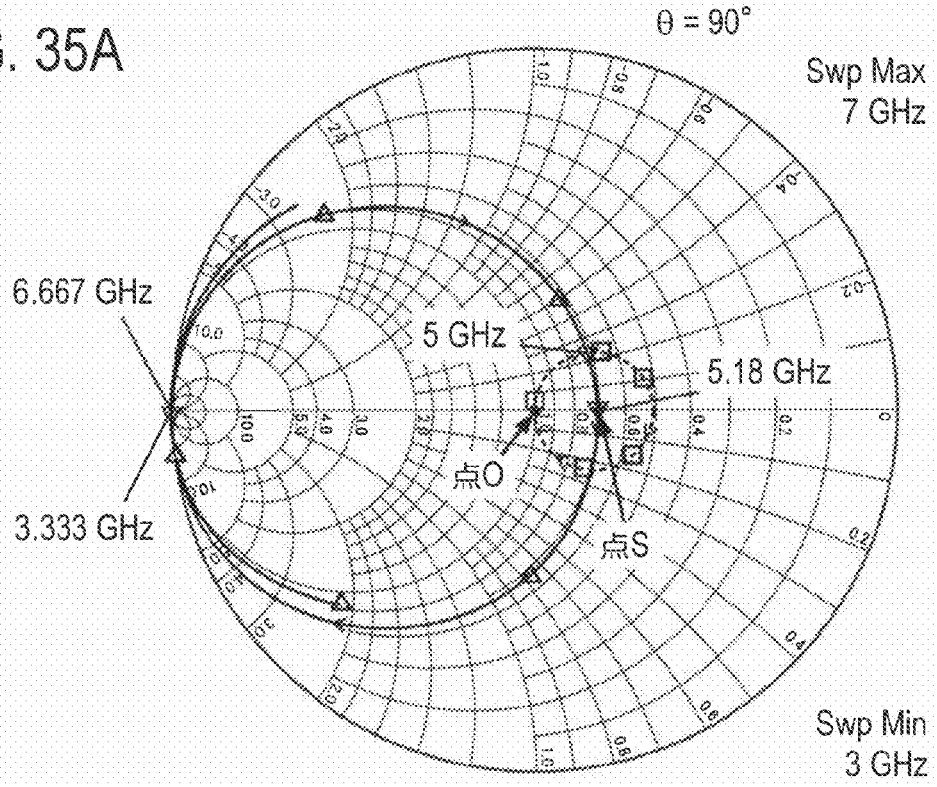
FIG. 35A is a Smith chart when $\theta=90°$ is set in the circuit of FIG. 34A.

FIG. 35A is a Smith chart showing the reflection coefficient S11 of the port P1. A thick line indicates the overall characteristics of the circuit of FIG. 34A and a thin line indicates the characteristics of only the input/output line 7 in the circuit of FIG. 34A, except for the variable resonator 20. Since the variable resonator 20 of FIG. 34A resonates at 5 GHz, the variable resonator 20 has an infinite impedance on the connecting point of the input/output line 7 and the variable resonator 20. Therefore, the impedance is equivalent to the absence of the variable resonator 20 at 5 GHz, which agrees with the characteristics of only the input/output line 7. S11 is minimized at a point S on the thick line. The point S is the closest to a point (point O in FIG. 34A) having a port impedance of 50Ω. The point S has a resonance frequency of 5.18 GHz which is different from 5 GHz, the resonance frequency of the variable resonator 20.

Figure 35B:
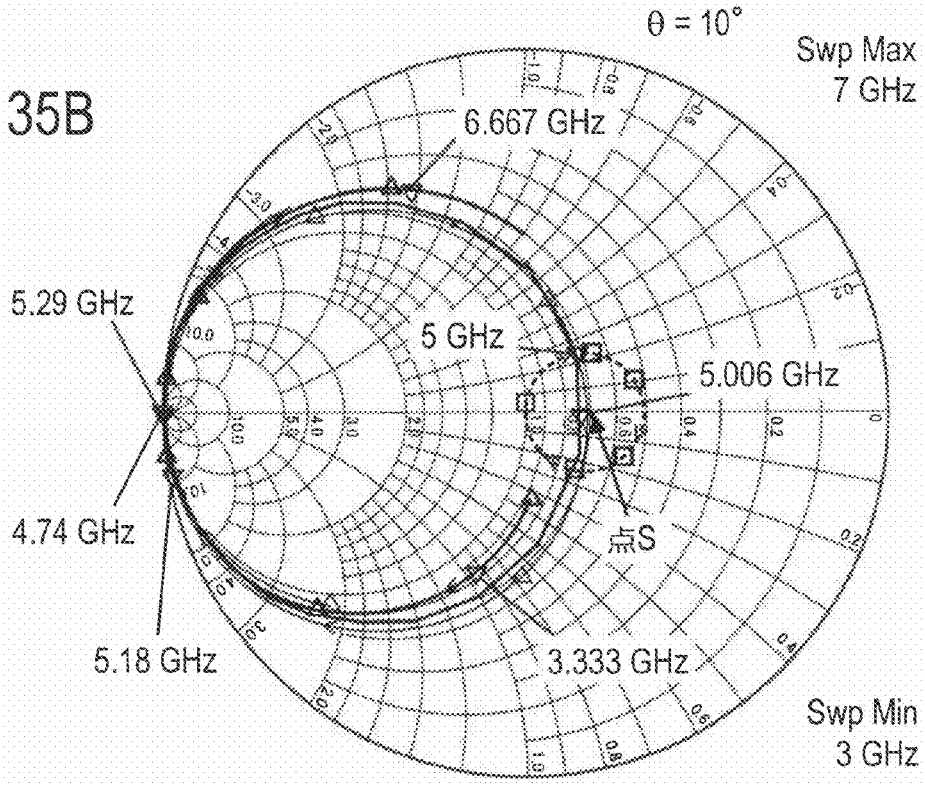
FIG. 35B is a Smith chart for $\theta=10°$.

At θ=10°, as shown in FIG. 35B, the reactance component of the impedance of the variable resonator 20 rapidly changes relative to a frequency as compared with the case of θ=90°. Thus the point S has a frequency of 5.006 GHz which is not largely deviated from 5 GHz. The resonance frequency of the overall circuit (the minimum frequency of S11) changes thus according to the angular position θ of the switch having been turned on. As shown in FIG. 34A, even when connecting the input/output line 7 having an impedance different from that of the port to the variable resonator 20, the resonance frequency of the ring-shaped variable resonator 20 is constant regardless of the position θ of the switch having been turned on. Thus the impedance at 5 GHz is not deviated even when the position θ of the switch having been turned on is changed. If the characteristic impedance $Z_1$ of the input/output line 7 is 50Ω which is equal to the port impedance $Z_0$, the thin line has the point O and such a change does not occur.

Figure 36B:
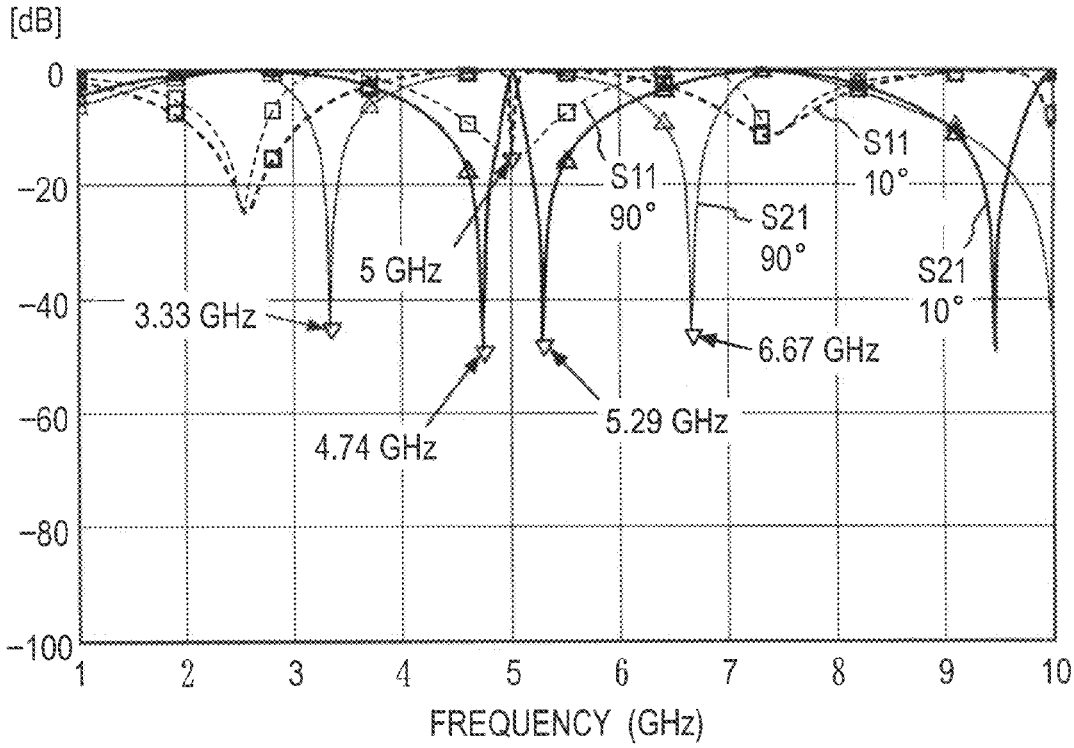
FIG. 36B is a graph showing frequency characteristics for different $\theta$.
Figure 37A:
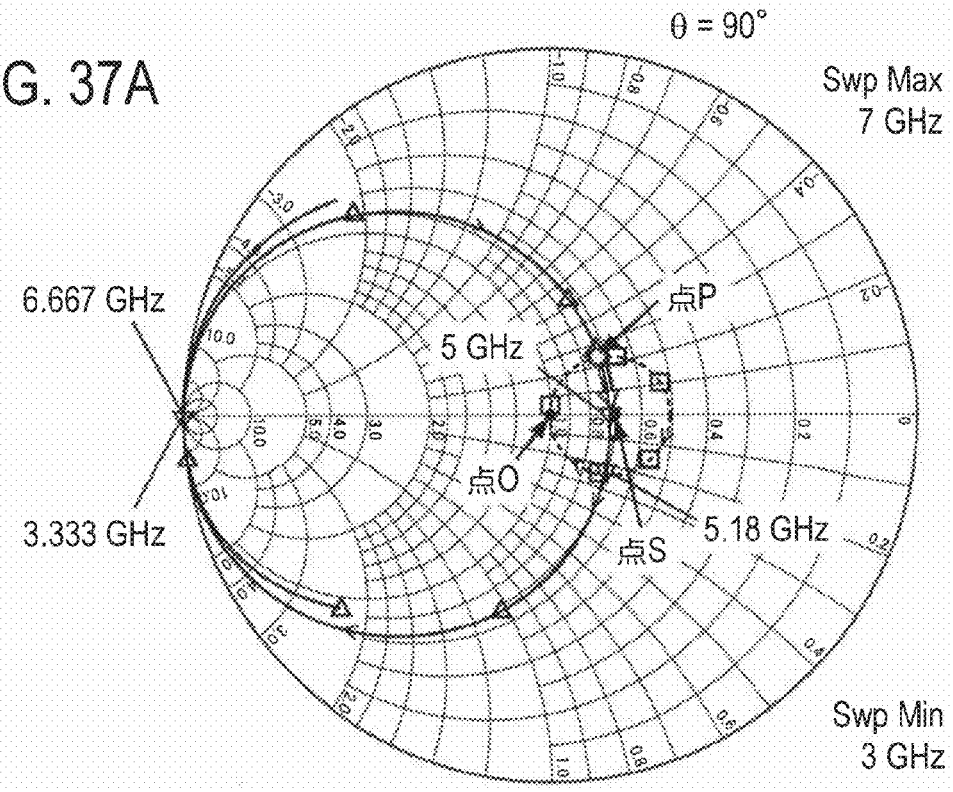
FIG. 37A is a Smith chart when $\theta=90°$ is set in the circuit of FIG. 36A.
Figure 37B:
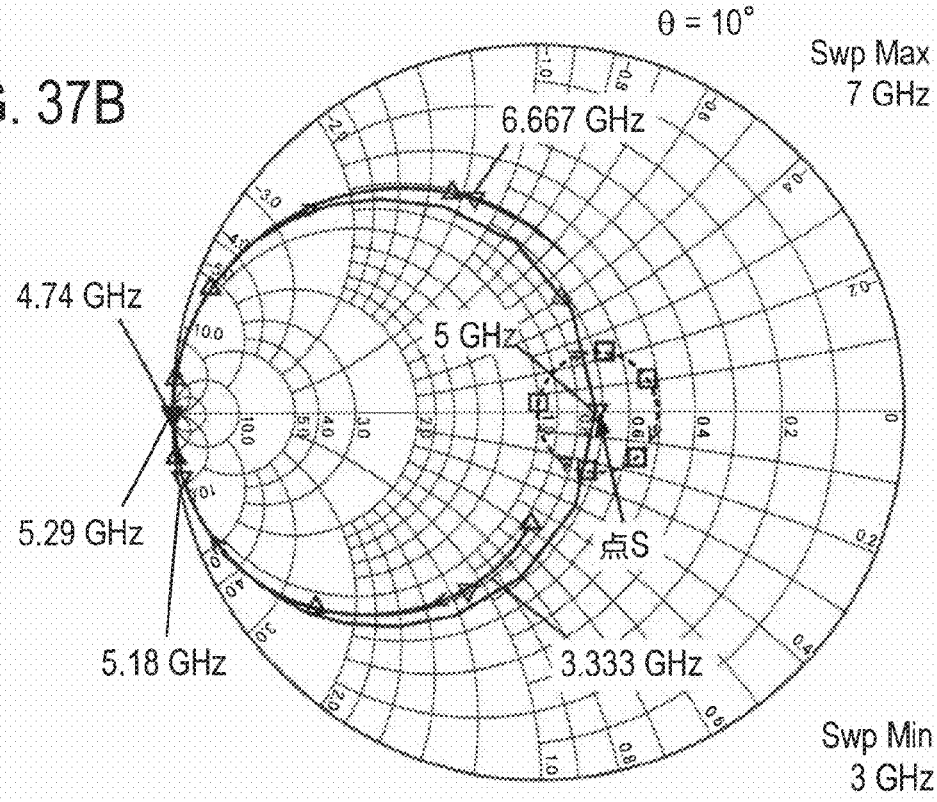
FIG. 37B is a Smith chart for $\theta=10°$.

The following will describe the case where the stub 8 is added. FIG. 36A shows that the open-end stub 8 having a characteristic impedance of 50Ω and an electric length of 13° is connected in parallel to a variable resonator 20. FIG. 36B shows characteristics corresponding to FIG. 34B. As is evident from FIG. 36B, the provision of stub 8 keeps the resonance frequency of the overall circuit constant at 5 GHz regardless of the angular position of the switch having been turned on. This finding will be further described with reference to FIGS. 37A and 37B. Also in FIGS. 37A and 37B, broken lines indicate the characteristics of only the input/output lines 7 in FIG. 34A, except for the variable resonator 20. In FIG. 37A where a switch on the angular position of 90° is turned on, a point P represents the reflection coefficient of 5 GHz in FIG. 35A. The point P is moved to a point S by the stub 8. Thus S11 at 5 GHz is minimized. As described above, the variable resonator 20 has an open impedance at 5 GHz and the impedance is constant regardless of the position of the switch having been turned on. Thus also in FIG. 37B where the switch at 10° is turned on, the reflection coefficient at 5 GHz does not move from a point S. Therefore, it is understood that the resonant frequency of the overall circuit can be made invariable by properly providing the stub 8 regardless of the position of the switch having been turned on.

Figure 38:
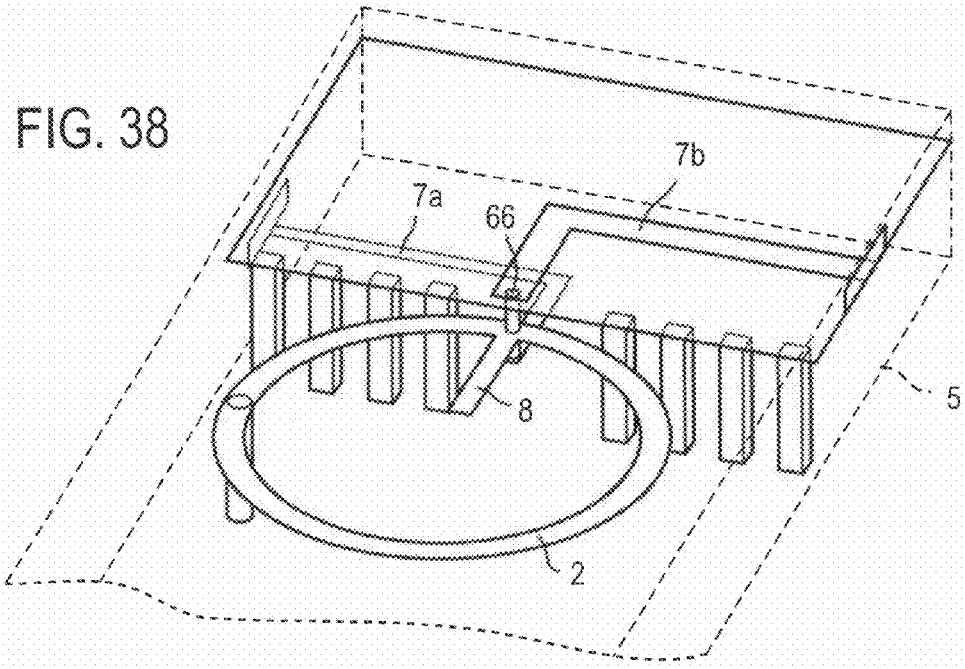
FIG. 38 is a perspective view showing a variable bandwidth filter having a multi-level configuration including an open-end stub.
Figure 39:
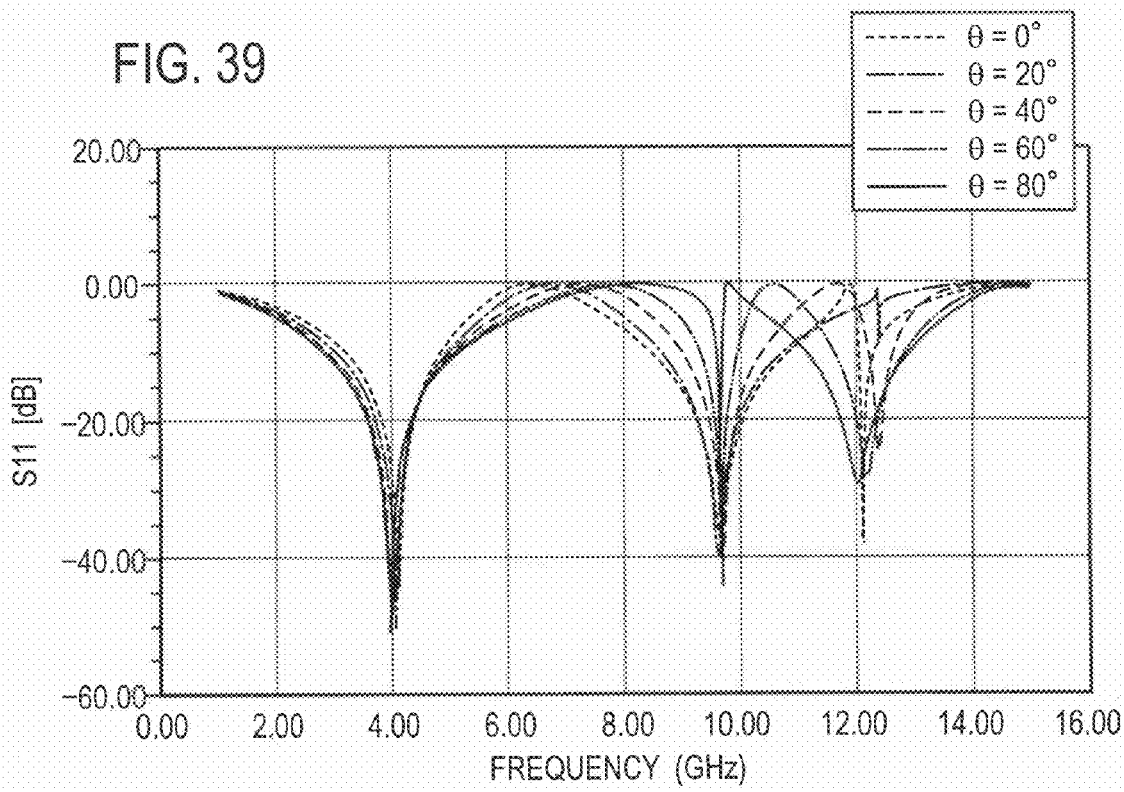
FIG. 39 is a graph showing frequency characteristics to indicate the effect of the open-end stub.

FIG. 38 shows a model for confirming the effect of the stub through electromagnetic field simulations. The stub 8 is added to the model of FIG. 31. FIG. 39 shows the frequency characteristics of the reflection coefficient. It is found that a frequency where S11 is minimized converges as compared with the characteristics of FIG. 32, so that the effect of the stub can be confirmed. In this case, the open-end stub is used as the circuit adjustment element 8. Any element can be used as long as the element can adjust a reactance. Moreover, a location where the circuit adjustment element 8 is connected is not limited to the connecting point of the resonator and the input/output line.

Figure 40A:
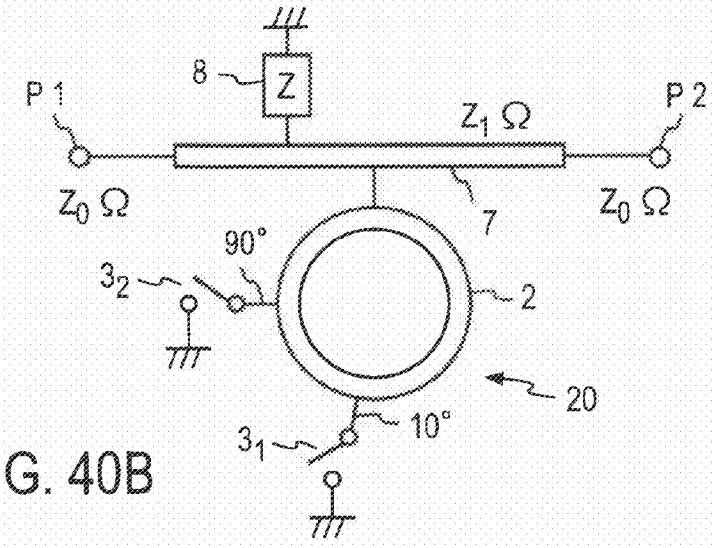
FIG. 40A shows an example in which a circuit adjustment element is inserted between the ground and the connecting point of an input/output line and a ring-shaped line.
Figure 40B:
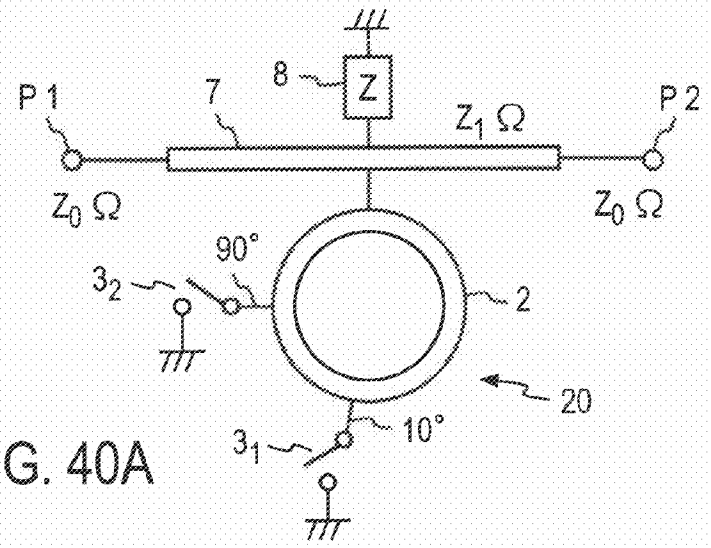
FIG. 40B shows an example in which the circuit adjustment element is inserted between the input/output line and the ground, on a position away from the connecting point of the input/output line and the ring-shaped line.
Figure 40C:
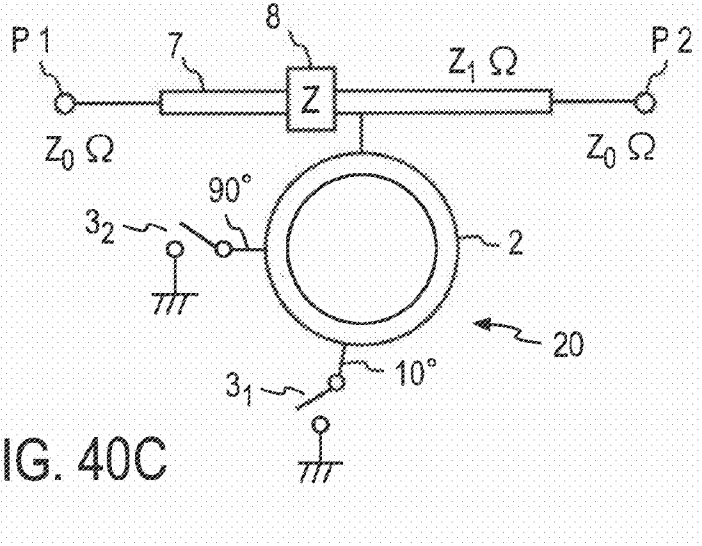
FIG. 40C shows an example in which the circuit adjustment element is inserted in series with the input/output line.
Figure 40D:
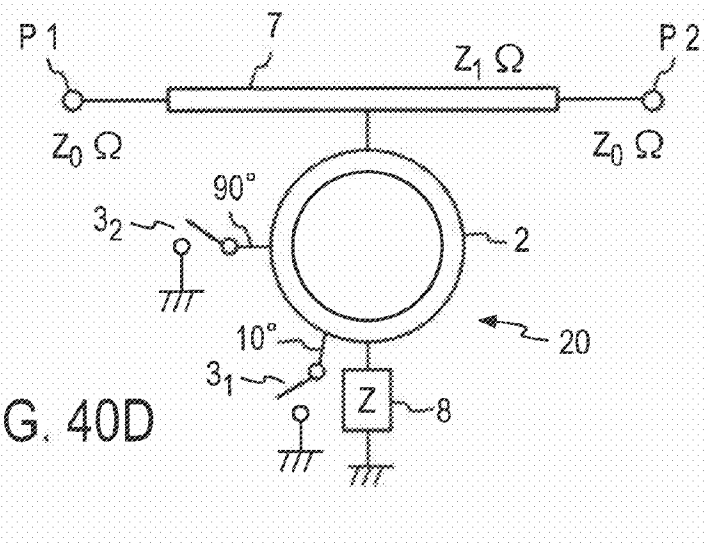
FIG. 40D shows an example in which the circuit adjustment element is inserted between the ring-shaped line and the ground.

FIGS. 40A to 40D show examples of the connecting point of the circuit adjustment element 8. FIG. 40A shows an example in which the circuit adjustment element 8 is connected to the connecting point of the input/output line 7 and the variable resonator 20 in parallel with the variable resonator 20. FIG. 40B shows an example in which the circuit adjustment element 8 is connected to the input/output line 7 in parallel with the variable resonator 20, between the connecting point of the input/output line 7 and the variable resonator 20 and the port P1. FIG. 40C shows an example in which the circuit adjustment element 8 is inserted in series with the input/output line 7. FIG. 40D shows an example in which the circuit adjustment element 8 is connected between the ring-shaped line 2 and the ground, on the angular position of N π on the variable resonator 20. In this case, N represents an integer of at least 1. In FIG. 41B (will be described later), N represents 0.

Figure 41A:
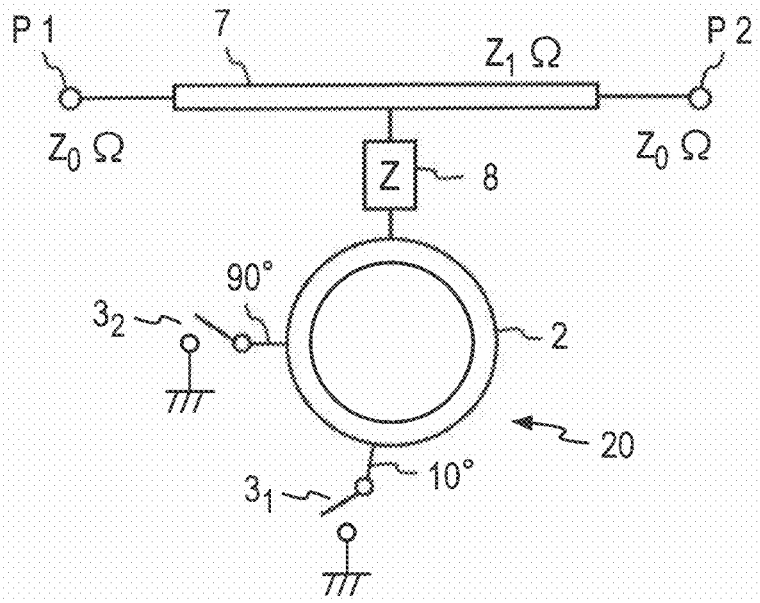
FIG. 41A shows an example in which a circuit adjustment element is provided between an input/output line and a ring-shaped line.
Figure 41B:
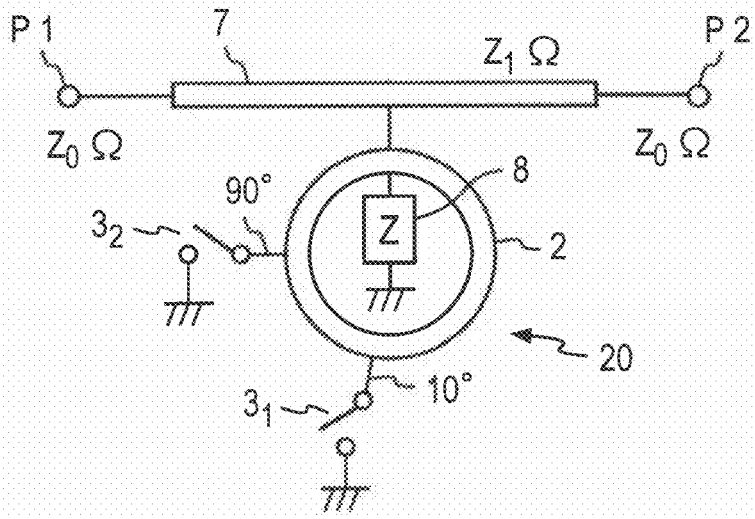
FIG. 41B shows an example in which the circuit adjustment element is disposed inside the ring-shaped line and connected between the ring-shaped line and the ground.

FIG. 41 shows another connection example of the circuit adjustment element 8. FIG. 41A shows an example in which the input/output line 7 and the variable resonator 20 are connected to each other via the circuit adjustment element 8. FIG. 41B shows an example in which the circuit adjustment element 8 is disposed inside the ring-shaped line 2 and is connected between the ground and the connecting position of the ring-shaped line 2 and the input/output line 7.

Figure 42:
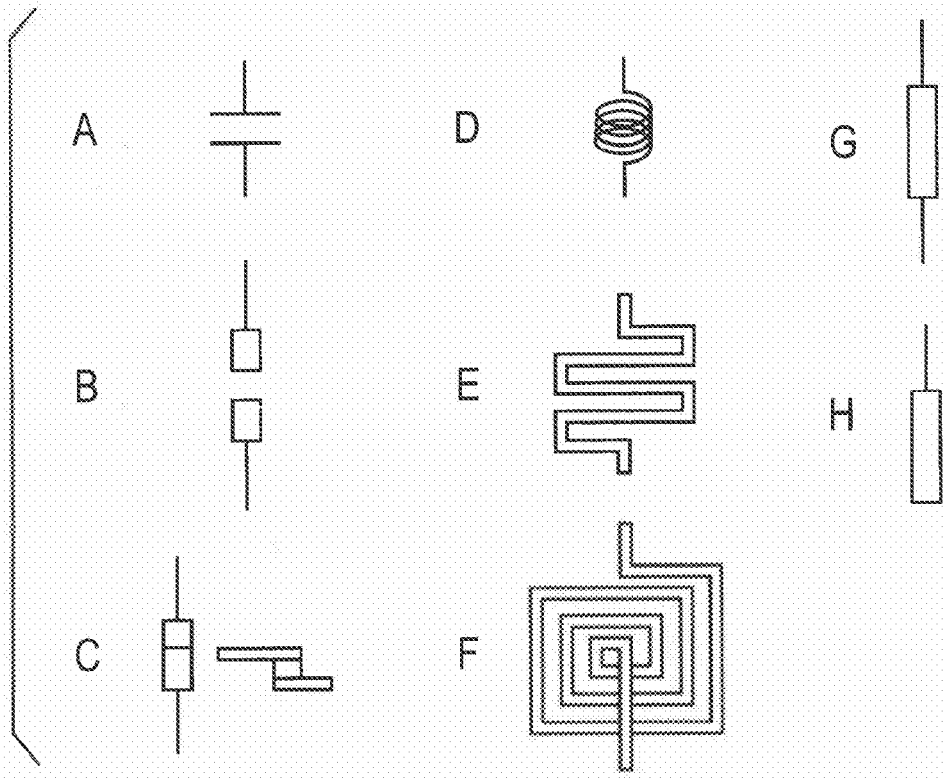
FIG. 42 shows examples of various circuit adjustment elements.

FIG. 42 shows various examples of the circuit adjustment element 8. FIG. 42A shows a capacitor acting as an individual element. FIG. 42B shows lines which form a gap in the same plane so as to act as a capacitor. FIG. 42C shows a multi-level line structure in which lines having different heights are opposed to each other with a dielectric interposed therebetween so as to act as a capacitor. FIG. 42D shows an inductor acting as an individual element. FIG. 42E shows a bent line acting as an inductor in a plane. FIG. 42F shows a spiral coil formed on a line. FIG. 42G shows a line inserted in series. FIG. 42H shows a line acting as an open-end stub.

Figure 43:
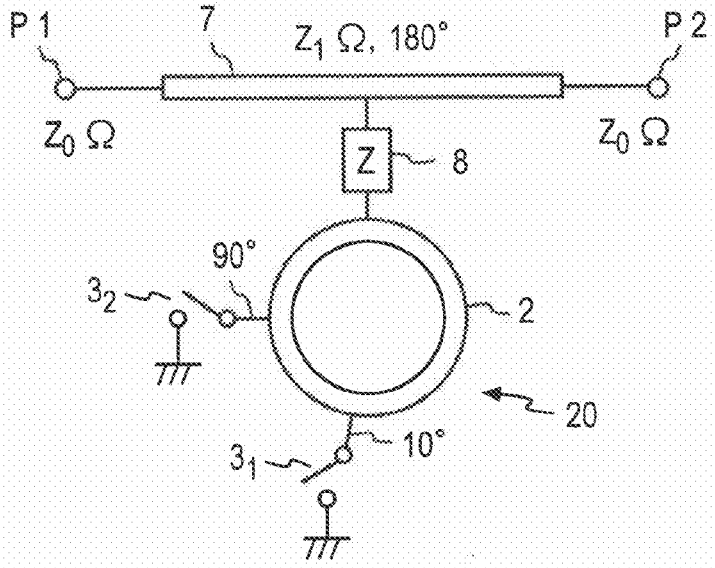
FIG. 43 shows an example an input/output line has a length of 180° instead of the provision of a circuit adjustment element.

This effect may be obtained without adding the circuit adjustment element 8. In this case, the input/output line 7 having the characteristic impedance $Z_1$ different from the port impedance $Z_0$ has a phase of 180° as shown in FIG. 43 or an integral multiple of the phase. This is because an input impedance viewed from the port P1 is always equal to the impedance of the port P2 due to the 180° line.

FIGS. 44 to 47 show structural examples of the variable bandwidth filer having the circuit adjustment element and also show the simulation results of the characteristics. In all the cases, the impedances of ports P1 and P2 are 50Ω, the impedance of an input/output line 7 is 60Ω, and two switches $\mathbf{3}_1$ and $\mathbf{3}_2$ are disposed on the position of 10° and the position of 90°. FIGS. 44B to 47B show characteristics when the switch $\mathbf{3}_1$ is turned on, and FIGS. 44C to 47C show characteristics when the switch $\mathbf{3}_2$ is turned on. Of these characteristics, a solid line indicates a transmission coefficient S21, a broken line indicates a reflection coefficient S11, and a thin line indicates characteristics in the absence of the circuit adjustment element 8.

Figure 44A:
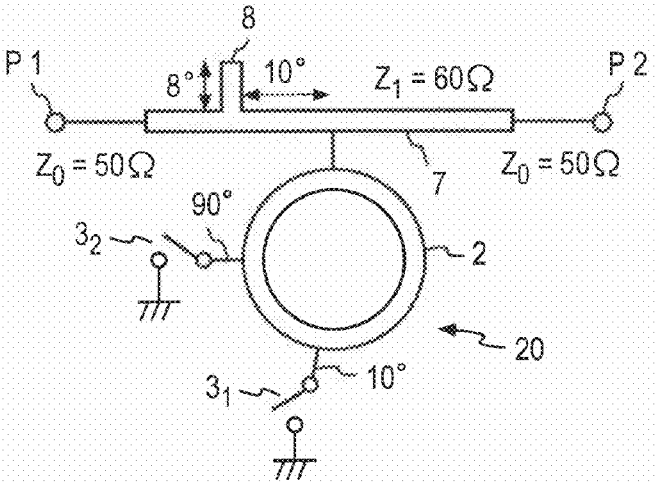
FIG. 44A shows circuit conditions for simulations when an open-end stub is provided on an input/output line.
Figure 44B:
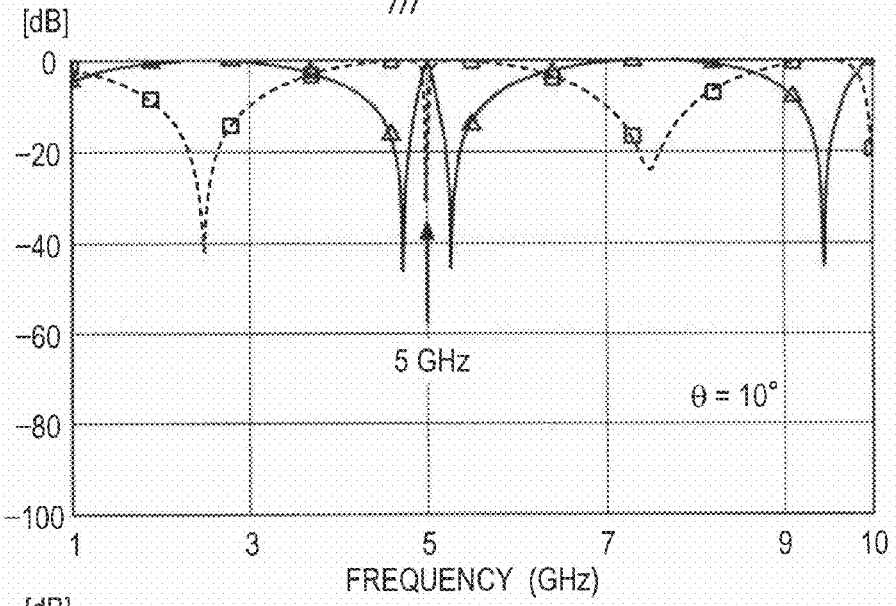
FIG. 44B is a graph showing the frequency characteristics for $\theta=10°$.
Figure 44C:
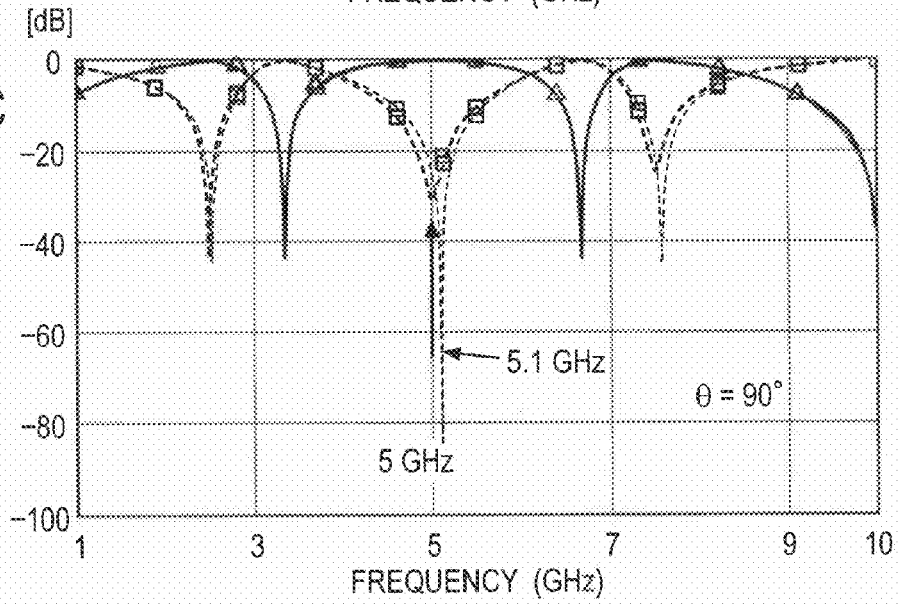
FIG. 44C is a graph showing the frequency characteristics for θ=90°.

FIG. 44A shows an example in which an open-end stub 8 is formed on the input/output line 7, on the position of a 10/360 wavelength at the resonance frequency from the connecting point between the input/output line 7 and the ring-shaped line 2 of the variable resonator. Even when switching a state in which the switch $\mathbf{3}_1$ is turned on to a state in which the switch $\mathbf{3}_2$ is turned on, the resonance frequency remains 5 GHz as shown in FIGS. 44B and 44C. However, when the stub 8 is not provided, the resonance frequency changes to 5.1 GHz as indicated by the thin line of FIG. 44C.

Figure 45A:
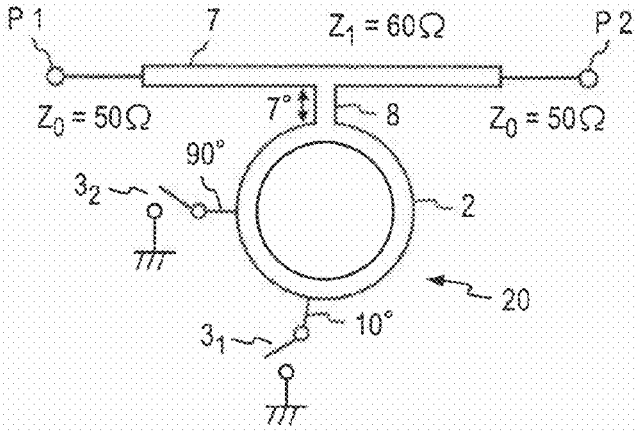
FIG. 45A shows circuit conditions for simulations when a line serving as a circuit adjustment element is inserted between an input/output line and a ring-shaped line.
Figure 45B:
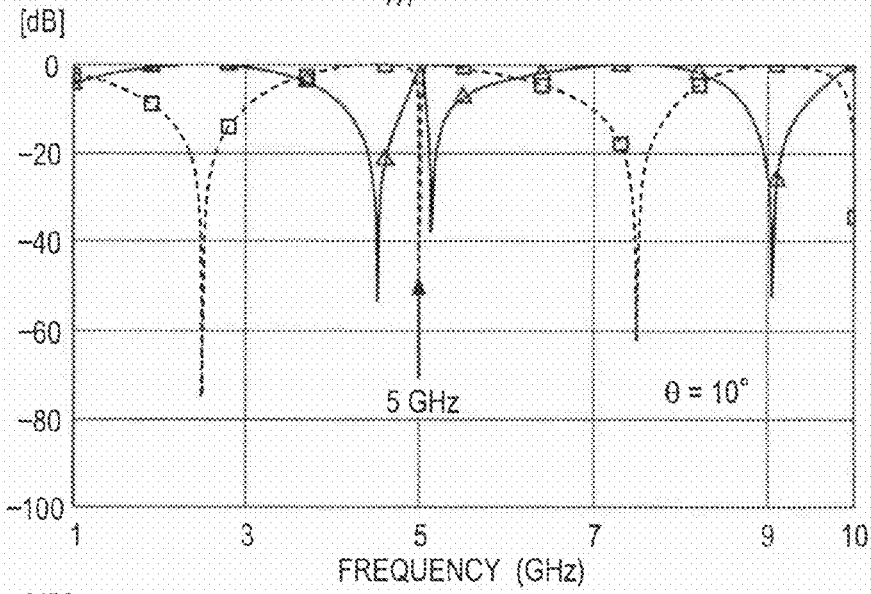
FIG. 45B is a graph showing the frequency characteristics for θ=10°.
Figure 45C:
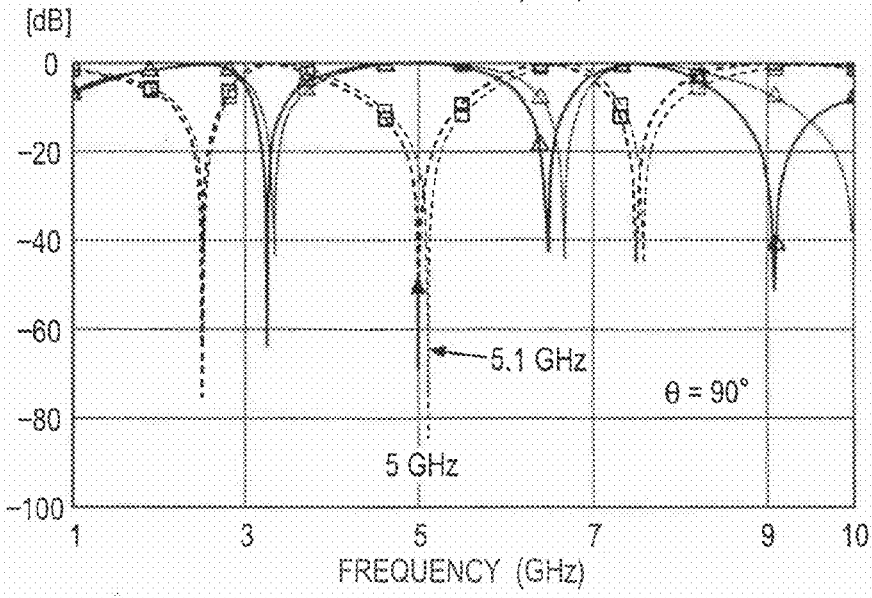
FIG. 45C is a graph showing the frequency characteristics for θ=90°.

FIG. 45A shows an example in which a line having a length of a 7/360 wavelength at the resonance frequency is inserted as the circuit adjustment element 8 between the input/output line 7 and the ring-shaped line 2. Also in this example, the resonance frequency does not change from 5 GHz as shown in FIGS. 45B and 45C even when the switches $3_1$ and $3_2$ are selectively turned on.

Figure 46A:
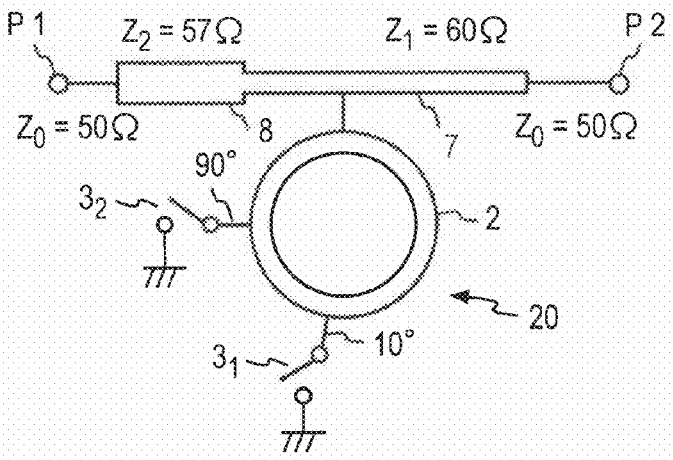
FIG. 46A shows circuit conditions for simulations when a line having different line widths is connected as a circuit adjustment element to an input/output line.
Figure 46B:
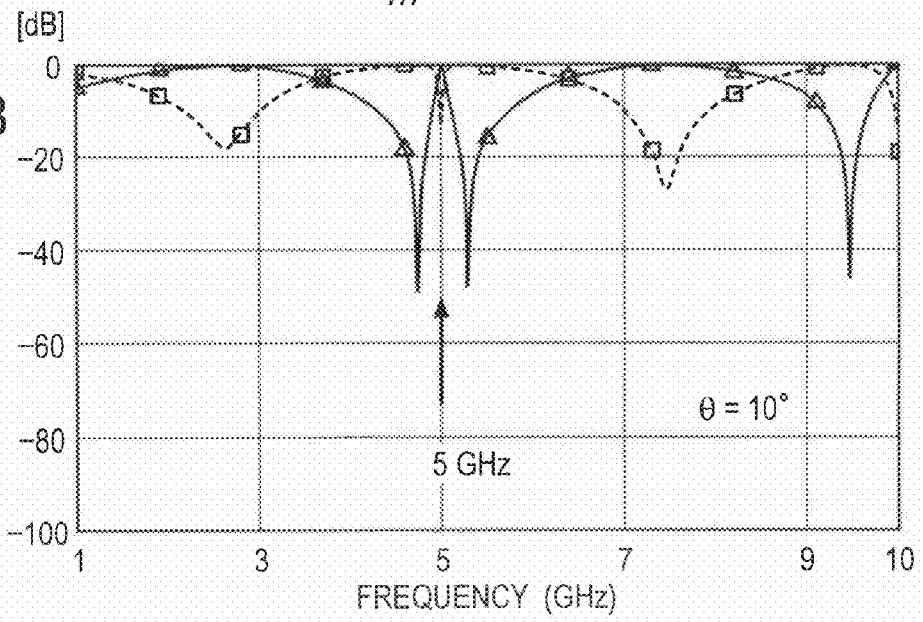
FIG. 46B is a graph showing the frequency characteristics for θ=10°.
Figure 46C:
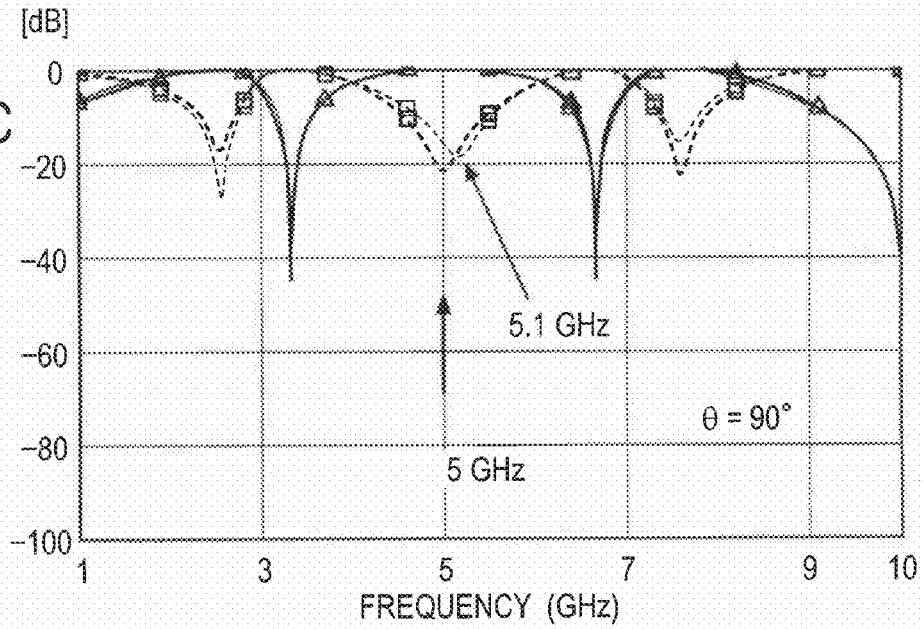
FIG. 46C is a graph showing the frequency characteristics for θ=90°.

FIG. 46A shows an example in which a line having a characteristic impedance of 57Ω is connected in series with the input end of the input/output line 7 as the circuit adjustment element 8. Also in this case, as is evident from FIGS. 45B and 45C, the resonance frequency does not change even when the switches $3_1$ and $3_2$ are switched.

Figure 47A:
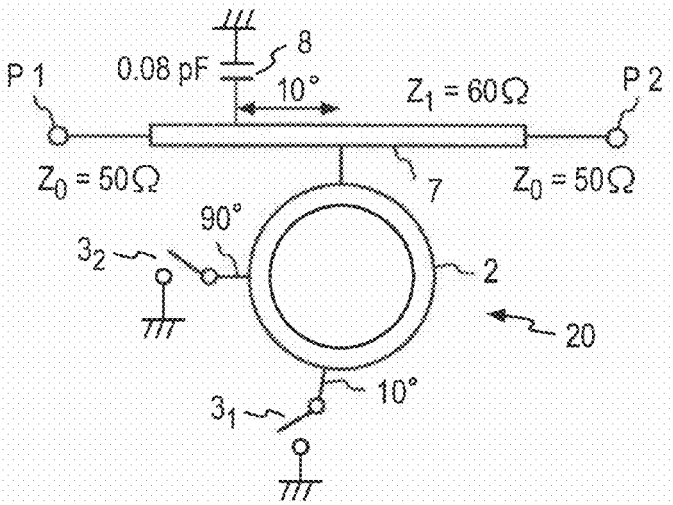
FIG. 47A shows circuit conditions for simulations when an individual capacitor is inserted as a circuit adjustment element between an input/output line and the ground.
Figure 47B:
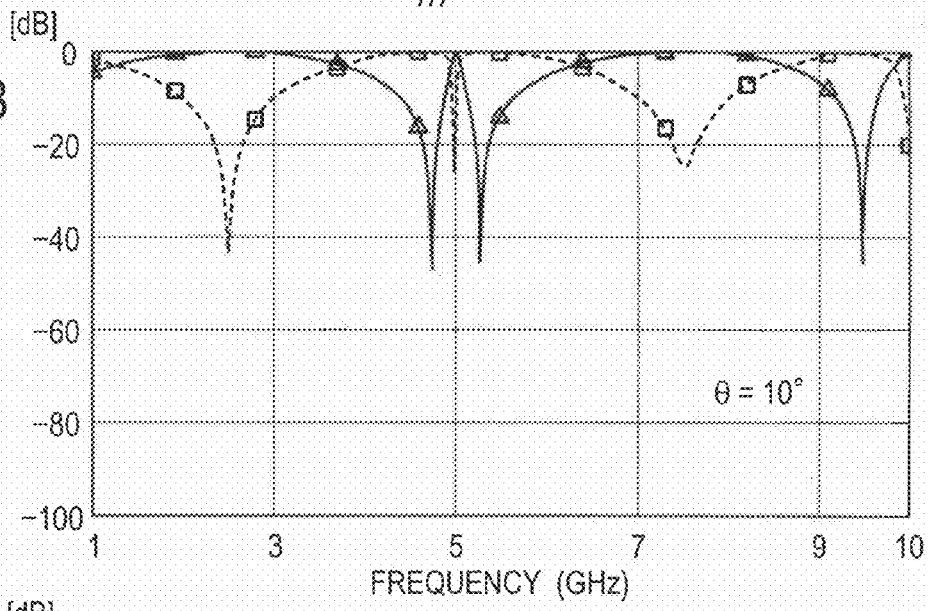
FIG. 47B is a graph showing the frequency characteristics for θ=10°.
Figure 47C:
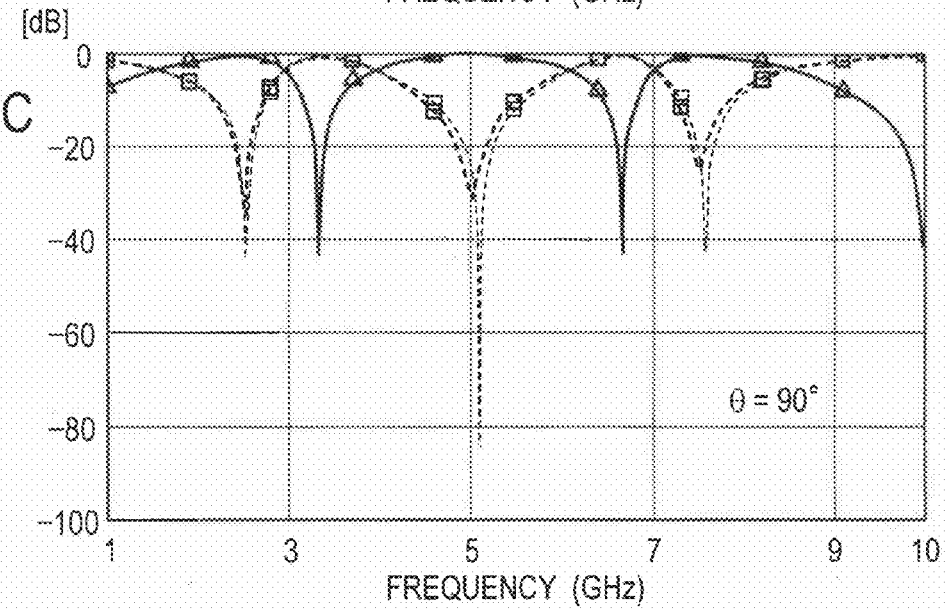
FIG. 47C is a graph showing the frequency characteristics for θ=90°.

FIG. 47A shows an example in which a capacitor of 0.08 pF is connected as the circuit adjustment element 8 between the input/output line 7 and the ground, instead of the open-end stub 8 of FIG. 44A. Also in this case, the resonance frequency does not change as shown in FIGS. 47B and 47C even when the switches $3_1$ and $3_2$ are selectively switched.

As described above, in all the examples, the function of the circuit adjustment element 8 makes the resonance frequency invariant regardless of the position of the switch having been turned on.

Figure 48A:
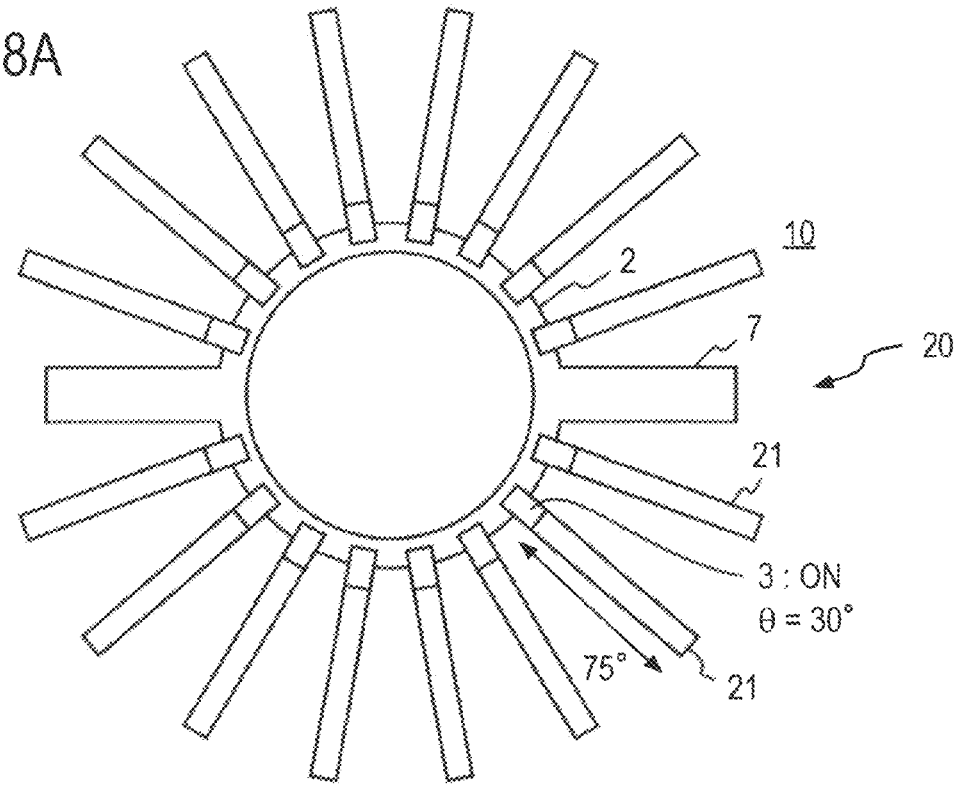
FIG. 48A shows an embodiment of a variable bandwidth filter in which the different positions of a ring-shaped conductor line can be connected to a transmission line via switches.

The variable resonators 20 of the foregoing embodiments enable direct grounding on different positions on the ring-shaped line 2 through the switch 3 or grounding through the passive element. An adjustment transmission line having desired characteristics may be connected via the switch 3. FIG. 48A shows the structural example.

FIG. 48A shows a modification of the variable bandwidth filter 10 shown in FIG. 13. As in FIG. 48A, a variable resonator 20 is inserted in series with an input/output line 7. Instead of grounding the ring-shaped conductor line 2 on a desired position via the switch 3, the ring-shaped conductor line 2 can be connected via the switch 3 to an adjustment transmission line 21 having desired characteristics. In this example, the electric length of each adjustment transmission line 21 is 75° at the center frequency of a used frequency band and the end of the adjustment transmission line 21 is opened.

Figure 48B:
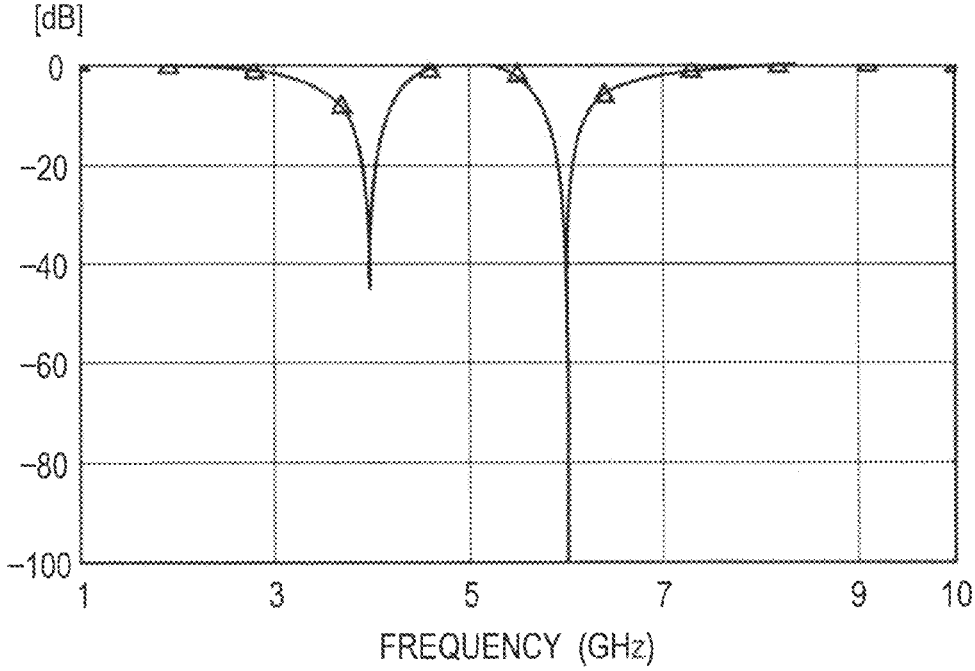
FIG. 48B shows the frequency characteristics of the variable bandwidth filter.

FIG. 48B shows the frequency characteristics of a transmission coefficient when the switch 3 at θ=30° is turned on in FIG. 48A. In this example, unlike FIG. 14 showing the characteristics of the variable bandwidth filter of FIG. 13, two transmission zeros appear substantially symmetrically with respect to the resonance frequency of 5 GHz. These transmission zeros appear on both sides of the resonance frequency and thus it is possible to control attenuation characteristics on the high-frequency side and the low-frequency side of the resonance frequency. Although FIG. 48A shows the case where adjustment transmission lines 21 of the same electric length are connected to all the switches 3, adjustment transmission lines of desired electric lengths may be connected to the respective switches 3 depending on required characteristics. The same is true for the following embodiments.

Figure 49A:
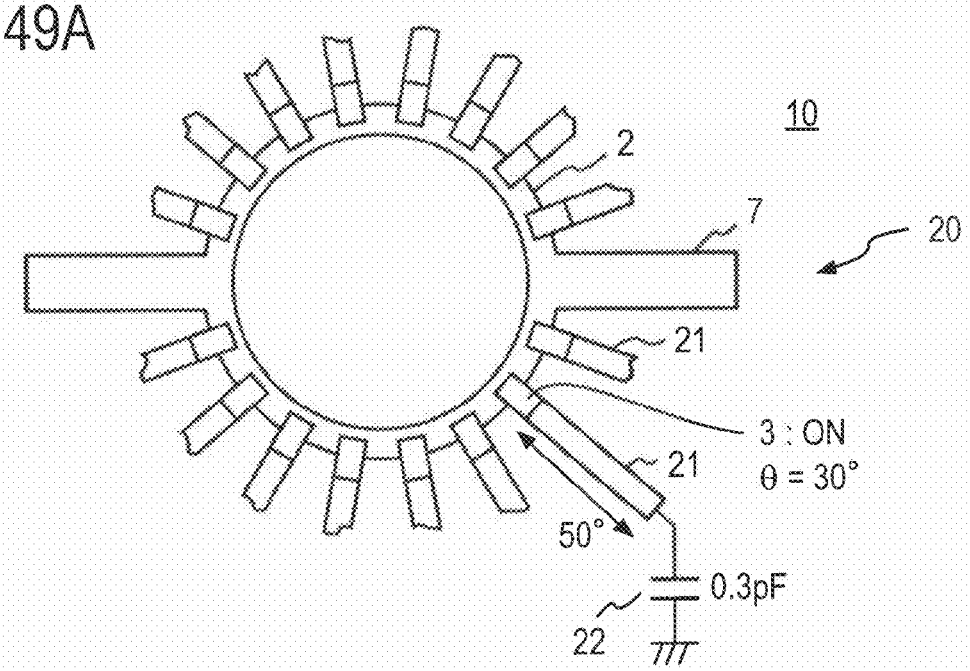
FIG. 49A shows a modification of the variable bandwidth filter of FIG. 48.
Figure 49B:
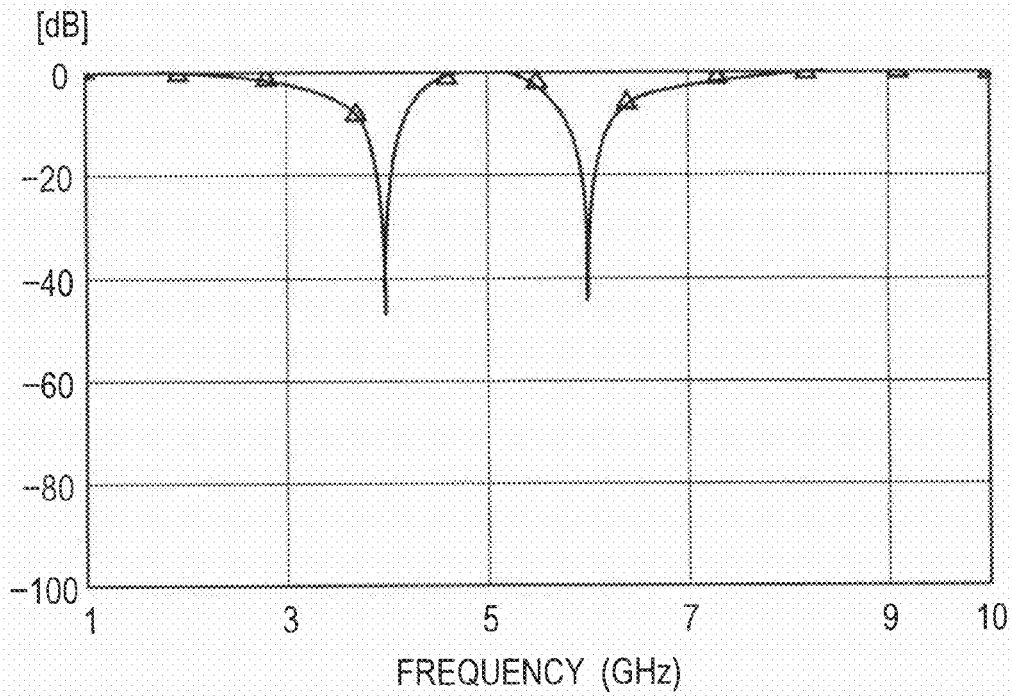
FIG. 49B shows the frequency characteristics of the variable bandwidth filter.

FIG. 49A shows an example in which the electric length of each adjustment transmission line 21 of FIG. 48A is shortened to 50° and the end of the adjustment transmission line 21 is grounded via a capacitor 22. FIG. 49B shows the frequency characteristics of a transmission coefficient in this configuration. Also in this case, the switch 3 at θ=30° is turned on. The adjustment transmission line 21 connected to the switch 3 and the capacitor 22 connected to the end of the adjustment transmission line 21 are illustrated only for one of the switches 3, and the intermediate portions and ends of the other adjustment transmission lines 21 and the capacitors 22 connected to the ends of the other transmission lines 21 are not shown. Comparisons between FIGS. 49B and 48B prove that the passband widths around 5 GHz are the same. In other words, although the same passband width is obtainable, the electric lengths can be equivalently increased by grounding the ends of the adjustment transmission lines 21 through the capacitors 22. Accordingly, the electric length of the adjustment transmission line 21 can be reduced. In FIG. 49A, the electric length of each adjustment transmission line 21 and capacitance of the capacitor 22 may be set to desired values depending on required characteristics.

Figure 50:
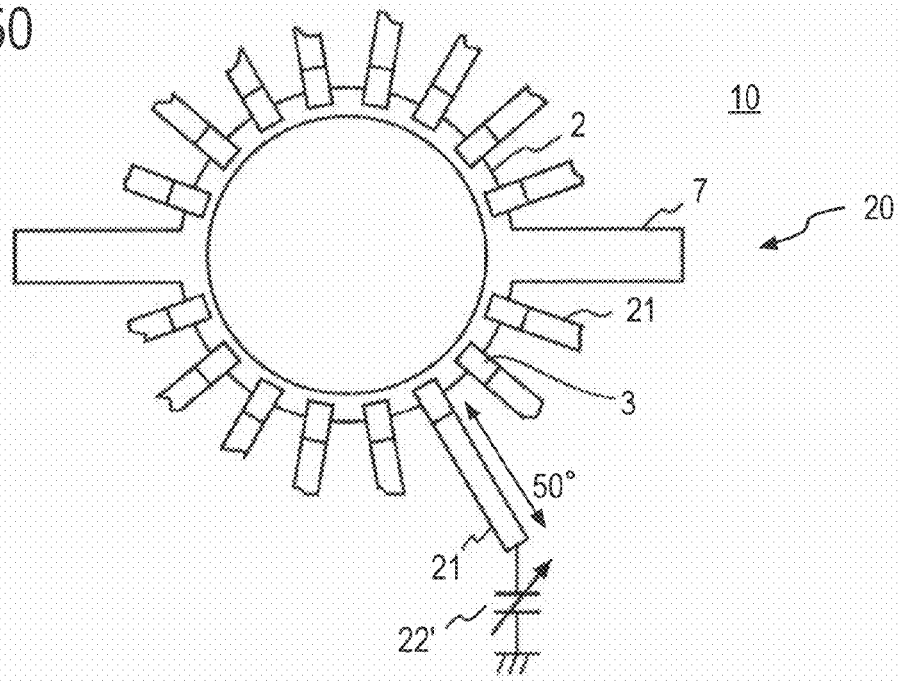
FIG. 50 shows a modification of the variable bandwidth filter shown in FIG. 49A.

In the example of FIG. 50, a variable capacitance element 22' is used instead of the capacitor 22 of FIG. 49A. However, the electric length of the adjustment transmission line 21 is not limited to 50°. With the adjustment transmission lines 21 and the variable capacitance elements 22', it is possible to equivalently adjust electric lengths. In other words, it is possible to adjust the positions of the transmission zeros in FIG. 49B.

Figure 51:
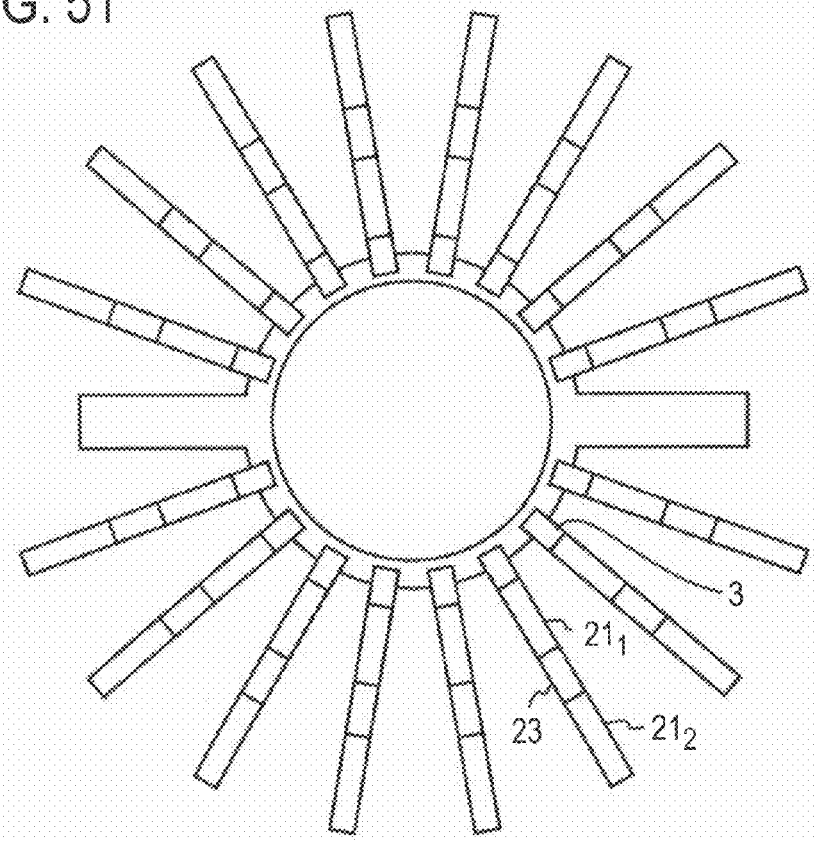
FIG. 51 shows another modification of the variable bandwidth filter shown in FIG. 48A.

In the example of FIG. 51, on the end of each adjustment transmission line $21_1$ which correspond to the adjustment transmission line 21 of the example of FIG. 48A and has a desired electric length, an adjustment transmission line $21_2$ having a desired electric length is further connected via a switch 23. The electric length of the adjustment transmission line connected to the switch 3 can be changed by turning on/off the switch 23. Thus the positions of the transmission zeros of the frequency characteristics can be adjusted.

Figure 52:
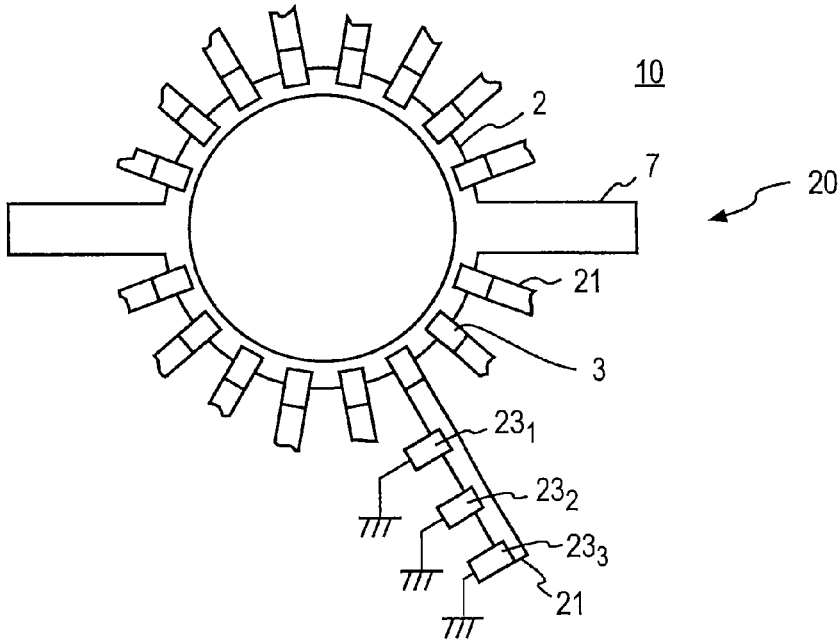
FIG. 52 shows still another modification of the variable bandwidth filter shown in FIG. 48A.

In the example of FIG. 52, at least two switches are provided on different positions including its end position along the length of each adjustment transmission line 21 connected to the switches 3 of FIG. 48A. In this example, three switches $23_1$, $23_2$ and $23_3$ are provided to enable grounding. This configuration can also adjust the positions of the transmission zeros of the frequency characteristics. The electric length of the adjustment transmission line 21 is not limited to 75°. By turning on desired one of the switches $23_1$, $23_2$ and $23_3$, it is possible to select the case where the adjustment transmission line 21 is grounded with a desired electric length and the case where all the switches are turned off and the ends of the adjustment transmission lines 21 are opened without being grounded.

Figure 53:
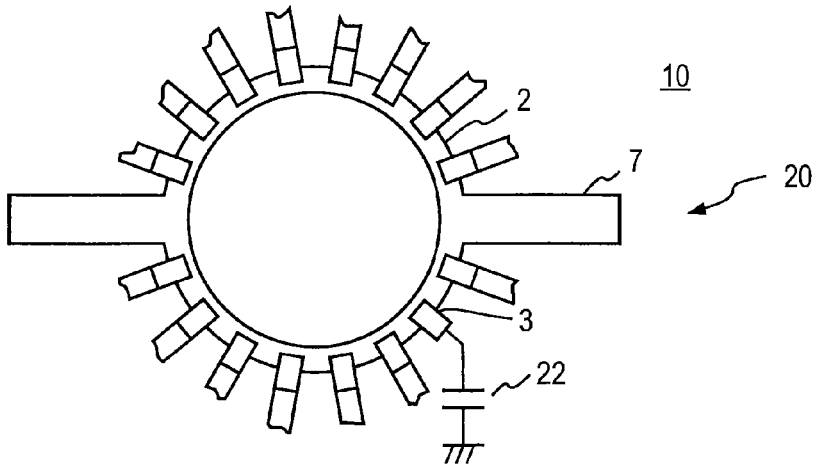
FIG. 53 shows still another modification of the variable bandwidth filter shown in FIG. 48A.

In FIG. 49A, the end of the adjustment transmission line 21 can be grounded through the capacitor 22, thereby reducing the electric length of the adjustment transmission line 21. As shown in FIG. 53, the adjustment transmission line 21 may not be connected and each switch 3 having one end connected to the ring-shaped line 2 may have the other end grounded directly through the capacitor 22. Also in this case, as in FIG. 49B, it is possible to obtain frequency characteristics having two transmission zeros near both sides of the resonance frequency.

FIGS. 48A, 49A, 50, 51, 52 and 53 show examples in which the variable resonator 20 is used to configure the variable bandwidth filter 10. These variable resonators 20 may be used in any of the variable resonators shown in FIGS. 5A, 5B, 7B, 7D, 8, 9, 10, 11A, 11B, 11C, 15, 16, 18, 19, 20A, 20B, 21A, 23A, 23B, 24, 26 to 29, 40A to 40D, 41A, 41B, 44A, 45A, 46A and 47A.

In FIGS. 49 to 53, the variable bandwidth filter has the variable resonator inserted in series with the input/output line as in the example of FIG. 13. Also in the variable bandwidth filter having the variable resonator connected in parallel with the input/output line, adjustment transmission lines may be connected to the switches 3 of the ring-shaped conductor line composing the variable resonator.

Figure 54:
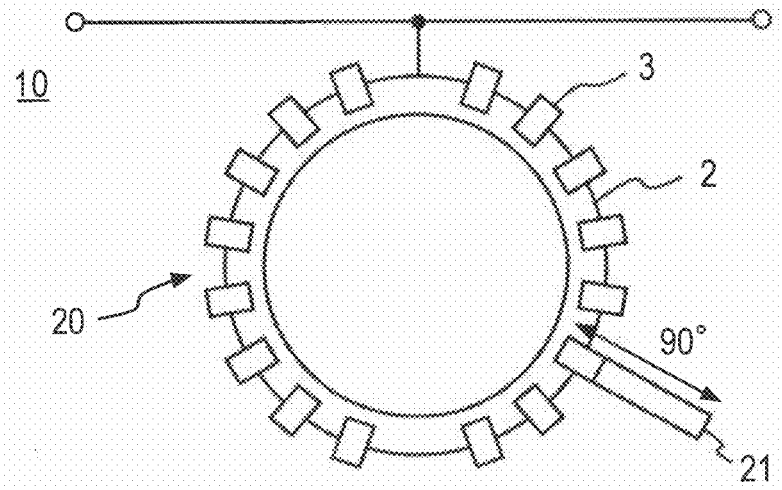
FIG. 54 shows an embodiment of a variable resonator in which open-end transmission lines are connected to switches connected to a ring-shaped conductor line.

FIG. 54 shows an example in which instead of grounding one end of a switch 3 having the other end connected to a ring-shaped line 2, an adjustment transmission line 21 having an open end is connected to the one end of each switch 3, in the example in which the variable resonator 20 of FIG. 1A or 1B is connected in parallel with the input/output line 7. In this configuration, an electric length from the connecting point between the switch 3 and the ring-shaped conductor line 2 to the open end of the adjustment transmission line 21 is selected 90° (λ/4) at the used frequency. In FIG. 54, the adjustment transmission line 21 is shown only for one of the switches 3 and the illustration for the other switches 3 is omitted. With this configuration, a connecting point of desired one of the switches 3 and the ring-shaped conductor line 2 is equivalently grounded when the switch 3 is turned on, thereby avoiding the influence of a phase change caused by the structure of the switch 3 (for example, the length of the switch in the signal transmission direction). In contrast, in FIGS. 1A and 1B, a signal phase change occurs due to the structure from the connecting point of the ring-shaped conductor line 2 and the switch 3 having been turned on to a ground point. Hence, the configuration of FIG. 54 is effective for avoiding the influence of such a phase change.

Figure 55:
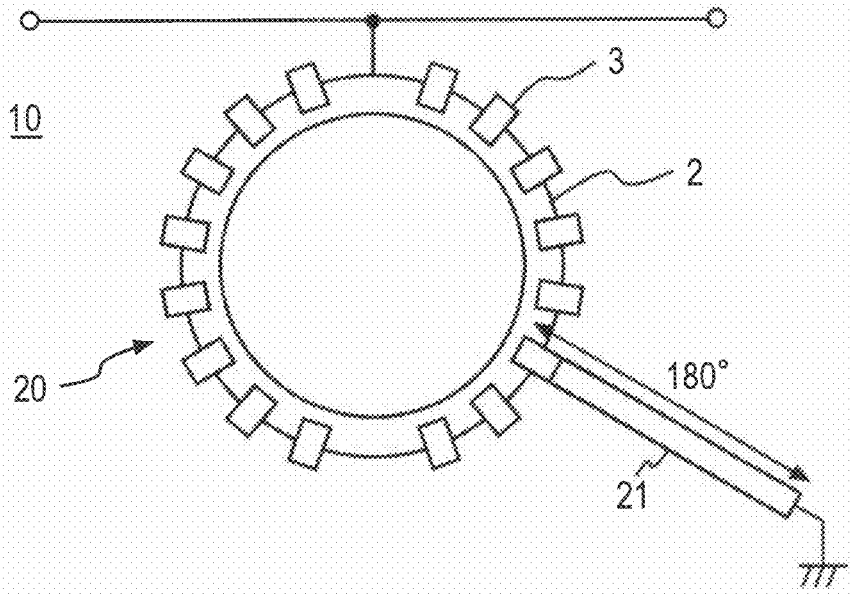
FIG. 55 shows an embodiment of a variable resonator in which short-circuited end transmission lines are connected to a ring-shaped conductor line.

FIG. 55 shows a modification of FIG. 54. An adjustment transmission line 21 whose end is short-circuited to the ground is connected to each switch 3. In this configuration, an electric length from the connecting point of the switch 3 and the ring-shaped conductor line to the short-circuited point on the end of the transmission line 21 is selected 180° (λ/2) at the frequency to be used. In this case, as in the case of FIG. 54, a connecting point of desired one of the switches 3 having been turned on and the ring-shaped conductor line 2 is equivalently grounded, thereby avoiding a signal phase change caused by the structure of the switch 3.

The open-end adjustment transmission line 21 or the adjustment transmission line 21 having the short-circuited end in FIGS. 54 and 55 can be used in the embodiments of FIGS. 5A, 5B, 8 to 11, 13, 15 to 21, 23, 24, 26 to 31, 38, 40, 41, and 43 to 47 as well as the examples of FIGS. 1A and 1B.

What is claimed is:

1. A variable resonator, comprising:

a ring-shaped conductor line provided on a dielectric substrate and having a circumferential length of a wavelength or an integral multiple of the wavelength at a resonance frequency of the variable resonator; and at least two first circuit switches, wherein each of said at least two first circuit switches has one end electrically connected to said ring-shaped conductor line and an other end electrically connected to a corresponding adjustment transmission line formed on the dielectric substrate, and each of said at least two first circuit switches is configured to select interchangeably electrical connection or electrical disconnection between said corresponding adjustment transmission line and said ring-shaped conductor line;

positions on said ring-shaped conductor line, each of which is electrically connected to said one end of a corresponding one of said at least two first circuit switches, are different from one another;

only one of said at least two first circuit switches is selected to turn to an on-state; and a bandwidth at the resonance frequency changes in response to a change of said selection of said only one of said at least two first circuit switches with said resonance frequency being constant.

2. The variable resonator according to claim 1, wherein the positions are located on said ring-shaped conductor line except at a connecting portion to be connected to an input/output line and a position of a half wavelength or an integral multiple of the half wavelength from the connecting portion at the resonance frequency.

3. The variable resonator according to claim 1, wherein said ring-shaped conductor line is a closed path formed with a plurality of conductor lines having different line widths.

4. The variable resonator according to claim 1, comprising:

a first conductor line adapted to be a part of the ring-shaped conductor line;

at least two second conductor lines, each being adapted to be a part of the ring-shaped conductor line and lengths of said at least two second conductor lines are different from each other; and pairs of circuit switch parts, each of said pairs being configured to select interchangeably electrical connection or electrical disconnection between both ends of said first conductor line and both ends of a selected one of said at least two second conductor lines, wherein the ring-shaped conductor line is a closed path formed with an electrical combination of said first conductor line and the selected one of said at least two second conductor lines by a corresponding one of said pairs of circuit switch parts, so that the resonance frequency changes in response to a change of circumferential lengths of the ring-shaped conductor line that depends on the lengths of said at least two second conductor lines.

5. A variable resonator comprising:

first and second variable resonators that each have features according to the variable resonator of claim 1; and circuit switch parts, each for electrically connecting said first variable resonator and said second variable resonator to each other, wherein said second variable resonator is disposed inside said ring-shaped conductor line of said first variable resonator.

6. The variable resonator according to claim 5, wherein a number of said circuit switch parts is two;

one position at which one of said circuit switch parts electrically connects said first variable resonator and said second variable resonator is different from an other position at which an other one of said circuit switch parts electrically connects said first variable resonator and said second variable resonator; and said one position is located away from the other position with an interval of a half wavelength or an integral multiple of the half wavelength at a resonance frequency of said first variable resonator on said ring-shaped conductor line of said first variable resonator and with an interval of a half wavelength or an integral multiple of the half wavelength at a resonance frequency of said second variable resonator on said ring-shaped conductor line of said second variable resonator.

7. A variable bandwidth filter, comprising:

the variable resonator according to claim 1; and an input/output line, wherein said variable resonator and the input/output line are electrically connected to each other.

8. The variable bandwidth filter according to claim 7, wherein said variable resonator is connected in parallel with the input/output line at one connecting portion.

9. The variable bandwidth filter according to claim 7, further comprising another input/output line, wherein said variable resonator is connected with an end of the input/output line and an end of said another input/output line at two connecting portions on said ring-shaped conductor line of said variable resonator;

the two connecting portions are separated from each other by a half wavelength or an integral multiple of the half wavelength at the resonance frequency of said variable resonator; and said positions on said ring-shaped conductor line of said variable resonator are different from said two connecting portions.

10. The variable bandwidth filter according to claim 7, further comprising a circuit adjustment element connected to at least one of said input/output line and said ring-shaped conductor line of said variable resonator.

11. The variable bandwidth filter according to claim 10, wherein said circuit adjustment element is inserted between said ring-shaped conductor line and a ground conductor.

12. The variable bandwidth filter according to claim 11, wherein said circuit adjustment element is at a position apart from a connecting position between said input/output line and said ring-shaped conductor line by an electric length $N\pi$ where N represents an integer equal to or greater than zero.

13. The variable bandwidth filter according to claim 10, wherein said circuit adjustment element is inserted between said input/output line and said ring-shaped conductor line.

14. The variable bandwidth filter according to claim 10, wherein said circuit adjustment element is connected in series with said input/output line.

15. A variable bandwidth filter, comprising:

at least two variable resonators, each having features according to the variable resonator of claim 1; and an input/output line, wherein each of said at least two variable resonators is connected in parallel with the input/output line at one connecting portion via a second circuit switch configured to select interchangeably electrical connection to or disconnection from the input/output line; and any one or more of said at least two variable resonators are connected electrically to the input/output line, each said second circuit switch being selected to turn to an on-state or an off-state.

16. An electric circuit device, comprising:

the variable resonator according to claim 1; and an input/output line comprising a first line and a second line, wherein one end of said second line is connected to a connecting portion between one end of said first line and the ring-shaped conductor line of said variable resonator, so that said first line, said second line, and said ring-shaped conductor line are electrically connected to one another; and on the connecting portion, said one end of said first line and said one end of said second line are disposed on different planes.

17. An electric circuit device, comprising:

the variable resonator according to claim 1; and an input/output line having a bent portion, wherein said bent portion of said input/output line and said ring-shaped conductor line of said variable resonator are electrically connected to each other.

18. The electric circuit device according to claim 17, wherein in the vicinity of a portion where said bent portion of said input/output line and said ring-shaped conductor line of said variable resonator are electrically connected to each other, the ring-shaped conductor line of the variable resonator forms an angle with respect to the input/output line.

19. The electric circuit device according to any one of claims 16 to 18, further comprising a circuit adjustment element connected to at least one of said input/output line and said ring-shaped conductor line of said variable resonator.

20. The electric circuit device according to claim 19, wherein said circuit adjustment element is inserted between said ring-shaped conductor line and a ground conductor.

21. The electric circuit device according to claim 20, wherein said circuit adjustment element is at a position apart from a connecting position between said input/output line and said ring-shaped conductor line by an electric length $N\pi$where N represents an integer equal to or greater than zero.

22. The electric circuit device according to claim 19, wherein said circuit adjustment element is inserted between said input/output line and said ring-shaped conductor line.

23. The electric circuit device according to claim 19, wherein said circuit adjustment element is connected in series with said input/output line.

24. A variable resonator, comprising:

a ring-shaped conductor line provided on a dielectric substrate and having a circumferential length of a wavelength or an integral multiple of the wavelength at a resonance frequency of the variable resonator;

at least two first circuit switches, each of the at least two first circuit switches including a first part and a second part different from the first part; and at least one adjustment transmission line formed on the dielectric substrate, wherein each first part of said at least two first circuit switches has one end electrically connected to said ring-shaped conductor line and an other end electrically connected to a ground conductor formed on the dielectric substrate, and each first part of said at least two first circuit switches is configured to select interchangeably electrical connection or electrical disconnection between said ground conductor and said ring-shaped conductor line;

each second part of said at least two first circuit switches has one end electrically connected to said ring-shaped conductor line and an other end electrically connected to a corresponding one of said at least one adjustment transmission line, and each second part of said at least two first circuit switches is configured to select interchangeably electrical connection or electrical disconnection between the corresponding one of said at least one adjustment transmission line and the ring-shaped conductor line;

positions on said ring-shaped conductor line, each of which is electrically connected to said one end of a corresponding one of said at least two first circuit switches, are different from one another;

only one of said at least two first circuit switches is selected to turn to an on-state; and a bandwidth at the resonance frequency changes in response to a change of said selection of said only one of said at least two first circuit switches with said resonance frequency being constant.

25. A variable bandwidth filter, comprising:

at least one variable resonator that each has features according to the variable resonator of claim 24; and an input/output line, wherein said at least one variable resonator and the input/output line are electrically connected to each other.

* * * * *